US007530656B2

(12) United States Patent
Endo et al.

(10) Patent No.: US 7,530,656 B2
(45) Date of Patent: May 12, 2009

(54) LIQUID-EJECTING APPARATUS AND PRINTING SYSTEM

(75) Inventors: Hironori Endo, Nagano-ken (JP); Hirokazu Nunokawa, Nagano-ken (JP); Hitoshi Igarashi, Nagano-ken (JP); Satoshi Nakata, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 420 days.

(21) Appl. No.: 10/522,307

(22) PCT Filed: Jul. 23, 2003

(86) PCT No.: PCT/JP03/09339

§ 371 (c)(1),
(2), (4) Date: Sep. 26, 2005

(87) PCT Pub. No.: WO2004/011262

PCT Pub. Date: Feb. 5, 2004

(65) Prior Publication Data

US 2006/0055718 A1 Mar. 16, 2006

(30) Foreign Application Priority Data

Jul. 25, 2002 (JP) ..... 2002-217232
Apr. 23, 2003 (JP) ..... 2003-119002

(51) Int. Cl.
*B41J 29/38* (2006.01)

(52) U.S. Cl. ..... 347/16; 347/14; 347/104

(58) Field of Classification Search ..... 347/16
See application file for complete search history.

(56) References Cited

U.S. PATENT DOCUMENTS 5,192,141 A 3/1993 Chung et al.
5,917,995 A * 6/1999 Ota ..... 358/1.12
5,934,664 A 8/1999 Murayama et al.
6,371,592 B1 4/2002 Otsuka et al.
6,464,417 B2 * 10/2002 Barbera et al. ..... 400/711

FOREIGN PATENT DOCUMENTS

| | | | |
|---|---|---|---|
| EP | 0 556 045 A2 | | 8/1993 |
| EP | 0 816 107 A2 | | 1/1998 |
| JP | 03-234621 A | | 10/1991 |
| JP | 5-221103 A | | 8/1993 |
| JP | 05221103 | * | 8/1993 |
| JP | 10-72144 A | | 3/1998 |
| JP | 10-138583 | | 5/1998 |
| JP | 10138583 | * | 5/1998 |
| JP | 2000-289252 A | | 10/2000 |
| JP | 2002-103721 A | | 4/2002 |
| JP | 2002-103586 A | | 9/2002 |

* cited by examiner

*Primary Examiner*—Luu Matthew
*Assistant Examiner*—Brian J Goldberg
(74) *Attorney, Agent, or Firm*—Sughrue Mion, PLLC

(57) ABSTRACT

The present invention relates to a liquid ejecting apparatus including: a movable head provided with a plurality of nozzles for ejecting a liquid; a carry unit for carrying a medium in a predetermined carrying direction; and a sensor for detecting an edge of the medium, the liquid ejecting apparatus controlling ejection of the liquid from the plurality of nozzles in accordance with a result of the detection of the sensor. In this liquid ejecting apparatus, the position, in the carrying direction, of the sensor is at the same position of or on an upstream side of a nozzle located most upstream in the carrying direction, of among the plurality of nozzles. In this way, it is possible to arrange the sensor for detecting the edge of the paper at the most suitable position, and to suppress waste of ink that is ejected from the nozzles.

17 Claims, 33 Drawing Sheets

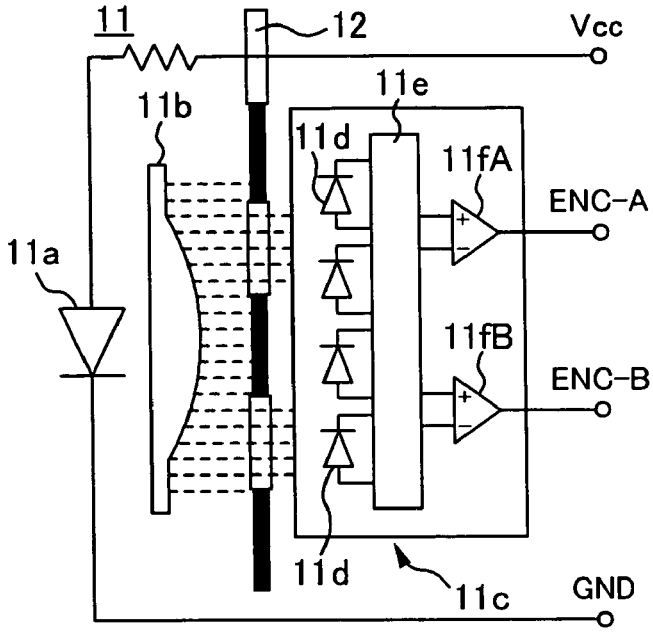
FIG. 5
FIG. 6A
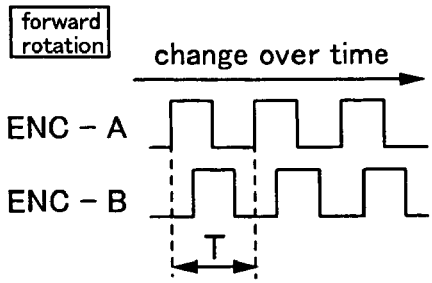
FIG. 6B
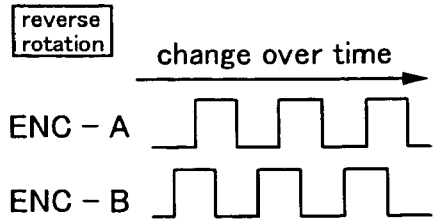
FIG. 6

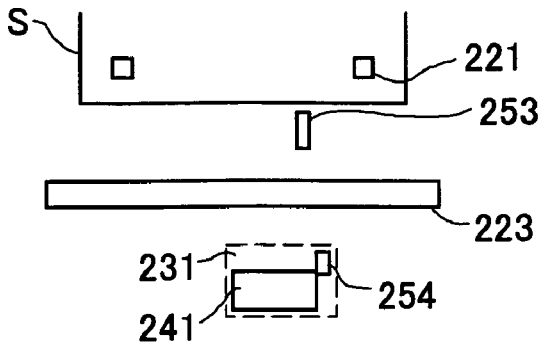
FIG. 22A
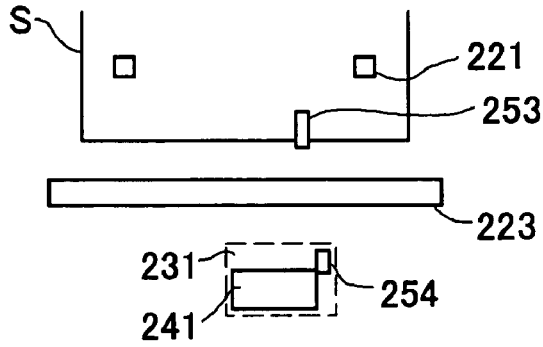
FIG. 22B
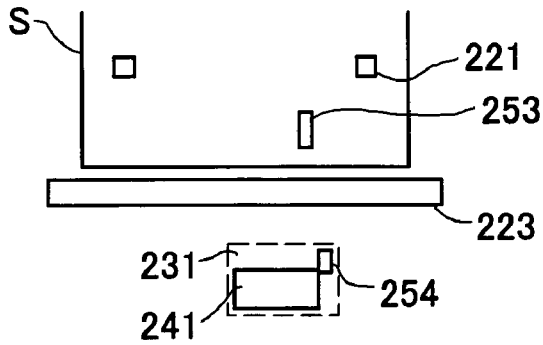
FIG. 22C
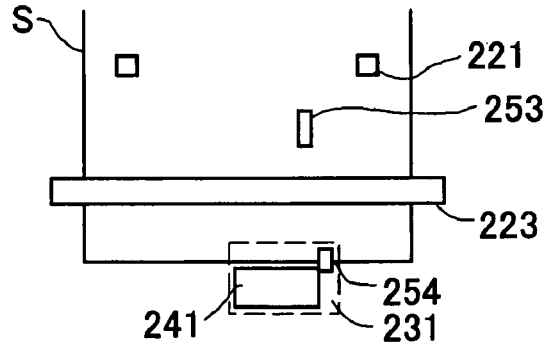
FIG. 22D
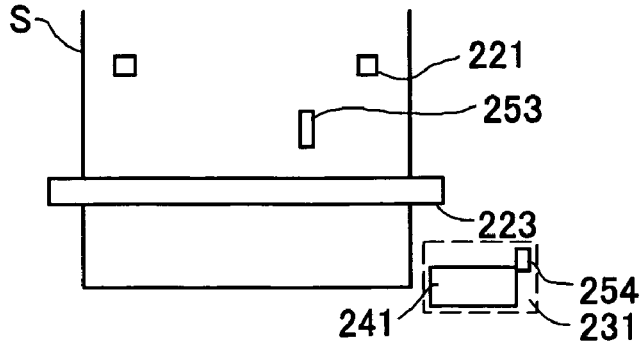
FIG. 22E
FIG. 22

FIG. 24A
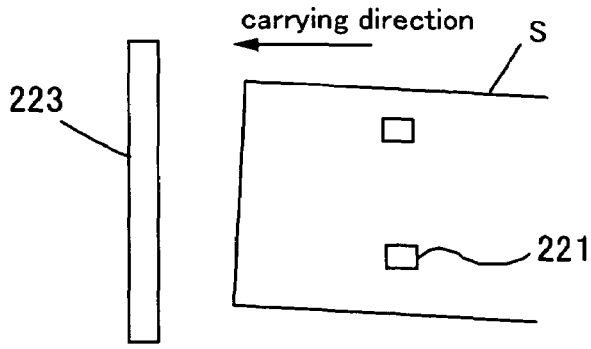
FIG. 24B
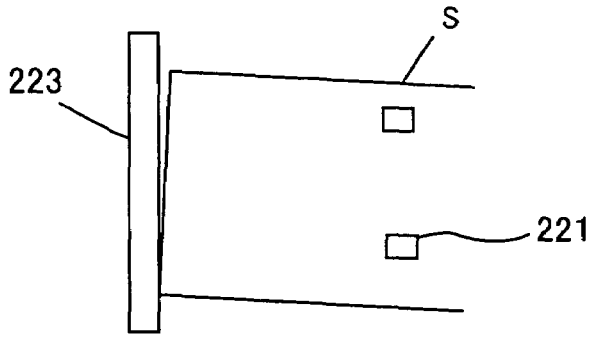
FIG. 24C
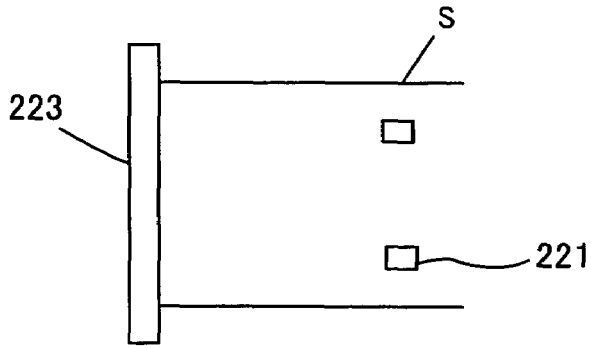
FIG. 24D
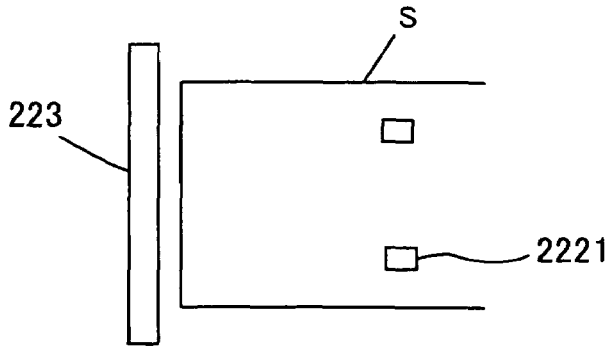
FIG. 24

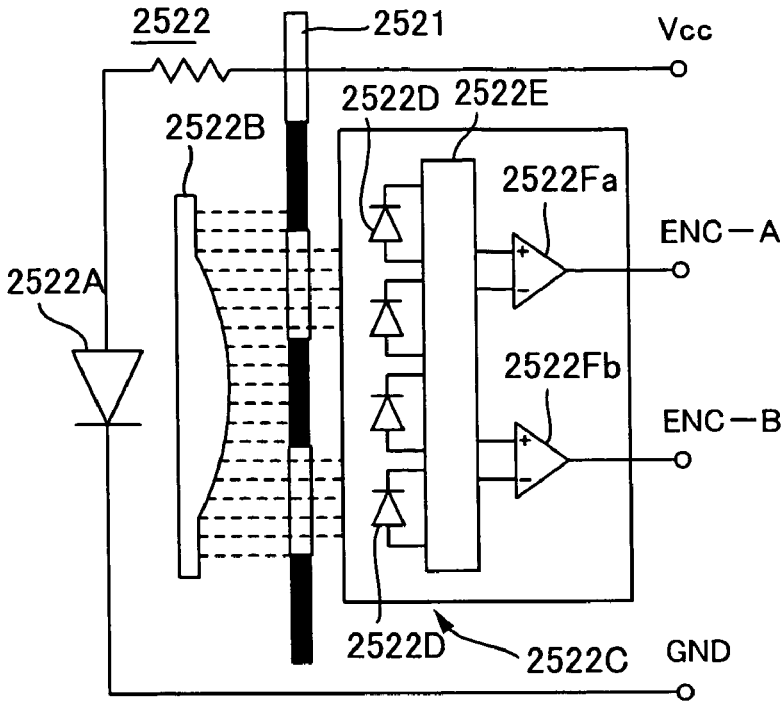
FIG. 26
FIG. 27A
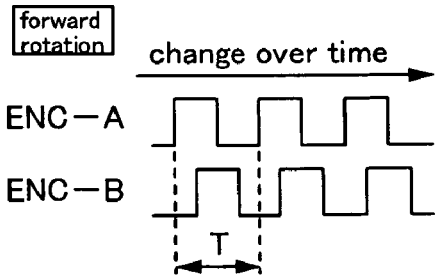
FIG. 27B
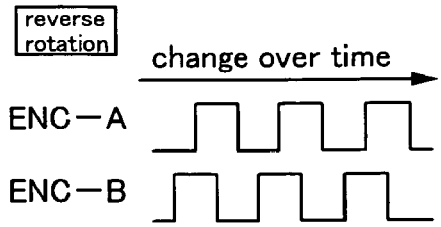
FIG. 27

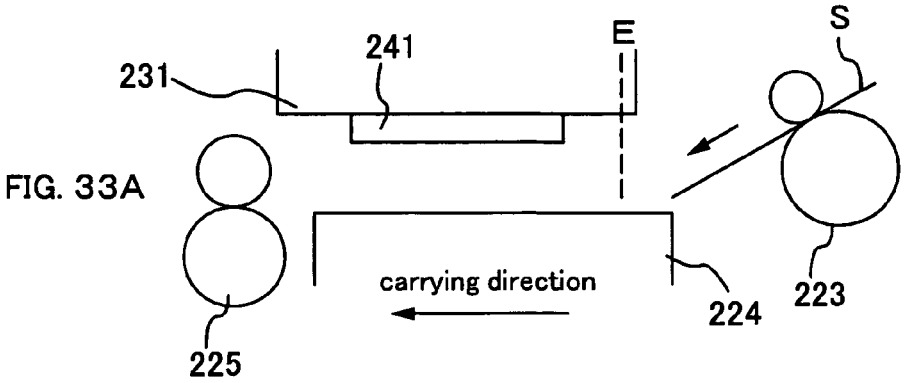
FIG. 33A
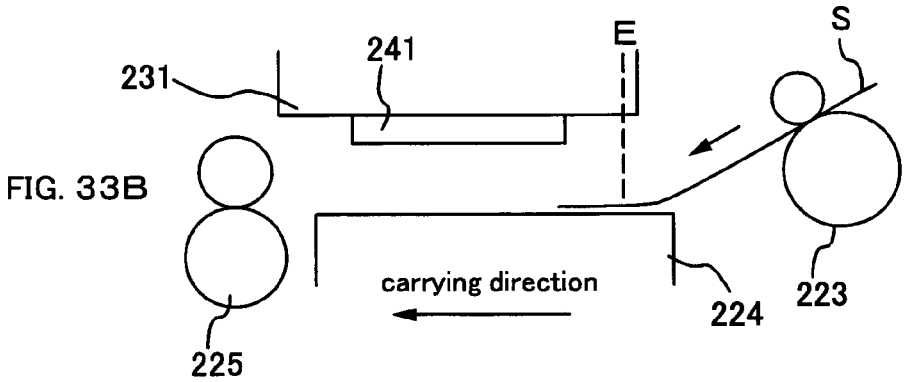
FIG. 33B
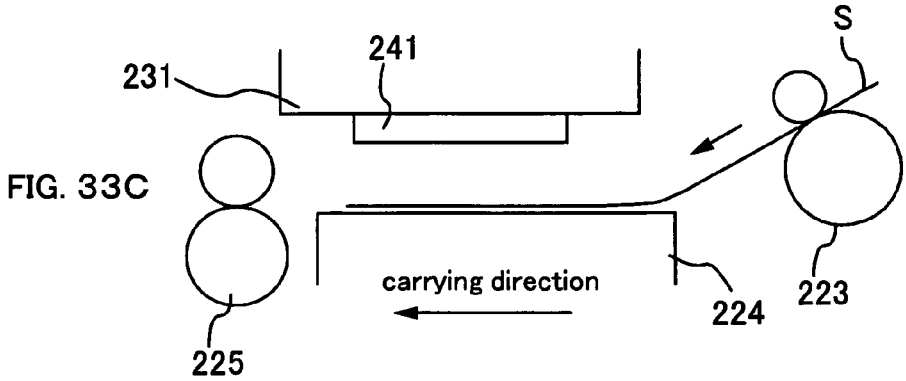
FIG. 33C
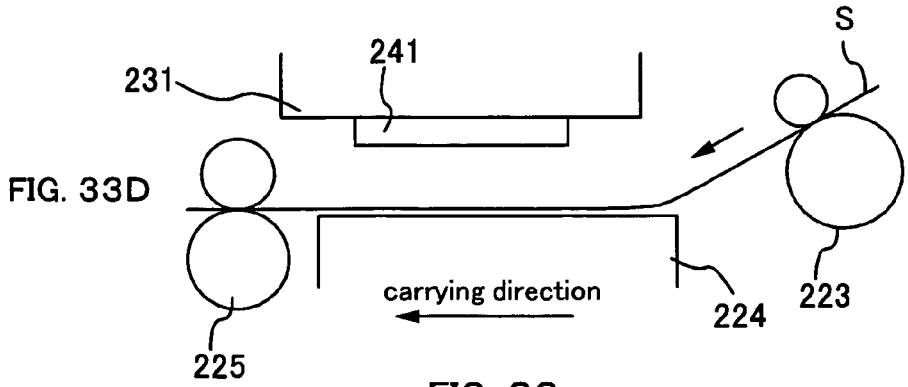
FIG. 33D
FIG. 33

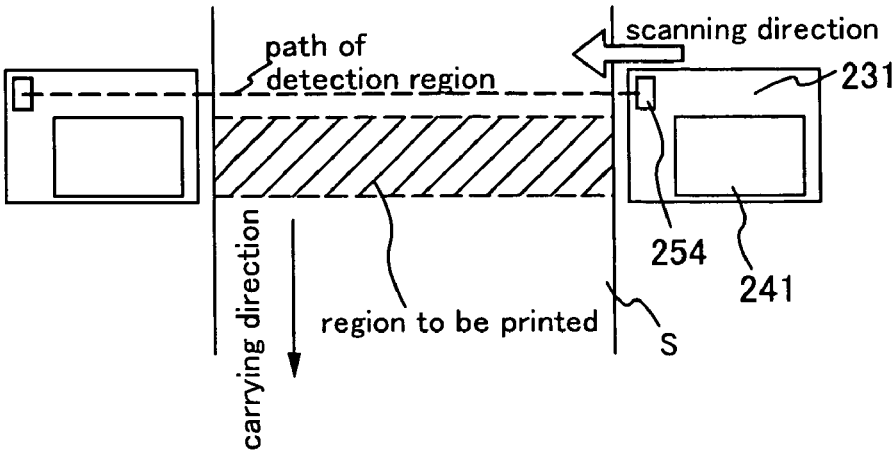
FIG. 35A
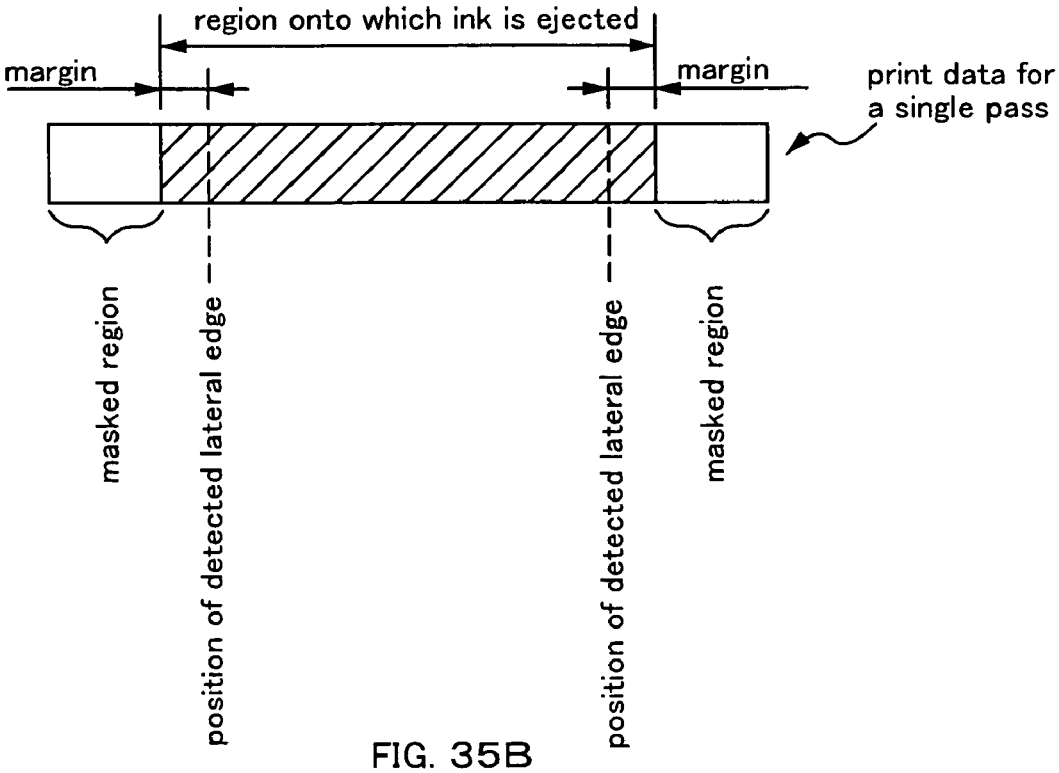
FIG. 35B
FIG. 35

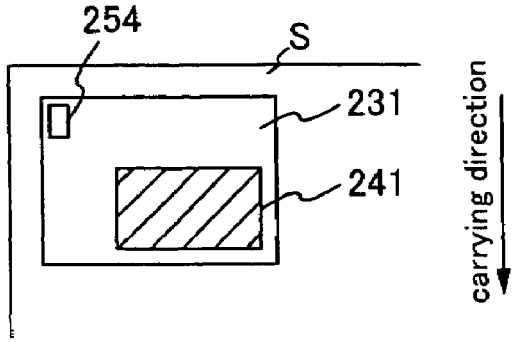
FIG. 36A
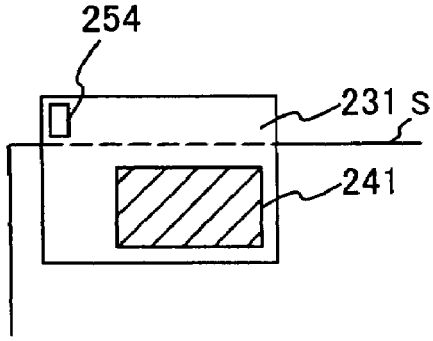
FIG. 36B
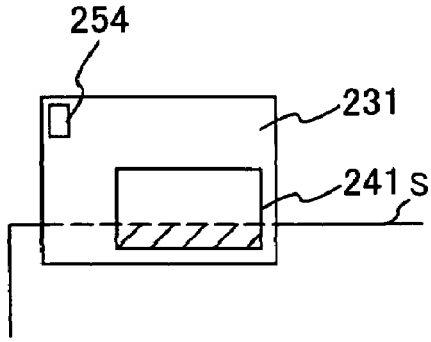
FIG. 36C
FIG. 36

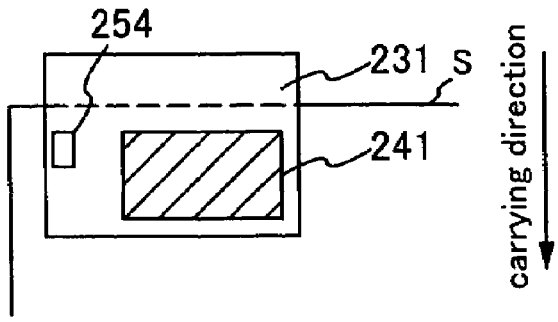
FIG. 37A
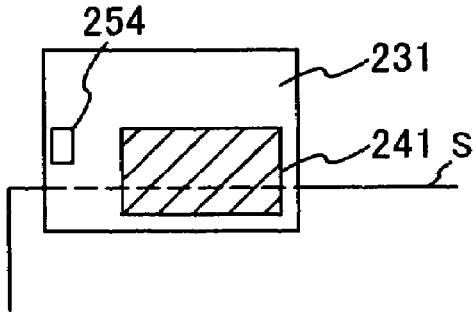
FIG. 37B
FIG. 37

LIQUID-EJECTING APPARATUS AND PRINTING SYSTEM

TECHNICAL FIELD

The present invention relates to liquid ejecting apparatuses and printing systems.

The present application claims priority upon Japanese Patent Application No. 2002-217232 filed on Jul. 25, 2002 and Japanese Patent Application No. 2003-119002 filed on Apr. 23, 2003, the contents of which are herein incorporated by reference.

BACKGROUND ART

Inkjet printers that perform printing by intermittently ejecting ink (liquid) are known as printing apparatuses (which are also liquid ejecting apparatuses) that print images on various types of media such as paper, cloth, and films. In such inkjet printers, images are printed on media by repeating, in alternation, the step of carrying paper in a carrying direction and the step of ejecting ink while moving nozzles in a scanning direction.

Further, in such printing apparatuses, it is known to provide a sensor for detecting the edges of the paper on a carriage and to control ejection of ink from the nozzles according to the detection results of the sensor.

The present invention has an objective of enabling the sensor for detecting the edges of the paper to be positioned at the most suitable position, and suppressing waste of ink ejected from the nozzles.

DISCLOSURE OF INVENTION

The present invention relates to a liquid ejecting apparatus provided with: a movable head that is provided with a plurality of nozzles for ejecting a liquid; a carry unit for carrying a medium in a predetermined carrying direction; and a sensor for detecting an edge of the medium, the liquid ejecting apparatus controlling ejection of the liquid from the plurality of nozzles in accordance with a result of the detection of the sensor. The position, in the carrying direction, of the sensor is at the same position of or on an upstream side of a nozzle located most upstream in the carrying direction, of among the plurality of nozzles. Further, due to a detection error in the sensor that occurs when the sensor detects the edge of the medium, a position of the edge of the medium when the edge is detected fluctuates within a range from a first position to a second position; and the position, in the carrying direction, of a nozzle located most upstream in the carrying direction, of among the plurality of nozzles, is between the first position and the second position. Further, the position, in the carrying direction, of the sensor is on an upstream side of a nozzle located most upstream in the carrying direction, of among the plurality of nozzles.

It should be noted that it is possible to grasp the present invention from other viewpoints. Other features of the present invention will be made clear through the description herein and the accompanying drawings.

BRIEF DESCRIPTION OF DRAWINGS

FIG. 5 is an explanatory diagram that schematically shows the configuration of a linear encoder 11 attached to the carriage 28.

FIG. 6A is a timing chart showing the waveforms of the two output signals of the linear encoder 11 when the CR motor is rotating forward. FIG. 6B is a timing chart showing the waveforms of the two output signals of the linear encoder 11 when the CR motor is rotating in reverse.

FIG. 22A to FIG. 22E are explanatory diagrams showing how the paper supply processing is performed as viewed from the upper surface.

FIG. 24A to FIG. 24D are explanatory diagrams of how the paper-skew correction processing is performed as viewed from the upper surface.

FIG. 26 is an explanatory diagram of the configuration of the rotary encoder.

FIG. 27A is a timing chart of the waveforms of the output signals during forward rotation. FIG. 27B is a timing chart of the waveforms of the output signals during reverse rotation.

FIG. 33A to FIG. 33D are explanatory diagrams showing how the paper is carried.

FIG. 35A is an explanatory diagram of detection of the lateral edge of the paper. FIG. 35B is an explanatory diagram of the lateral edge processing in borderless printing.

FIG. 36A to FIG. 36C are explanatory diagrams of the rear edge processing of the present embodiment.

FIG. 37A and FIG. 37B are explanatory diagrams of the rear edge processing of a reference example.

REGARDING THE REFERENCE CHARACTERS

Figure 1:
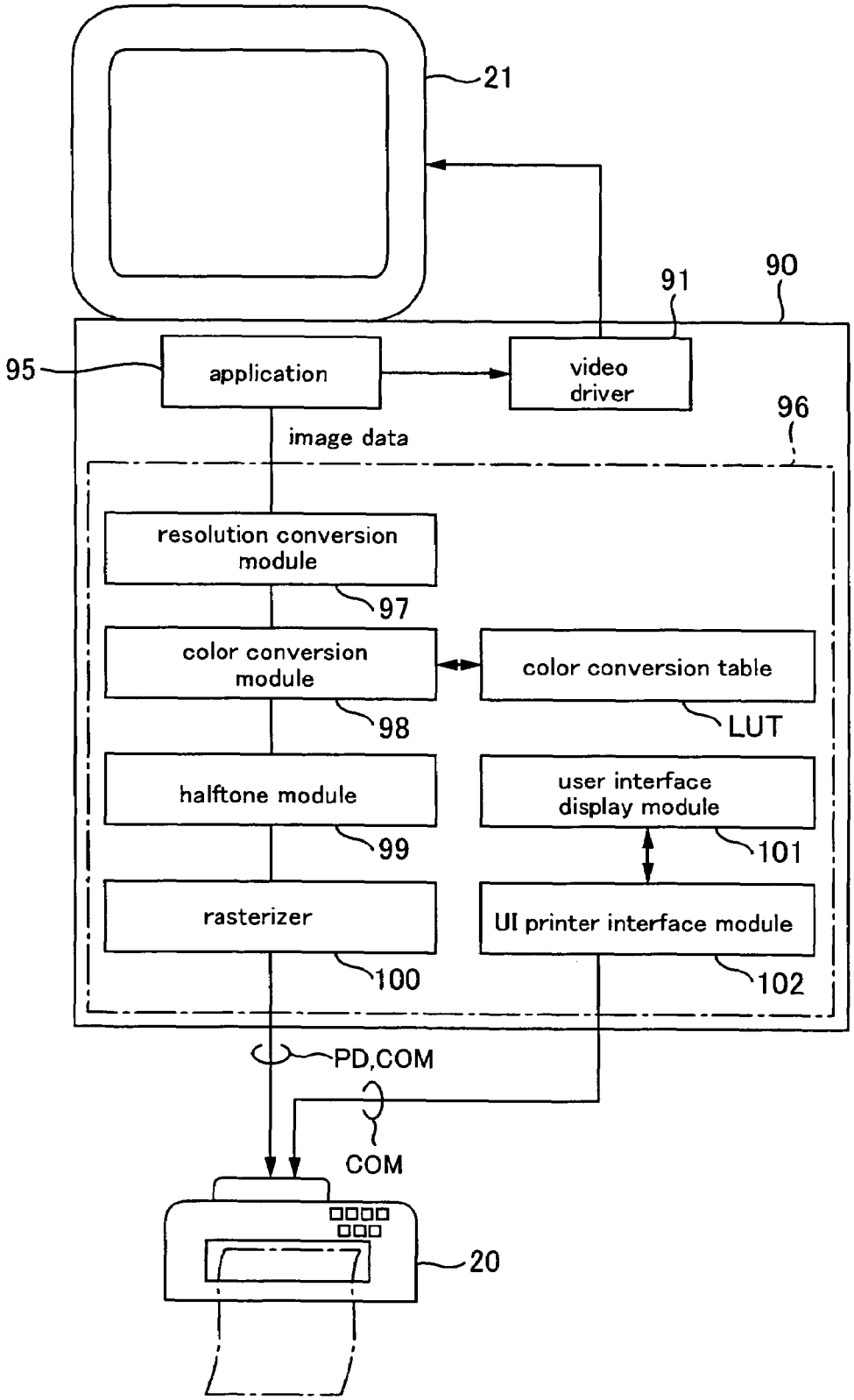
FIG. 1 is a block diagram showing the configuration of a printing system serving as an example of the present invention.

11 linear encoder
12 linear encoder code plate
13 rotary encoder
20 color inkjet printer
21 CRT
22 paper stacker
24 paper feed roller
25 pulley
26 platen
28 carriage
29 reflective optical sensor
30 carriage motor
31 paper feed motor
32 pull belt
34 guide rails
36 print head
38 light-emitting section
40 light-receiving section
50 buffer memory
52 image buffer
54 system controller
56 main memory
58 EEPROM
61 main-scan drive circuit
62 sub-scan drive circuit
63 head drive circuit
65 reflective optical sensor control circuit
66 electric signal measuring section
90 computer
91 video driver
95 application program
96 printer driver
97 resolution conversion module
98 color conversion module
99 halftone module
100 rasterizer
101 user interface display module
102 UI printer interface module
1000 computer system
1102 main computer unit
1104 display device
1106 printer
1108 input device
1108A keyboard
1108B mouse
1110 reading device
1110A flexible disk drive device
1110B CD-ROM drive device
1202 internal memory
1204 hard disk drive unit
201 printer
220 carry unit
221 paper supplying roller
222 carry motor (PF motor)
223 carry roller
224 platen
225 paper discharge roller
230 carriage unit
231 carriage
232 carriage motor (CR motor)
240 head unit
241 head
250 detector group
251 linear encoder
252 rotary encoder
2521 scale
2522 detector
253 paper detection sensor
254 optical sensor
260 controller
261 interface section
262 CPU
263 memory
264 unit control circuit
2100 printing system
2110 computer
2120 display device
2130 input device
2130A keyboard
2130B mouse
2140 record/play device
2140A flexible disk drive device
2140B CD-ROM drive device

BEST MODE FOR CARRYING OUT THE INVENTION

Overview of Disclosure

At least the following will be made clear through the disclosure below.

A liquid ejecting apparatus comprises: a movable head that is provided with a plurality of nozzles for ejecting a liquid; a carry unit for carrying a medium in a predetermined carrying direction; and a sensor for detecting an edge of the medium; wherein the liquid ejecting apparatus controls ejection of the liquid from the plurality of nozzles in accordance with a result of the detection of the sensor; and wherein a position, in the carrying direction, of the sensor is at the same position of or on an upstream side of a nozzle located most upstream in the carrying direction, of among the plurality of nozzles.

With such a liquid ejecting apparatus, it is possible to arrange the sensor for detecting the edge of the paper at the most suitable position, and to suppress waste of ink that is ejected from the nozzles.

A liquid ejecting apparatus comprises: a movable head that is provided with a plurality of nozzles for ejecting a liquid; a carry unit for carrying a medium in a predetermined carrying direction; and a sensor for detecting an edge of the medium; wherein the liquid ejecting apparatus controls ejection of the liquid from the plurality of nozzles in accordance with a result of the detection of the sensor; wherein, due to a detection error in the sensor that occurs when the sensor detects the edge of the medium, a position of the edge of the medium when the edge is detected fluctuates within a range from a first position to a second position; and wherein a position, in the carrying direction, of a nozzle located most upstream in the carrying direction, of among the plurality of nozzles, is between the first position and the second position.

With such a liquid ejecting apparatus, it is possible to achieve a liquid ejecting apparatus in which the nozzle located most upstream in the carrying direction is arranged at an ideal position.

In this liquid ejecting apparatus, it is preferable that the position, in the carrying direction, of the nozzle located most upstream in the carrying direction is in the middle of the first position and the second position. In this way, it is possible to achieve a liquid ejecting apparatus in which the nozzle located most upstream in the carrying direction is arranged at a further ideal position.

In this liquid ejecting apparatus, it is preferable that the sensor detects the edge of the medium; and based on a result of this detection, the liquid is kept from being ejected from the nozzle located most upstream in the carrying direction and nozzles located within a predetermined distance from that nozzle in the carrying direction. In this way, it becomes possible to further reduce the amount of consumption of the liquid.

In this liquid ejecting apparatus, it is preferable that after the sensor detects the edge of the medium, a process of carrying the medium in the carrying direction using the carry unit and a process of moving the head and ejecting the liquid onto the medium are repeated for a predetermined number of times, and then ejection of the liquid onto the medium is ended. In this way, it becomes possible to fill the medium up with dots.

In this liquid ejecting apparatus, it is preferable that the predetermined number of times is a plural number of times; and the predetermined distance in the process of ejecting the liquid onto the medium is increased in correspondence with an increase in an aggregate carry amount of the medium after the detection of the edge of the medium. In this way, it becomes possible to increase the number of nozzles that do not eject the liquid in accordance with the increase in the number of nozzles that do not oppose the medium, and therefore, it is possible to further reduce the amount of consumption of the liquid.

In this liquid ejecting apparatus, it is preferable that the predetermined distance is a value obtained by subtracting a predetermined amount from the aggregate carry amount. In this way, it becomes possible to ensure a margin, taking into consideration the detection error for when the edge of the medium is detected.

In this liquid ejecting apparatus, it is preferable that the higher the precision of detection with which the edge of the medium is detected is, the smaller the predetermined amount is made. By adjusting the amount of margin according to the level of the detection precision in this way, it is possible to determine the nozzles that do not eject ink more effectively.

In this liquid ejecting apparatus, it is preferable that the edge of the medium is detected by determining whether or not the edge of the medium had passed a predetermining position in the carrying direction. In this way, it is possible to detect the edge of the medium more reliably.

In this liquid ejecting apparatus, it is preferable that the liquid ejecting apparatus further comprises a medium-supporting section for supporting the medium; the sensor is provided with a light-emitting section for emitting light toward the medium-supporting section, and a light-receiving section for receiving the light that has been emitted from the light-emitting section; and by determining, based on an output value of the light-receiving section, whether or not the medium is in a traveling direction of the light emitted from the light-emitting section, it is determined whether or not the edge had passed the predetermined position in the carrying direction. In this way, it is possible to determine whether or not the edge of the medium has passed the predetermined position in the carrying direction more easily.

In this liquid ejecting apparatus, it is preferable that the light is emitted from the light-emitting section toward a plurality of positions different from one another in a direction of movement of the head; and based on the output value of the light-receiving section that has received the emitted light, it is determined whether or not the medium is in the traveling direction of the light. In this way, it is possible to detect the edge of the medium reliably, even when there is a skew in the medium, for example.

In this liquid ejecting apparatus, it is preferable that the sensor is provided in/on a movable moving member; the light is emitted from the light-emitting section toward the plurality of positions while moving the moving member; and based on the output value of the light-receiving section that has received the emitted light, it is determined whether or not the medium is in the traveling direction of the light. In this way, when emitting light from the light-emitting section (light-emitting means) toward a plurality of positions different from one another in the scanning direction (main-scanning direction), it is not necessary to change the direction in which the light is emitted for each of those positions.

In this liquid ejecting apparatus, it is preferable that the head is provided in/on the moving member; and while moving the moving member, the light is emitted from the light-emitting section toward the plurality of positions, based on the output value of the light-receiving sensor that has received the emitted light, it is determined whether or not the medium is in the traveling direction of the light, and the liquid is ejected from the nozzles provided in the head. In this way, it is possible to use the moving mechanism of the moving member and the light-emitting section (light-emitting means) and the light-receiving section (light-receiving sensor) in common.

In this liquid ejecting apparatus, it is preferable that the liquid is ejected with respect to an entire surface of the medium. The advantages of the above-described means become more significant because, in a state where a portion of the nozzle face is not in opposition to the medium, a situation in which the liquid is ejected from the nozzles that do not oppose the medium is likely to occur.

In this liquid ejecting apparatus, it is preferable that the liquid is ink; and the liquid ejecting apparatus is a printing apparatus that prints on a medium to be printed, which serves as the medium, by ejecting the ink from the nozzles. In this way, it is possible to achieve a printing apparatus that allows for the above-described effects.

Further, it is also possible to achieve a liquid ejecting apparatus comprising: a movable head that is provided with a plurality of nozzles for ejecting an ink; a carry unit for carrying a medium to be printed in a predetermined carrying direction; and a sensor for detecting an edge of the medium to be printed; wherein the liquid ejecting apparatus controls ejection of the ink from the plurality of nozzles in accordance with a result of the detection of the sensor; wherein, due to a detection error in the sensor that occurs when the sensor detects the edge of the medium to be printed, a position of the edge of the medium to be printed when the edge is detected fluctuates within a range from a first position to a second position; wherein a position, in the carrying direction, of a nozzle located most upstream in the carrying direction, of among the plurality of nozzles, is in the middle of the first position and the second position; wherein, based on the result of the detection, the ink is kept from being ejected from the nozzle located most upstream in the carrying direction and nozzles located within a predetermined distance from that nozzle in the carrying direction; wherein, after the sensor detects the edge of the medium to be printed, a process of carrying the medium to be printed in the carrying direction using the carry unit and a process of moving the head and ejecting the ink onto the medium to be printed are repeated for a predetermined number of times, and then ejection of the ink onto the medium to be printed is ended; wherein the predetermined number of times is a plural number of times; wherein the predetermined distance in the process of ejecting the ink onto the medium to be printed is increased in correspondence with an increase in an aggregate carry amount of the medium to be printed after the detection of the edge of the medium to be printed; wherein the predetermined distance is a value obtained by subtracting a predetermined amount from the aggregate carry amount; wherein, the higher the precision of detection with which the edge of the medium to be printed is detected is, the smaller the predetermined amount is made; wherein the edge of the medium to be printed is detected by determining whether or not the edge of the medium to be printed had passed a predetermining position in the carrying direction; wherein the liquid ejecting apparatus further comprises a supporting section for supporting the medium to be printed; wherein the sensor is provided with a light-emitting section for emitting light toward the supporting section, and a light-receiving section for receiving the light that has been emitted from the light-emitting section; wherein, by determining, based on an output value of the light-receiving section, whether or not the medium to be printed is in a traveling direction of the light emitted from the light-emitting section, it is determined whether or not the edge had passed the predetermined position in the carrying direction; wherein the light is emitted from the light-emitting section toward a plurality of positions different from one another in a direction of movement of the head; wherein, based on the output value of the light-receiving section that has received the emitted light, it is determined whether or not the medium to be printed is in the traveling direction of the light; wherein the sensor is provided in/on a movable moving member; wherein the light is emitted from the light-emitting section toward the plurality of positions while moving the moving member; wherein, based on the output value of the light-receiving section that has received the emitted light, it is determined whether or not the medium to be printed is in the traveling direction of the light; wherein the head is provided in/on the moving member; wherein, while moving the moving member, the light is emitted from the light-emitting section toward the plurality of positions, based on the output value of the light-receiving sensor that has received the emitted light, it is determined whether or not the medium to be printed is in the traveling direction of the light, and the ink is ejected from the nozzles provided in the head; wherein the ink is ejected with respect to an entire surface of the medium to be printed; and wherein the liquid ejecting apparatus is a printing apparatus that prints on the medium to be printed by ejecting the ink from the nozzles.

With such a liquid ejecting apparatus, the object of the present invention is most effectively achieved because all of the effects described above can be obtained.

Further, a printing system comprises: a main computer unit; and a liquid ejecting apparatus that is connectable to the main computer unit and that is provided with a movable head that is provided with a plurality of nozzles for ejecting a liquid; a carry unit for carrying a medium in a predetermined carrying direction; and a sensor for detecting an edge of the medium; wherein the liquid ejecting apparatus controls ejection of the liquid from the plurality of nozzles in accordance with a result of the detection of the sensor; and wherein a position, in the carrying direction, of the sensor is at the same position of or on an upstream side of a nozzle located most upstream in the carrying direction, of among the plurality of nozzles.

As an overall system, the printing system described above is more superior to conventional systems.

Further, a liquid ejecting apparatus comprises: a movable head that is provided with a plurality of nozzles for ejecting a liquid; a carry unit for carrying a medium in a predetermined carrying direction; and a sensor for detecting an edge of the medium and that is movable with the head; wherein the liquid ejecting apparatus controls ejection of the liquid from the plurality of nozzles in accordance with a result of the detection of the sensor; and wherein a position, in the carrying direction, of the sensor is at the same position of or on an upstream side of a nozzle located most upstream in the carrying direction, of among the plurality of nozzles.

With such a liquid ejecting apparatus, it is possible to achieve a liquid ejecting apparatus in which the nozzle located most upstream in the carrying direction is arranged at a further ideal position.

A liquid ejecting apparatus comprises: a movable head that is provided with a plurality of nozzles for ejecting a liquid; a carry unit for carrying a medium in a predetermined carrying direction; and a sensor for detecting an edge of the medium and that is movable with the head; wherein the liquid ejecting apparatus controls ejection of the liquid from the plurality of nozzles in accordance with a result of the detection of the sensor; and wherein a position, in the carrying direction, of the sensor is on an upstream side of a nozzle located most upstream in the carrying direction, of among the plurality of nozzles.

With such a liquid ejecting apparatus, the sensor can detect the front edge of the medium before the liquid becomes ejectable onto the front edge of the medium. Further, with such a liquid ejecting apparatus, the sensor can detect the rear edge of the medium before the liquid becomes ejectable onto the rear edge of the medium. Further, with such a liquid ejecting apparatus, it is possible to detect the lateral edge of the medium with high accuracy because ink has not been ejected onto the detection region of the sensor.

In this liquid ejecting apparatus, it is preferable that the sensor detects a lateral edge of the medium; and the liquid ejecting apparatus controls ejection of the liquid from the plurality of nozzles in accordance with a position of the lateral edge of the medium that has been detected. Since the sensor is arranged on the upstream side of the most upstream nozzle, the region in which the sensor detects the edge of the medium is away from the region in which the liquid is ejected onto the medium. Therefore, with such a liquid ejecting apparatus, since the sensor detects the lateral edge in a region where the liquid is not ejected, it is possible to detect the lateral edge of the medium with high accuracy and to control ejection of the liquid in accordance with the position of the lateral edge with high accuracy.

In this liquid ejecting apparatus, it is preferable that a position, on the most downstream side in the carrying direction, of a detection region of the sensor is located on the upstream side, in the carrying direction, of the nozzle located most upstream in the carrying direction. In this way, the entire detection region becomes preferable for detecting the edge of the medium.

In this liquid ejecting apparatus, it is preferable that the carry unit carries the medium by a predetermined carry amount in the carrying direction; and the position, in the carrying direction, of the sensor is on the upstream side, in the carrying direction, away from the nozzle located most upstream in the carrying direction by more than the carry amount. Such a liquid ejecting apparatus is suitable for performing rear edge processing.

In this liquid ejecting apparatus, it is preferable that the liquid ejecting apparatus ejects the liquid onto the edge of the medium using a portion of the plurality of nozzles after the sensor no longer detects the medium. With such a liquid ejecting apparatus, it is possible to limit the nozzles to be used depending on the detection results of the sensor.

In this liquid ejecting apparatus, it is preferable that the liquid ejecting apparatus ejects the liquid onto the medium using all of the plurality of nozzles in a state where the sensor no longer detects the medium, and after the carry unit has further carried the medium by the carry amount, the liquid ejecting apparatus ejects the liquid onto the edge of the medium using a portion of the plurality of nozzles. With such a liquid ejecting apparatus, there is time for calculating which nozzles are to be used during the period from when the sensor detects the rear edge of the medium up to when printing is performed by limiting the nozzles used.

In this liquid ejecting apparatus, it is preferable that a position, on the most downstream side in the carrying direction, of a detection region of the sensor is on the upstream side, in the carrying direction, away from the nozzle located most upstream in the carrying direction by more than the carry amount. With such a liquid ejecting apparatus, the entire detection region becomes preferable for detecting the edge of the medium.

In this liquid ejecting apparatus, it is preferable that the carry unit has a carry roller for carrying the medium up to a position where the liquid can be ejected onto the medium; and the position, in the carrying direction, of the sensor is on the downstream side of the carry roller. With such a liquid ejecting apparatus the sensor can detect the front edge of the paper with high accuracy.

In this liquid ejecting apparatus, it is preferable that a process of correcting a skew in the medium is performed on the upstream side of the carry roller. A slippage occurs between the carry roller and the medium when correcting the skew in the medium. However, with such a liquid ejecting apparatus, the front edge of the medium is detected by the sensor after the medium-skew correction processing, and therefore, it is possible to correctly perform control (for example, positioning to the print start position) using the detection results of the front edge of medium.

In this liquid ejecting apparatus, it is preferable that a position, on the most upstream side in the carrying direction, of a detection region of the sensor is on the downstream side, in the carrying direction, of the carry roller. In this way, the entire detection region becomes preferable for detecting the edge of the medium.

In this liquid ejecting apparatus, it is preferable that the liquid ejecting apparatus further comprises a supporting section for supporting the medium that is carried from the carry roller; and the sensor is arranged such that a detection region of the sensor is located on the supporting section. In this way, the sensor will detect the supporting section if there is no medium.

In this liquid ejecting apparatus, it is preferable that calibration of the sensor is performed based on an output signal of the sensor in a state in which the supporting section is not supporting the medium. In this way, since it is possible to perform calibration in a preferable state, it becomes possible to increase the detection precision of the sensor.

In this liquid ejecting apparatus, it is preferable that a position, on the most upstream side in the carrying direction, of the detection region of the sensor is on the supporting section. In this way, the entire detection region becomes preferable for detecting the edge of the medium.

In this liquid ejecting apparatus, it is preferable that the carry unit carries the medium in a slanted manner with respect to the supporting section; and the position of the sensor is on the downstream side, in the carrying direction, of a position at which a front edge of the medium first comes into contact with the supporting section. In this way, the posture of the medium is stable in the detection region of the sensor, and therefore, it is possible to detect the edge of the paper with the sensor correctly.

In this liquid ejecting apparatus, it is preferable that the carry unit has a paper discharge roller for discharging the medium; and the medium that has been carried in a slanted manner with respect to the supporting section passes a print region within which the liquid ejected from the nozzles land, and then reaches the paper discharge roller. In this way, it is possible to detect the edge of the paper with the sensor correctly, even before the front edge of the paper reaches the paper discharge roller (i.e., when the front edge of the paper tends to lift up easily).

In this liquid ejecting apparatus, it is preferable that a position, on the most upstream side in the carrying direction, of the detection region of the sensor is on the downstream side, in the carrying direction, of the position at which the front edge of the medium first comes into contact with the supporting section. In this way, the entire detection region becomes preferable for detecting the edge of the medium.

In this liquid ejecting apparatus, it is preferable that the liquid is ink; and the liquid ejecting apparatus is a printing apparatus that prints on a medium to be printed, which serves as the medium, by ejecting the ink from the nozzles. In this way, it is possible to achieve a printing apparatus that allows for the above-described effects.

Further, a liquid ejecting apparatus comprises: a movable head that is provided with a plurality of nozzles for ejecting an ink; a carry unit for carrying a medium to be printed in a predetermined carrying direction; and a sensor for detecting an edge of the medium to be printed and that is movable with the head; wherein the liquid ejecting apparatus controls ejection of the ink from the plurality of nozzles in accordance with a result of the detection of the sensor; wherein a position, in the carrying direction, of the sensor is on an upstream side of a nozzle located most upstream in the carrying direction, of among the plurality of nozzles; wherein the sensor detects a lateral edge of the medium to be printed; wherein the liquid ejecting apparatus controls ejection of the ink from the plurality of nozzles in accordance with a position of the lateral edge of the medium to be printed that has been detected; wherein a position, on the most downstream side in the carrying direction, of a detection region of the sensor is located on the upstream side, in the carrying direction, of the nozzle located most upstream in the carrying direction; wherein the carry unit carries the medium to be printed by a predetermined carry amount in the carrying direction; wherein the position, in the carrying direction, of the sensor is on the upstream side, in the carrying direction, away from the nozzle located most upstream in the carrying direction by more than the carry amount; wherein the liquid ejecting apparatus ejects the ink onto the edge of the medium to be printed using a portion of the plurality of nozzles after the sensor no longer detects the medium to be printed; wherein the liquid ejecting apparatus ejects the ink onto the medium to be printed using all of the plurality of nozzles in a state where the sensor no longer detects the medium to be printed, and after the carry unit has further carried the medium to be printed by the carry amount, the liquid ejecting apparatus ejects the ink onto the edge of the medium to be printed using a portion of the plurality of nozzles; wherein the position, on the most downstream side in the carrying direction, of the detection region of the sensor is on the upstream side, in the carrying direction, away from the nozzle located most upstream in the carrying direction by more than the carry amount; wherein the carry unit has a carry roller for carrying the medium to be printed up to a position where the ink can be ejected onto the medium to be printed; wherein the position, in the carrying direction, of the sensor is on the downstream side of the carry roller; wherein a process of correcting a skew in the medium to be printed is performed on the upstream side of the carry roller; wherein a position, on the most upstream side in the carrying direction, of the detection region of the sensor is on the downstream side, in the carrying direction, of the carry roller; wherein the liquid ejecting apparatus further comprises a supporting section for supporting the medium to be printed that is carried from the carry roller; wherein the sensor is arranged such that the detection region of the sensor is located on the supporting section; wherein calibration of the sensor is performed based on an output signal of the sensor in a state in which the supporting section is not supporting the medium to be printed; wherein the position, on the most upstream side in the carrying direction, of the detection region of the sensor is on the supporting section; wherein the carry unit carries the medium to be printed in a slanted manner with respect to the supporting section; wherein the position of the sensor is on the downstream side, in the carrying direction, of a position at which a front edge of the medium to be printed first comes into contact with the supporting section; wherein the carry unit has a paper discharge roller for discharging the medium to be printed; wherein the medium to be printed that has been carried in a slanted manner with respect to the supporting section passes a print region within which the ink ejected from the nozzles land, and then reaches the paper discharge roller; wherein the position, on the most upstream side in the carrying direction, of the detection region of the sensor is on the downstream side, in the carrying direction, of the position at which the front edge of the medium to be printed first comes into contact with the supporting section; and wherein the liquid ejecting apparatus is a printing apparatus that prints on the medium to be printed by ejecting the ink from the nozzles.

With such a liquid ejecting apparatus, it is possible to achieve the effects described above.

Further, a printing system comprises: a main computer unit; and a liquid ejecting apparatus that is connectable to the main computer unit and that is provided with a movable head that is provided with-a plurality of nozzles for ejecting a liquid; a carry unit for carrying a medium in a predetermined carrying direction; and a sensor for detecting an edge of the medium and that is movable with the head; wherein the liquid ejecting apparatus controls ejection of the liquid from the plurality of nozzles in accordance with a result of the detection of the sensor; and wherein a position, in the carrying direction, of the sensor is on an upstream side of a nozzle located most upstream in the carrying direction, of among the plurality of nozzles.

As an overall system, the printing system described above is more superior to conventional systems.

(1)

(1) Example of the Overall Configuration of the Apparatus

FIG. 1 is a block diagram showing the configuration of a printing system serving as an example of the present invention. The printing system is provided with a computer 90 and a color inkjet printer 20, which is an example of a liquid ejecting apparatus. It should be noted that the printing system including the color inkjet printer 20 and the computer 90 can also be broadly referred to as a "liquid ejecting apparatus." Although not shown in the diagram, a computer system is made of the computer 90, the color inkjet printer 20, a display device such as a CRT 21 or a liquid crystal display device, input devices such as a keyboard and a mouse, and a drive device such as a flexible drive device or a CD-ROM drive device.

In the computer 90, an application program 95 is executed under a predetermined operating system. The operating system includes a video driver 91 and a printer driver 96, and the application program 95 outputs print data PD for transfer to the color inkjet printer 20 through these drivers. The application program 95, which carries out retouching of images, for example, carries out a desired process with respect to an image to be processed, and also displays the image on the CRT 21 via the video driver 91.

When the application program 95 issues a print command, the printer driver 96 of the computer 90 receives image data from the application program 95 and converts these into print data PD to be supplied to the color inkjet printer 20. The printer driver 96 is internally provided with a resolution conversion module 97, a color conversion module 98, a halftone module 99, a rasterizer 100, a user interface display module 101, a UI printer interface module 102, and a color conversion look-up table LUT.

The resolution conversion module 97 performs the function of converting the resolution of the color image data formed by the application program 95 to a print resolution. The image data whose resolution is thus converted is image information still made of the three color components RGB. The color conversion module 98 refers to the color conversion look-up table LUT and, for each pixel, converts the RGB image data into multi-gradation data of a plurality of ink colors that can be used by the color inkjet printer 20.

The multi-gradation data that have been color converted have a gradation value of 256 grades, for example. The halftone module 99 executes so-called halftone processing to create halftone image data. The halftone image data are arranged by the rasterizer 100 into the order in which they are to be transferred to the color inkjet printer 20, and are output as the final print data PD. The print data PD include raster data indicating the state in which dots are formed during main scanning, and data indicating the sub-scan feed amount (carry amount).

The user interface display module 101 has a function for displaying various types of user interface windows related to printing and a function for receiving input from the user in these windows.

The UI printer interface module 102 functions as an interface between the user interface (UI) and the color inkjet printer. It interprets instructions given by users through the user interface and sends various commands COM to the color inkjet printer. Conversely, it also interprets commands COM received from the color inkjet printer and executes various displays with respect to the user interface.

It should be noted that the printer driver 96 realizes, for example, a function for sending and receiving various types of commands COM and a function for supplying print data PD to the color inkjet printer 20. A program for realizing the functions of the printer driver 96 is supplied in a format in which it is stored on a computer-readable storage medium. Examples of this storage medium include various types of computer-readable media, such as flexible disks, CD-ROMs, magneto optical disks, IC cards, ROM cartridges, punch cards, printed materials on which a code such as a bar code is printed, internal storage devices (memory such as a RAM or a ROM) and external storage devices of the computer. The computer program can also be downloaded onto the computer 90 via the Internet.

Figure 2:
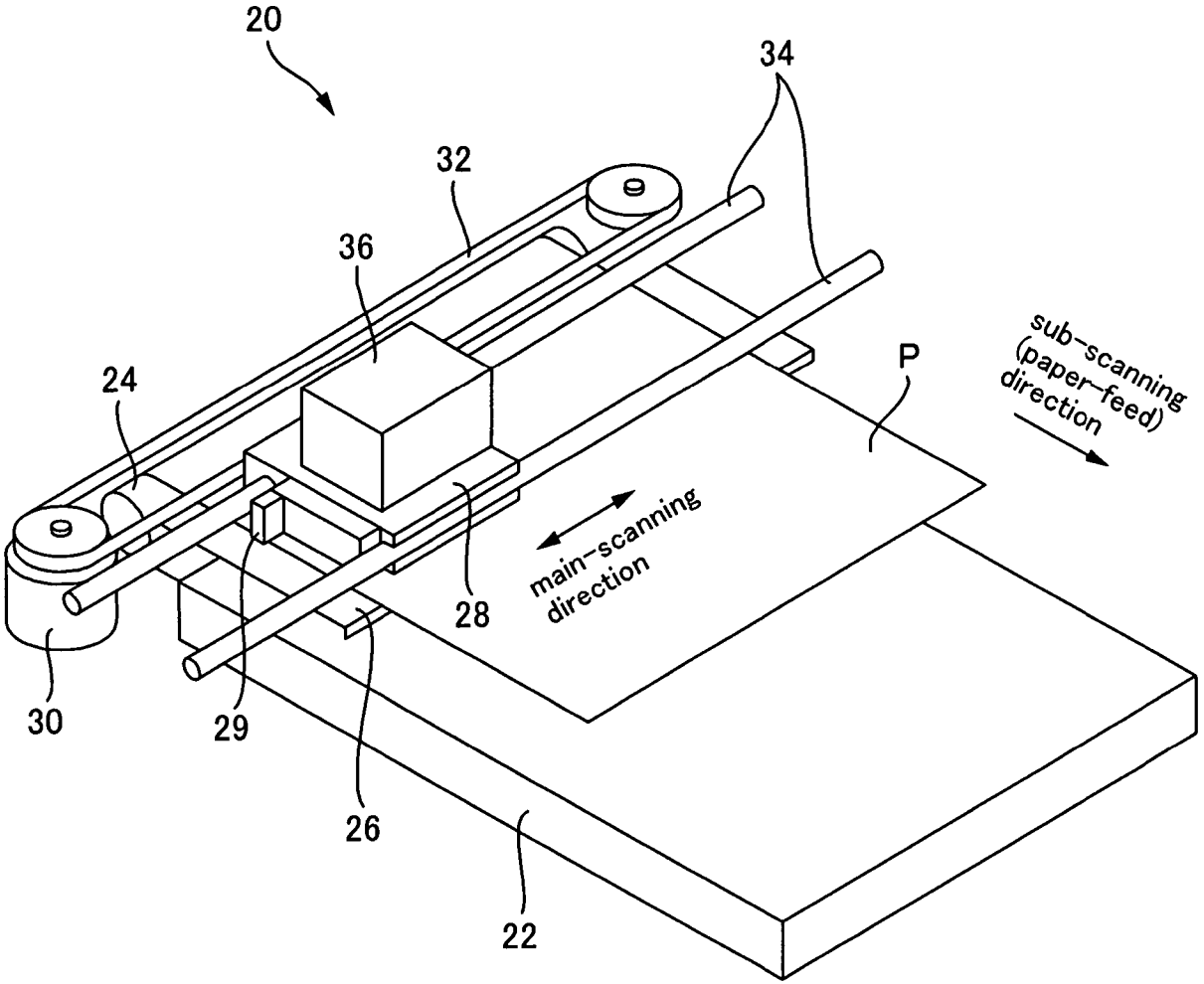
FIG. 2 is a schematic perspective view showing an example of the primary structures of a color inkjet printer 20.

FIG. 2 is a schematic perspective view showing an example of the primary structures of the color inkjet printer 20. The color inkjet printer 20 is provided with a paper stacker 22, a paper feed roller 24 driven by a step motor that is not shown, a platen 26, which is an example of a medium-supporting section for supporting the medium, a carriage 28 serving as an example of a moving member, a carriage motor 30, a pull belt 32 that is driven by the carriage motor 30, and guide rails 34 for the carriage 28. Further, a print head 36, which is an example of an ejection head provided with numerous nozzles, and a reflective optical sensor 29 that serves as an example of detecting means (sensing means) and that will be described in detail later are mounted onto the carriage 28.

The print paper P is rolled from the paper stacker 22 by the paper feed roller 24 and fed in a paper-feed direction (hereinafter also referred to as the sub-scanning direction and the carrying direction), which is an example of the predetermined feed direction, over the surface of the platen 26. The carriage 28 is pulled by the pull belt 32, which is driven by the carriage motor 30, and moves in the main-scanning direction along the guide rails 34. It should be noted that as shown in the diagram, the main-scanning direction (also referred to simply as the scanning direction) refers to the two directions perpendicular to the sub-scanning direction. The paper feed roller 24 is also used to carry out the paper-supply operation for supplying the print paper P to the color inkjet printer 20 and the paper discharge operation for discharging the print paper P from the color inkjet printer 20.

(1) Example of Configuration of the Reflective Optical Sensor

Figure 3:
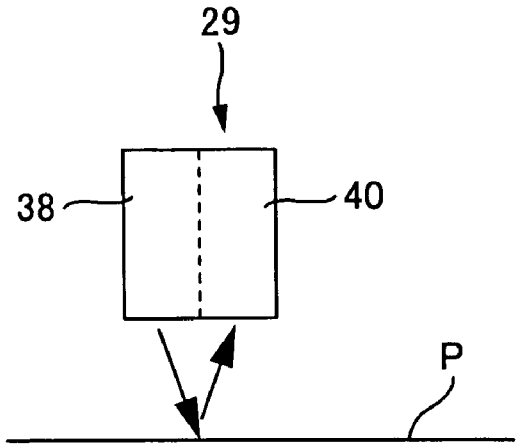
FIG. 3 is a schematic diagram for describing an example of a reflective optical sensor 29.

FIG. 3 is a schematic diagram for describing an example of the reflective optical sensor 29. The reflective optical sensor 29 is attached to the carriage 28, and has a light-emitting section 38, which is for example made of a light emitting diode and is an example of a light-emitting means, and a light-receiving section 40, which is for example made of a phototransistor and is an example of a light-receiving sensor. The light that is emitted from the light-emitting section 38, that is, the incident light, is reflected by print paper P or by the platen 26 if there is no print paper P in the direction in which the emitted light travels. The light that is reflected is received by the light-receiving section 40 and is converted into an electric signal. Then, the magnitude of the electric signal is measured as the output value of the light-receiving sensor corresponding to the intensity of the reflected light that is received.

It should be noted that in the above description, as shown in the figure, the light-emitting section 38 and the light-receiving section 40 are provided as a single unit and together constitute the reflective optical sensor 29. However, they may also constitute separate devices, such as a light emitting device and a light-receiving device.

Further, in the above description, the reflected light was converted into an electric signal and then the magnitude of that electric signal was measured in order to obtain the intensity of the reflected light that is received. However, this is not a limitation, and it is only necessary that the output value of the light-receiving sensor corresponding to the intensity of the reflected light that is received can be measured.

(1) Example of Configuration of the Periphery of the Carriage

Figure 4:
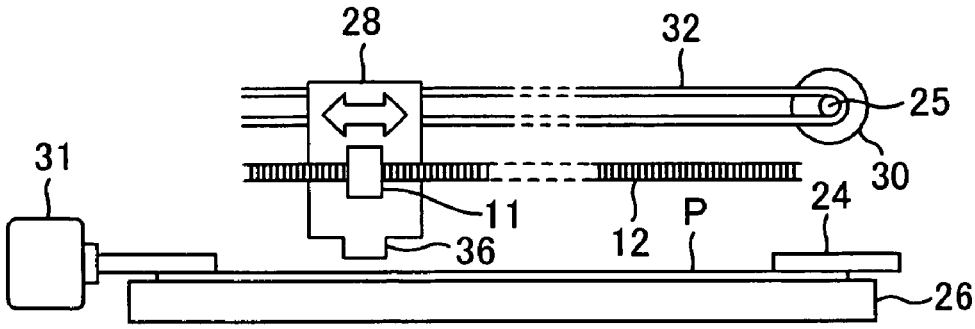
FIG. 4 is a diagram showing the configuration of the periphery of a carriage 28 of the inkjet printer.

The configuration of the carriage area is described next. FIG. 4 is a diagram showing the configuration of the periphery of the carriage 28 of the inkjet printer.

The inkjet printer shown in FIG. 4 is provided with a paper feed motor (hereinafter referred to as PF motor) 31, which is as an example of the feed mechanism for feeding paper, the carriage 28 to which the print head 36 for ejecting ink, which is an example of a liquid, onto the print paper P is fastened and which is driven in the main-scanning direction, the carriage motor (hereinafter referred to as CR motor) 30 for driving the carriage 28, a linear encoder 11 that is fastened to the carriage 28, a linear encoder code plate 12 in which slits are formed at a predetermined spacing, a rotary encoder 13, which is not shown, for the PF motor 31, the platen 26 for supporting the print paper P, the paper feed roller 24 driven by the PF motor 31 for carrying the print paper P, a pulley 25 attached to the rotational shaft of the CR motor 30, and the pull belt 32 driven by the pulley 25. It should be noted that the paper feed roller 24 and the paper feed motor 31 structure a part of the carry unit for carrying the paper.

Next, the above-described linear encoder 11 and the rotary encoder 13 are described. FIG. 5 is an explanatory diagram that schematically shows the configuration of the linear encoder 11 attached to the carriage 28.

The linear encoder 11 shown in FIG. 5 is provided with a light emitting diode 11*a*, a collimating lens 11*b*, and a detection processing section 11*c*.The detection processing section 11*c* has a plurality of (for example, four) photodiodes 11*d*, a signal processing circuit 11*e*, and for example two comparators 11*f*A and 11*f*B.

The light-emitting diode 11*a* emits light when a voltage Vcc is applied to it via resistors on both sides. This light is condensed into parallel light by the collimating lens 11*b* and passes through the linear encoder code plate 12. The linear encoder code plate 12 is provided with slits at a predetermined spacing (for example, 1/180 inch (one inch=2.54 cm)).

The parallel light that passes through the linear encoder code plate 12 then passes through stationary slits which are not shown and is incident on the photodiodes 11*d*, where it is converted into electric signals. The electric signals that are output from the four photodiodes 11*d* are subjected to signal processing by the signal processing circuit 11*e*, the signals that are output from the signal processing circuit 11*e* are compared in the comparators 11*f*A and 11*f*B, and the results of these comparisons are output as pulses. Then, the pulse ENC-A and the pulse ENC-B that are output from the comparators 11*f*A and 11*f*B become the output of the linear encoder 11.

FIG. 6A is a timing chart showing the waveforms of the two output signals of the linear encoder 11 when the CR motor is rotating forward. FIG. 6B is a timing chart showing the waveforms of the two output signals of the linear encoder 11 when the CR motor is rotating in reverse.

As shown in FIG. 6A and FIG. 6B, the phases of the pulse ENC-A and the pulse ENC-B are misaligned by 90 degrees both when the CR motor is rotating forward and when it is rotating in reverse. When the CR motor 30 is rotating forward, that is, when the carriage 28 is moving in the main-scanning direction, then, as shown in FIG. 6A, the phase of the pulse ENC-A leads the phase of the pulse ENC-B by 90 degrees. On the other hand, when the CR motor 30 is rotating in reverse, then, as shown in FIG. 6B, the phase of the pulse ENC-A is delayed by 90 degrees with respect to the phase of the pulse ENC-B. A single period T of the pulse ENC-A and the pulse ENC-B is equivalent to the time during which the carriage 28 is moved by the slit spacing of the linear encoder code plate 12.

Then, the rising edge and the rising edge of the output pulses ENC-A and ENC-B of the linear encoder 11 are detected, and the number of detected edges is counted. The rotational position of the CR motor 30 is detected based on the number that is calculated. With respect to the calculation, when the CR motor 30 is rotating forward a "+1" is added for each detected edge, and when the CR motor 30 is rotating in reverse a "−1" is added for each detected edge. The period of the pulses ENC-A and ENC-B is equal to the time from when one slit of the linear encoder code plate 12 passes through the linear encoder 11 to when the next slit passes through the linear encoder 11, and the phases of the pulse ENC-A and the pulse ENC-B are misaligned by 90 degrees. Accordingly, a count number of "1" of the calculation corresponds to ¼ of the slit spacing of the linear encoder code plate 12. Therefore, if the counted number is multiplied by ¼ of the slit spacing, then the amount that the CR motor 30 has moved from the rotational position corresponding to the count number "0" can be obtained based on this product. The resolution of the linear encoder 11 at this time is ¼ the slit spacing of the linear encoder code plate 12.

On the other hand, the rotary encoder 13 for the PF motor 31 has the same configuration as the linear encoder 11, except that the rotary encoder code plate is a rotation disk that rotates in conjunction with rotation of the PF motor 31. The rotary encoder 13 outputs two output pulses ENC-A and ENC-B, and based on this output the amount of movement of the PF motor 31 can be obtained.

(1) Example of the Electric Configuration of the Color Inkjet Printer

Figure 7:
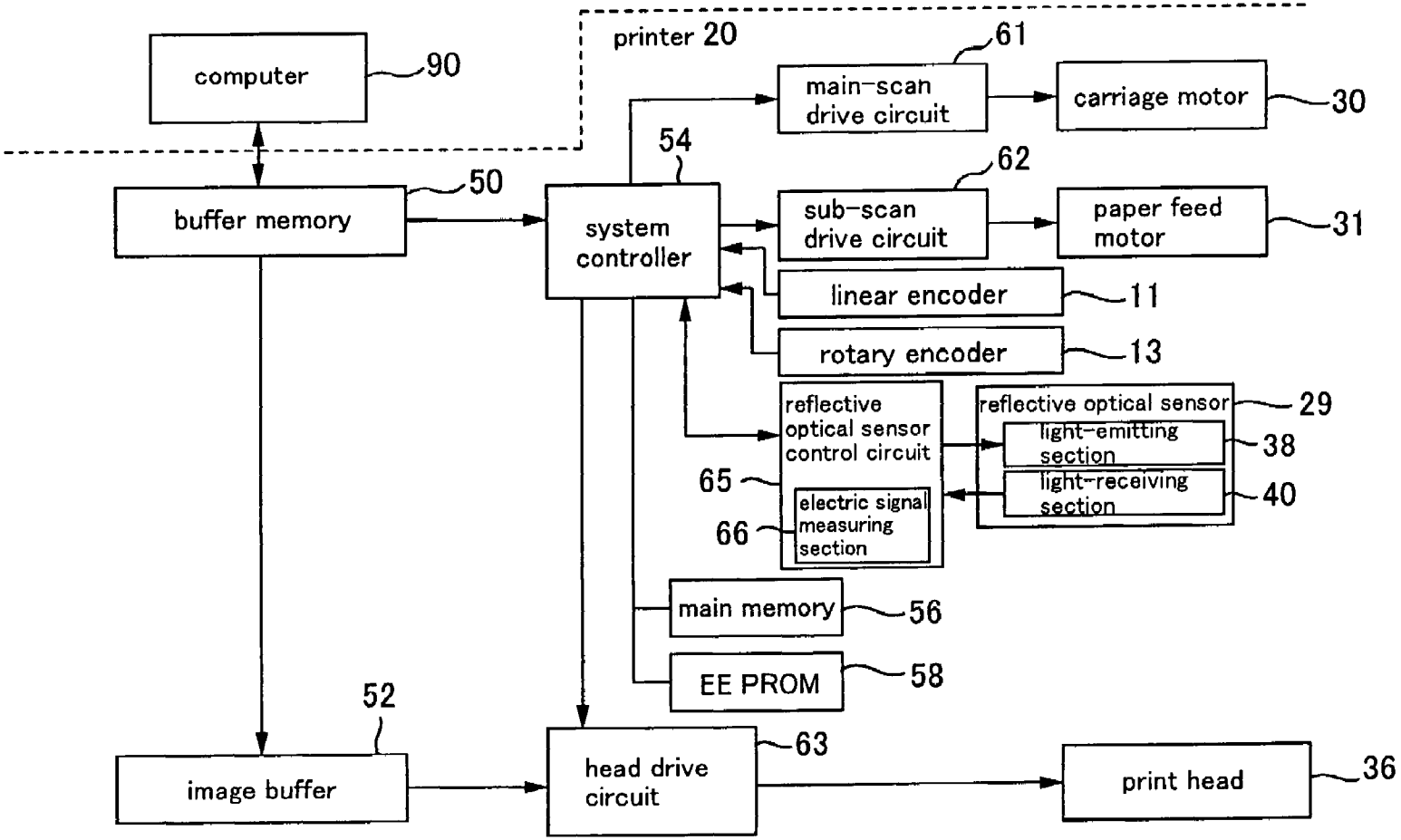
FIG. 7 is a block diagram showing an example of the electrical configuration of the color inkjet printer 20.

FIG. 7 is a block diagram showing an example of the electric configuration of the color inkjet printer 20. The color inkjet printer 20 is provided with a buffer memory 50 for receiving signals supplied from the computer 90, an image buffer 52 for storing print data, a system controller 54 for controlling the overall operation of the color inkjet printer 20, a main memory 56, and an EEPROM 58. The system controller 54 is connected to a main-scan drive circuit 61 for driving the carriage motor 30, a sub-scan drive circuit 62 for driving the paper feed motor 31, a head drive circuit 63 for driving the print head 36, a reflective optical sensor control circuit 65 for controlling the light-emitting section 38 and the light-receiving section 40 of the reflective optical sensor 29, the above-described linear encoder 11, and the above-described rotary encoder 13. Further, the reflective optical sensor control circuit 65 is provided with an electric signal measuring section 66 for measuring the electric signals that are converted from the reflected light received by the light-receiving section 40.

The print data that are transferred from the computer 90 are held temporarily in the buffer memory 50. Within the color inkjet printer 20, the system controller 54 reads necessary information from the print data in the buffer memory 50, and based on this information, sends control signals to the main-scan drive circuit 61, the sub-scan drive circuit 62, and the head drive circuit 63, for example.

The image buffer 52 stores print data for a plurality of color components that are received by the buffer memory 50. The head drive circuit 63 reads the print data of the various color components from the image buffer 52 in accordance with the control signals from the system controller 54, and drives the various color nozzle arrays provided in the print head 36 in correspondence with the print data.

(1) Example of Nozzle Arrangement of Print Head, Etc.

Figure 8:
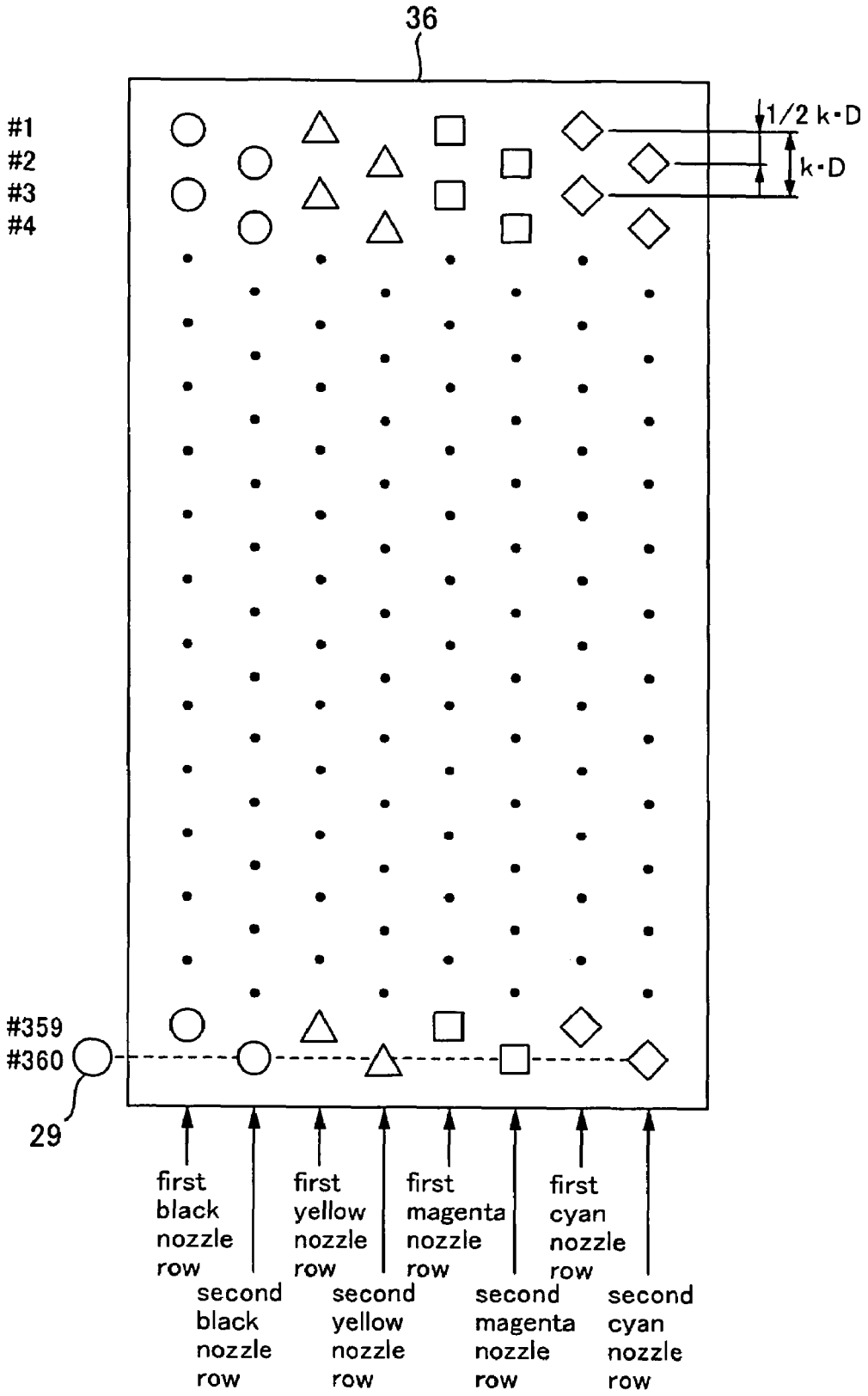
FIG. 8 is an explanatory diagram showing the nozzle arrangement on the bottom surface of the print head 36.

FIG. 8 is an explanatory diagram showing the nozzle arrangement on the bottom surface of the print head 36. The print head 36 has a black nozzle row, a yellow nozzle row, a magenta nozzle row, and a cyan nozzle row, arranged in straight lines in the sub-scanning direction. As shown in the diagram, each of these nozzle rows is constituted by two rows, and in this specification, these nozzle rows are referred to as the first black nozzle row, the second black nozzle row, the first yellow nozzle row, the second yellow nozzle row, the first magenta nozzle row, the second magenta nozzle row, the first cyan nozzle row, and the second cyan nozzle row.

The black nozzle rows (shown by white circles) have 360 nozzles, nozzles #1 to #360 of these nozzles, the odd-numbered nozzles #1, #3, . . . , #359 belong to the first black nozzle row and the even-numbered nozzles #2, #4, . . . , #360 belong to the second black nozzle row. The nozzles #1, #3, . . . , #359 of the first black nozzle row are arranged at a constant nozzle pitch k·D in the sub-scanning direction. Here, D is the dot pitch in the sub-scanning direction, and k is an integer. The dot pitch D in the sub-scanning direction is equal to the pitch of the main scan lines (raster lines). Hereafter, the integer k indicating the nozzle pitch k·D is referred to simply as the "nozzle pitch k." In the example of FIG. 8, the nozzle pitch k is four dots. The nozzle pitch k, however, may be set to any integer.

The nozzles #2, #4, . . . , #360 of the second black nozzle row are also arranged at the constant nozzle pitch k·D (nozzle pitch k=4) in the sub-scanning direction, and as shown in the diagram, the positions of the nozzles in the sub-scanning direction are misaligned with the positions of the nozzles of the first black nozzle row in the sub-scanning direction. In the example of FIG. 8, the amount of this misalignment is ½·k·D (k=4).

The above-described matters also apply for the yellow nozzle rows (shown by white triangles), the magenta nozzle rows (shown by white squares), and the cyan nozzle rows (shown by white diamonds). In other words, each of the these nozzle rows has 360 nozzles #1 to #360, and of the these nozzles, the odd-numbered nozzles #1, #3, . . . , #359 belong to the first nozzle row and the even-numbered nozzles #2, #4, . . . , #360 belong to the second nozzle row. Further, each of these nozzle rows is arranged at a constant nozzle pitch k·D in the sub-scanning direction, and the positions of the nozzles of the second rows in the sub-scanning direction are misaligned with the positions of the nozzles of the first rows in the sub-scanning direction by ½·k·D (k=4).

In other words, the nozzle groups arranged in the print head 36 are staggered, and during printing, ink droplets are ejected from each of the nozzles while the print head 36 is moved in the main-scanning direction at a constant velocity together with the carriage 28. However, depending on the print mode, not all of the nozzles are always used, and there are instances in which only some of the nozzles are used.

It should be noted that the reflective optical sensor 29 described above is attached to the carriage 28 with the print head 36. Further, in the present embodiment, as shown in the figure, the reflective optical sensor 29 is provided aligned in the main-scanning direction with the nozzle located most upstream, in the paper-feed direction, of among the plurality of nozzles provided in the print head 36.

(1) First Embodiment

Figure 9:
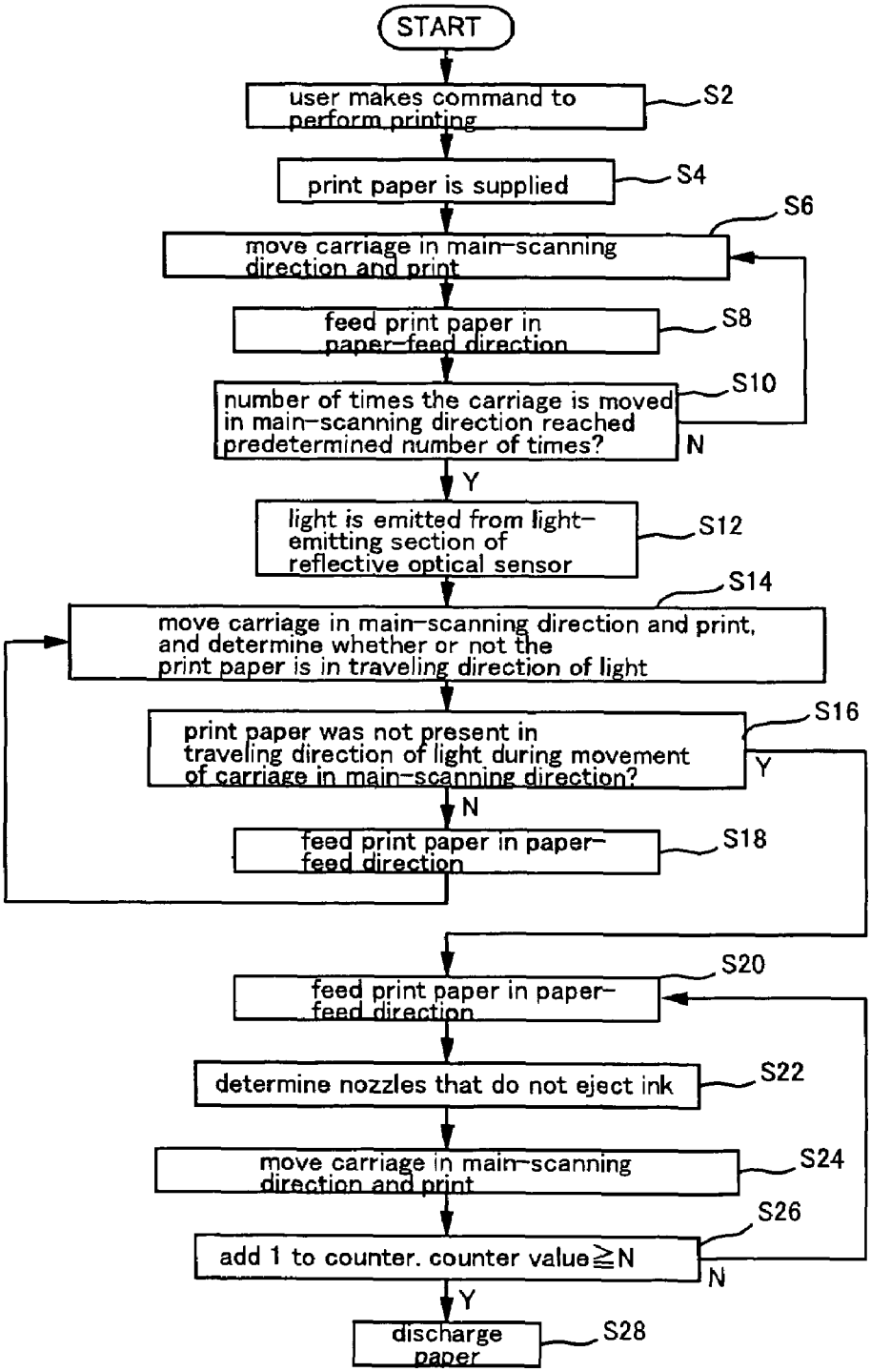
FIG. 9 is a flowchart for describing the first embodiment.
Figures 10, 10A, 10B, 10C:
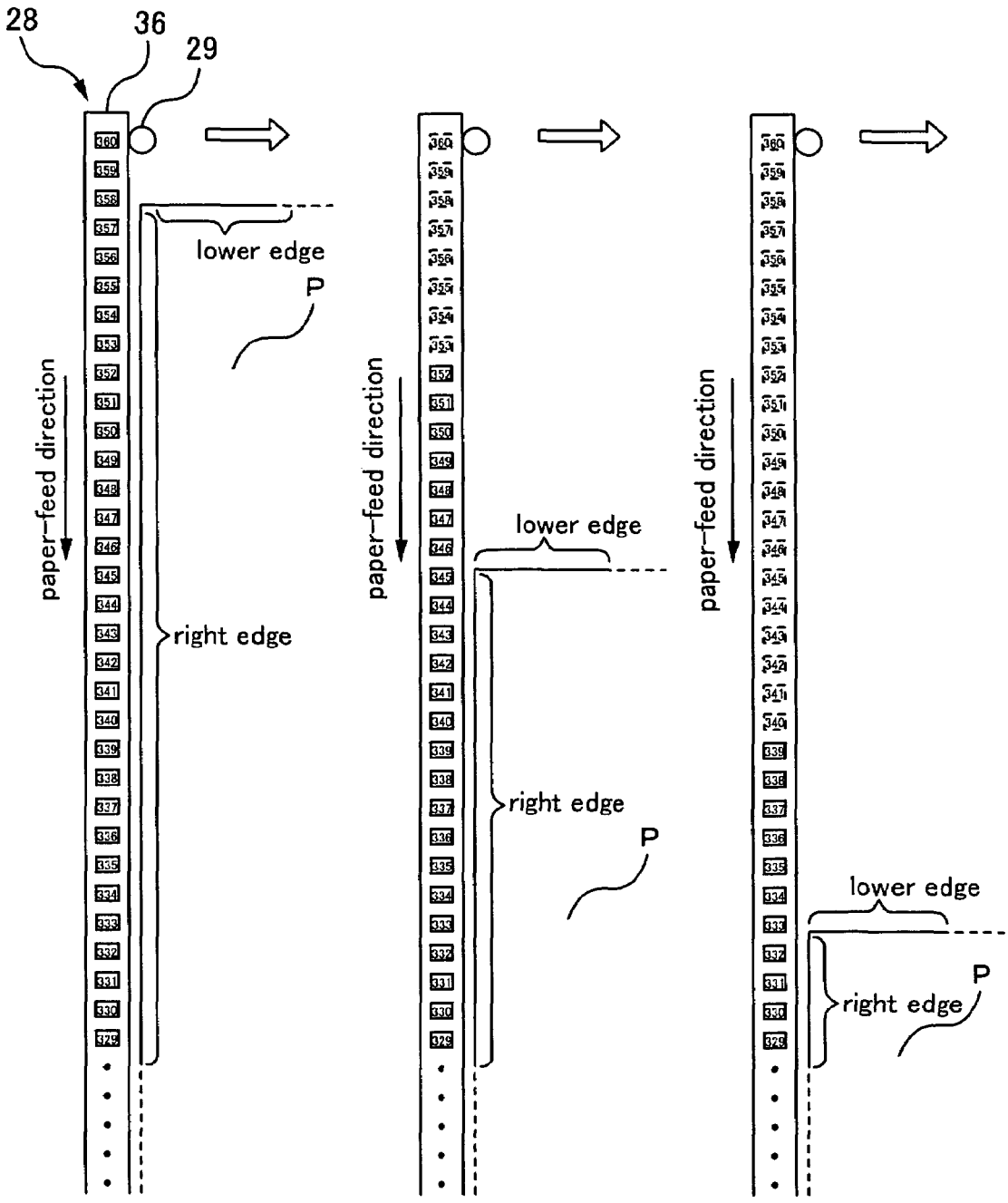
FIG. 10A to FIG. 10C are diagrams that schematically represent the positional relationship between the nozzles of the print head 36 and the print paper P.

Next, a first embodiment of the present invention is described using FIG. 9 and FIG. 10. FIG. 9 is a flowchart for describing the first embodiment. FIG. 10 will be described later.

First, the user makes a command to perform printing through the application program 95 or the like (step S2). The application program 95 receives this instruction and issues a print command, at which time the printer driver 96 of the computer 90 receives image data from the application program 95 and converts them to print data PD including raster data indicating the state in which dots are formed during main scanning and data indicating the sub-scan feed amount (carry amount). Moreover, the printer driver 96 supplies the print data PD to the color inkjet printer 20 together with various commands COM. The color inkjet printer 20 receives these at its buffer memory 50, after which it sends them to the image buffer 52 or the system controller 54.

The user can also designate the size of the print paper P or issue a command to perform borderless printing to the user interface display module 101. This instruction by the user is received by the user interface display module 101 and sent to the UI printer interface module 102. The UI printer interface module 102 interprets the instruction that has been given, and sends a command COM to the color inkjet printer 20. The color inkjet printer 20 receives the command COM at the buffer memory 50 and then transmits it to the system controller 54.

The color inkjet printer 20 then drives, for example, the paper feed motor 31 by the sub-scan drive circuit 62 based on the command that is sent to the system controller 54 so as to supply the print paper P (step S4).

Then, the system controller 54 moves the carriage 28 in the main-scanning direction as it feeds the print paper P in the paper-feed direction, and ejects ink from the print head 36 provided in the carriage 28, thereby carrying out borderless printing (step S6, step S8). It should be noted that the print paper P is fed in the paper-feed direction by driving the paper feed motor 31 with the sub-scan drive circuit 62, the carriage 28 is moved in the main-scanning direction by driving the carriage motor 30 with the main-scan drive circuit 61, and ink is ejected from the print head 36 by driving the print head 36 with the head drive circuit 63.

The color inkjet printer 20 carries out the operations of step S6 and step S8 in sequence, and if, for example, the number of times the carriage 28 is moved in the main-scanning direction reaches a predetermined number of times (step S10), then, from the next move of the carriage 28 in the main-scanning direction, the following operation is performed.

The system controller 54 controls the reflective optical sensor 29, which is provided in the carriage 28, by the reflective optical sensor control circuit 65, so that light is emitted toward the platen 26 from the light-emitting section 38 of the reflective optical sensor 29 (step S12). The system controller 54 moves the carriage 28 in the main-scanning direction and ejects ink from the print head 36 provided in the carriage 28 so as to perform borderless printing, as well as emits light from the light-emitting section 38 toward a predetermined position on the platen 26 in the paper-feed direction but in a plurality of different positions on the platen 26 in the main-scanning direction, and based on the output values of the light-receiving section 40, which receives the light that has been emitted, detects whether or not the print paper P is in the traveling direction of the light (step S14).

It should be noted that as described above, in this embodiment, the reflective optical sensor 29 is aligned, in the main-scanning direction, with the nozzle located most upstream in the paper-feed direction, of among the plurality of nozzles provided in the print head 36. Thus, the predetermined position, in the paper-feed direction, of the reflective optical sensor 29 corresponds to the position of the nozzle #360 in the paper-feed direction.

Further, in this embodiment, whether or not the print paper P is in the traveling direction of the light is always detected while the carriage 28 is moving in the main-scanning direction. That is, when the edge of the print paper P blocks the light that is emitted from the light-emitting section 38, the object on which the light that is emitted from the light-emitting section 38 is incident changes from the platen 26 to the print paper P, and thus the intensity of the electric signal, that is, the value output by the light-receiving section 40 of the reflective optical sensor 29 that receives the light that is reflected is changed. Then, by measuring the intensity of this electric signal with the electric signal measuring section 66, the fact that the edge of the print paper P has passed the light is detected.

When movement of the carriage 28 in step S14 is over, whether or not the print paper P was in the traveling direction of the light during movement of the carriage 28 in the main-scanning direction is determined based on the output value of the light-receiving section 40 (step S16). That is, by determining whether or not the edge of the print paper P on the upstream side in the paper-feed direction (hereinafter, this edge may also be referred to as the bottom edge or the rear edge) has passed the predetermined position in the paper-feed direction (in this embodiment, the position in the paper-feed direction of the nozzle #360), the portion of the print paper P located on the upstream side in the paper-feed direction is detected.

If the result of the determination of step S16 is that the print paper P was in the traveling direction of the light, then after the print paper P is fed in the paper-feed direction (step S18), the procedure returns to step S14, and the system controller 54 repeats the above-described operations of step S14 through step S18 until the print paper P is no longer in the traveling direction of the light.

If the result of the determination of step S16 is that the print paper P was not in the traveling direction of the light, then the system controller 54 performs the following operation.

A more detailed description is provided using FIG. 10. FIG. 10 shows diagrams that schematically represent the positional relationship between the nozzles of the print head 36 and the print paper P.

In FIGS. 10A to 10C, the small rectangles shown on the left represent the nozzles of the print head 36. The numbers within the rectangles are the nozzle numbers, and correspond to the nozzle numbers shown in FIG. 8. It should be noted that in FIG. 10A to FIG. 10C, for the sake of simplifying the description, only the black nozzle row is shown, and moreover, the first black nozzle row and the second black nozzle row shown in FIG. 8 are shown on the same straight line. In FIGS. 10A to 10C, the circle shown to the right of nozzle #360 represents the reflective optical sensor 29. As described above, the position of the reflective optical sensor 29 in the paper-feed direction is identical to the position of the nozzle #360 in the paper-feed direction. Further, a portion of the print paper P (lower right edge) is shown to the right of the black nozzle row.

First, let us look at FIG. 10A. FIG. 10A represents the positional relationship between the nozzles of the print head 36 and the print paper P when the above-described operations of step S14 through step S18 are repeated and in step S16 it is determined that the print paper P has not arrived in the traveling direction of the light. It is clear from the diagram that the print paper P has not arrived in the traveling direction of the light that is emitted from the light-emitting section 38 of the reflective optical sensor 29 as the carriage 28, which is provided with the print head 36 and the reflective optical sensor 29, is moved in the main-scanning direction (in this embodiment, the direction of the arrow from left to right in the diagram).

In this manner, if the result of the determination of step S16 is that the print paper P has not arrived in the traveling direction of the light, then the system controller 54 feeds the print paper P in the paper-feed direction as shown in FIG. 10A and FIG. 10B (step S20). In this embodiment, the system controller 54 feeds the print paper P by 25·D (D is the dot pitch) using a carry roller etc.

Next, the system controller 54 moves the carriage 28 in the main-scanning direction (in this embodiment, the direction of the arrow from left to right in FIG. 10B) and ink is ejected from the nozzles of the print head 36 provided in the carriage 28 so as to perform borderless printing (step S24). During this printing, however, of among the plurality of nozzles of the print head 36, the system controller 54 does not allow ink to be ejected from the nozzles located on the upstream side in the paper-feed direction. In this embodiment, ink is kept from being ejected from the nozzle located most upstream in the paper-feed direction and the nozzles within a predetermined distance from that nozzle in the paper-feed direction, and in FIG. 10B these nozzles are the nozzles #353 to #360, shown by rectangles drawn with dashed lines.

It can be understood from the above that a procedure (step S22) for determining the nozzles to be kept from ejecting ink is necessary before borderless printing is performed by ejecting ink from the nozzles of the print head 36 (step S24). A specific method for determining which nozzles are kept from ejecting ink is discussed later.

Next, as shown in FIG. 10B and FIG. 10C, the system controller 54 further feeds the print paper P in the paper-feed direction (step S20). In this embodiment, here also, the system controller 54 feeds the print paper P by 25·D (D is the dot pitch).

Then, the system controller 54 moves the carriage 28 in the main-scanning direction (in this embodiment, the direction of the arrow, from left to right in FIG. 10B) and ink is ejected from the nozzles of the print head 36 provided in the carriage 28 so as to perform borderless printing (step S24). In this printing as well, of among the plurality of nozzles of the print head 36, the system controller 54 does not allow ink to be ejected from the nozzles positioned on the upstream side in the paper-feed direction. In this embodiment, ink is kept from being ejected from the nozzle located most upstream in the paper-feed direction and the nozzles within a predetermined distance from that nozzle in the paper-feed direction, and in FIG. 10C these nozzles correspond to the nozzles #340 to #360, which are shown by rectangles drawn with dashed lines. The nozzles from which ink is not ejected are determined prior to step S24 (step S22).

After the above procedure, that is, the procedure from step S20 to S24, has been repeated a predetermined number of times (in FIG. 9, N is the number of times), printing of the print paper P is ended (step S26). The print paper P is then discharged by the paper feed motor 31, which is driven by the sub-scan drive circuit 62 (step S28). It should be noted that since it is necessary to completely fill the print paper P with dots, the predetermined number of times N is determined based on the above-mentioned nozzle pitch k, whether or not a so-called overlap recording method is used, and the number of nozzles for recording dot groups on the same main-scan line if overlap recording is used, for example.

It should be noted a program for performing the above processes is stored in the EEPROM 58, and the system controller 54 executed the program. The system controller 54 controls the motors etc. in the printer according to the program to achieve the above-described processes.

It should be noted that in the description above, a reflective-type optical sensor is used, but this is not a limitation. For example, it is possible to arrange the light-emitting section and the light-receiving section such that they oppose one another in a direction perpendicular to both the main-scanning direction and the sub-scanning direction and such that they sandwich the print paper therebetween.

Further, in the description above, detection of whether the edge of the print paper passed the light is started after the number of times the carriage 28 is moved in the main-scanning direction has reached a predetermined number of times in step S10. This, however, is not a limitation. For example, it is possible to start detection from the first movement of the carriage 28 in the main-scanning direction, or to find an ideal detection timing through calculation etc. to make the number of times of detections minimum.

Further, in the description above, the nozzles that do not eject ink are determined every time the procedure passes step S22 in the loop from step S20 to step S26, but it is possible to determine the nozzles for the first through N-th times in the step S22 that is performed for the first time.

(1) Method for Determining Nozzles Kept from Ejecting Ink

As described above, the nozzles kept from ejecting ink are determined in step S22. Here, an example of the method for determining these nozzles is described using FIG. 9 and FIG. 10A to FIG. 10C.

First, as has been mentioned already, in this embodiment the nozzles that do not eject ink are the nozzle located most upstream in the paper-feed direction and the nozzles that are within a predetermined distance in the paper-feed direction from that nozzle. That is, in the example of FIG. 10, these are the nozzle #360 and the nozzles within a predetermined distance in the paper-feed direction from nozzle #360.

The predetermined distance is described below. The predetermined distance is set large to correspond to the increase in the aggregate paper feed amount (aggregate carry amount) of the print paper P after the portion of the print paper P positioned on the upstream side in the paper-feed direction is detected. More specifically, the predetermined distance is the amount obtained by subtracting a predetermined amount from the aggregate paper feed amount of the print paper P after the portion of the print paper P positioned on the upstream side in the paper-feed direction is detected. The aggregate paper feed amount in the example of FIG. 10B is 25·D (D is the dot pitch), and in the example of FIG. 10C is (25·D+25·D).

The predetermined amount is determined in correspondence with the detection precision with which the portion of the print paper P on the upstream side in the paper-feed direction is detected. If the predetermined distance were simply set to the aggregate paper feed amount, then there is no problem if the portion of the print paper P on the upstream side in the paper-feed direction can be detected accurately. However, if it cannot be detected accurately, a situation may occur in which nozzles that are kept from ejecting ink come into opposition to the print paper P. The predetermined amount is set so as to avoid this problem and ensure a certain margin. Consequently, the predetermined amount is made smaller, the higher the detection precision with which the portion of the print paper P located on the upstream side in the paper-feed direction is detected. In the examples of FIGS. 10B and 10C, the predetermined amount is set to an amount of 10·D.

When the above method is employed in the examples of FIG. 10B and FIG. 10C, the nozzles that do not eject ink are as follows.

In the example of FIG. 10B, the aggregate paper feed amount is 25·D and the predetermined amount is 10·D. Consequently, the predetermined distance is 15·D. The nozzles to be found are nozzle #360 and the nozzles that are within the range of the predetermined distance from nozzle #360 in the paper-feed direction, and these nozzles are nozzles #353 to #360. It should be noted that the distance in the paper-feed direction from nozzle #360 to nozzle #353 is a distance of 14·D.

In the example of FIG. 10C, the aggregate paper feed amount is 50·D and the predetermined amount is 10·D. Consequently, the predetermined distance is 40·D. The nozzles to be found are nozzle #360 and the nozzles that are within the range of the predetermined distance from nozzle #360 in the paper-feed direction, and these nozzles are nozzles #340 to #360. It should be noted that the distance in the paper-feed direction from nozzle #360 to nozzle #340 is a distance of 40·D.

As described earlier, the procedure from step S20 to step S24 shown in FIG. 9 is repeated for a predetermined number of times (in FIG. 9, N is this number of times). Consequently, step S22 is repeated N number of times. The examples of FIG. 10B and FIG. 10C mentioned above for determining the nozzles to be kept from ejecting ink are examples in which the nozzles are determined the first and the second time, respectively, when step S22 is performed. The same method can also be used to determine the nozzles in the third time through N-th time that step S22 is performed.

(1) Regarding the Detection Error for when Detecting the Portion of Print Paper Located on Upstream Side in Paper-feed Direction Next, consideration is given to a detection error for when detecting the portion of the print paper located on the upstream side in the paper-feed direction. As described above, the portion of the print paper P located on the upstream side in the paper-feed direction is detected by determining whether or not the lower edge of the print paper P has passed a predetermined position in the paper-feed direction (in this embodiment, the position in the paper-feed direction of the nozzle #360). During this detection, however, detection error occurs.

Figure 11:
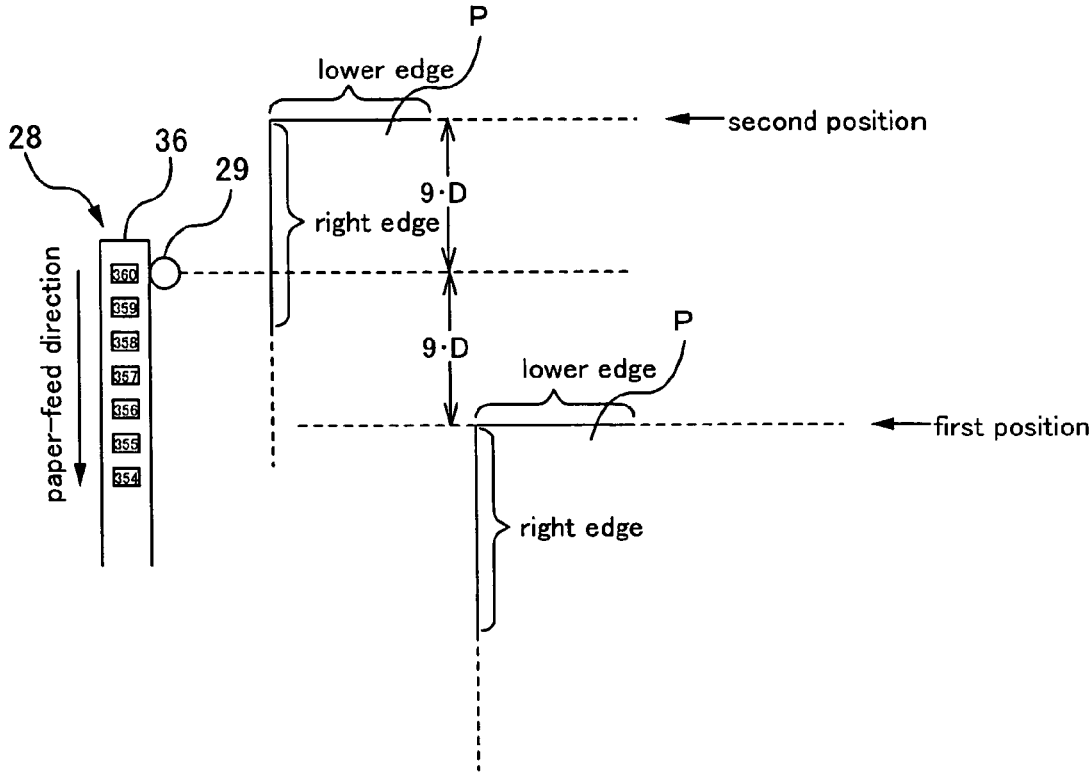
FIG. 11 is a diagram that schematically represents the positional relationship between the nozzles of the print head 36 and the print paper P.

This is described using FIG. 11. FIG. 11 is a diagram that schematically represents the positional relationship between the nozzles of the print head 36 and the print paper P.

In FIG. 11, the small rectangles shown on the left represent the nozzles of the print head 36. The numbers within the rectangles are the nozzle numbers, and correspond to the nozzle numbers shown in FIG. 8. It should be noted that in FIG. 11, for the sake of simplifying the description, only the black nozzle row is shown, and moreover, the first black nozzle row and the second black nozzle row shown in FIG. 8 are represented by the same straight line.

In FIG. 11, the circle shown to the right of nozzle #360 represents the reflective optical sensor 29. As mentioned above, the position of the reflective optical sensor 29 in the paper-feed direction is identical to the position of the nozzle #360 in the paper-feed direction. Further, a portion of the print paper P (lower right edge) is shown to the right of the black nozzle row. In FIG. 11, two positions of the print paper P are shown; as regards the print paper P shown on the downstream side in the paper-feed direction, its lower edge position (which is also referred to below as the first position) is located more on the downstream side, in the paper-feed direction, than the reflective optical sensor 29 by a distance of 9·D. On the other hand, as regards the print paper P shown on the upstream side in the paper-feed direction, its lower edge position (which is also referred to below as the second position) is located more on the upstream side, in the paper-feed direction, than the reflective optical sensor 29 by a distance of 9·D.

As described above, a detection error occurs when detecting the portion of the print paper P located on the upstream side in the paper-feed direction. Due to this detection error, the lower edge position of the print paper P for when the portion located on the upstream side in the paper-feed direction has been detected fluctuates between a range from the first position to the second position. That is, there is a possibility that the portion of the print paper P located on the upstream side in the paper-feed direction is not detected even when the lower edge position of the print paper P is at position somewhere on the upstream side of the first position, or conversely, the portion of the print paper P located on the upstream side in the paper-feed direction is detected even when the lower edge position of the print paper P is at a position somewhere on the downstream side of the second position.

Further, as shown in FIG. 11, according to the present embodiment, the position, in the paper-feed direction, of the nozzle located most upstream in the paper-feed direction (i.e., the nozzle #360) is on the upstream side of the first position and on the downstream side of the second position, and further, is in the middle of the first position and the second position.

The following advantages can be achieved by providing the position, in the paper-feed direction, of the nozzle located most upstream in the paper-feed direction (i.e., the nozzle #360) on the upstream side of the first position and on the downstream side of the second position.

Figure 12:
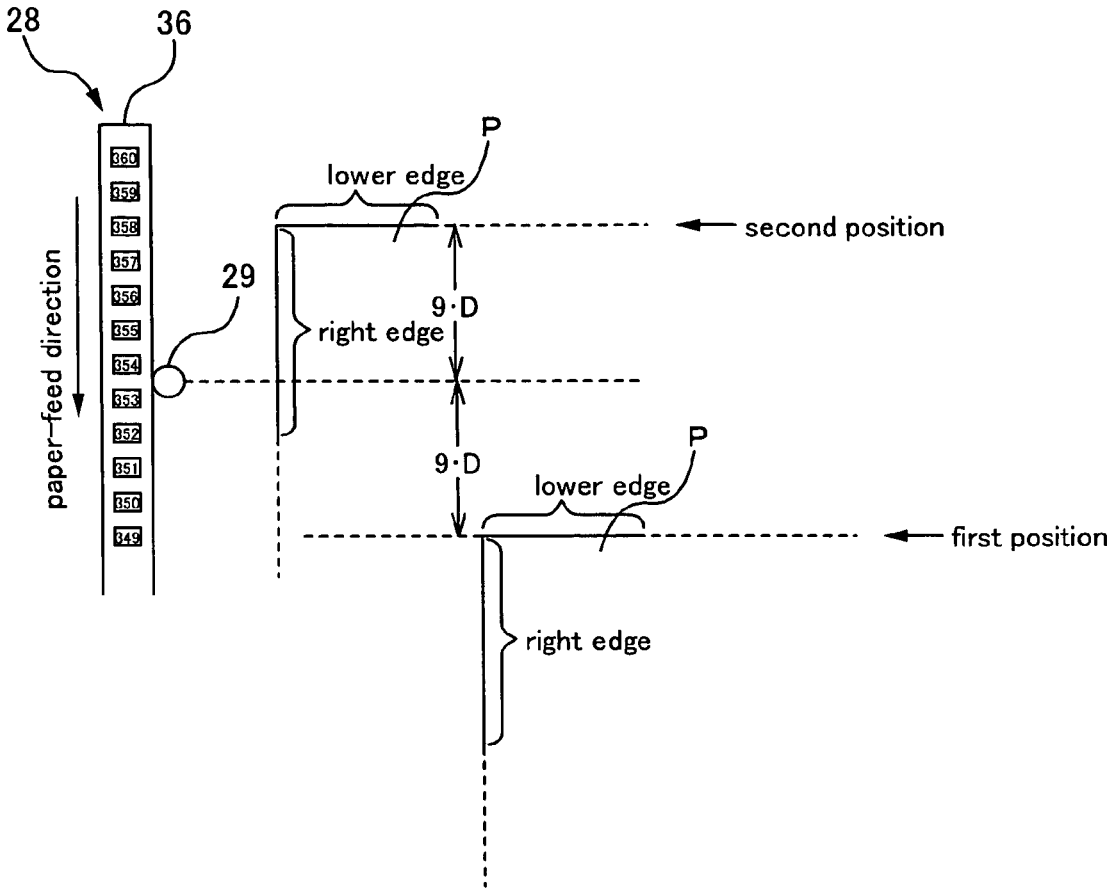
FIG. 12 is a diagram that schematically represents the positional relationship between the nozzles of the print head 36 and the print paper P.
Figure 13:
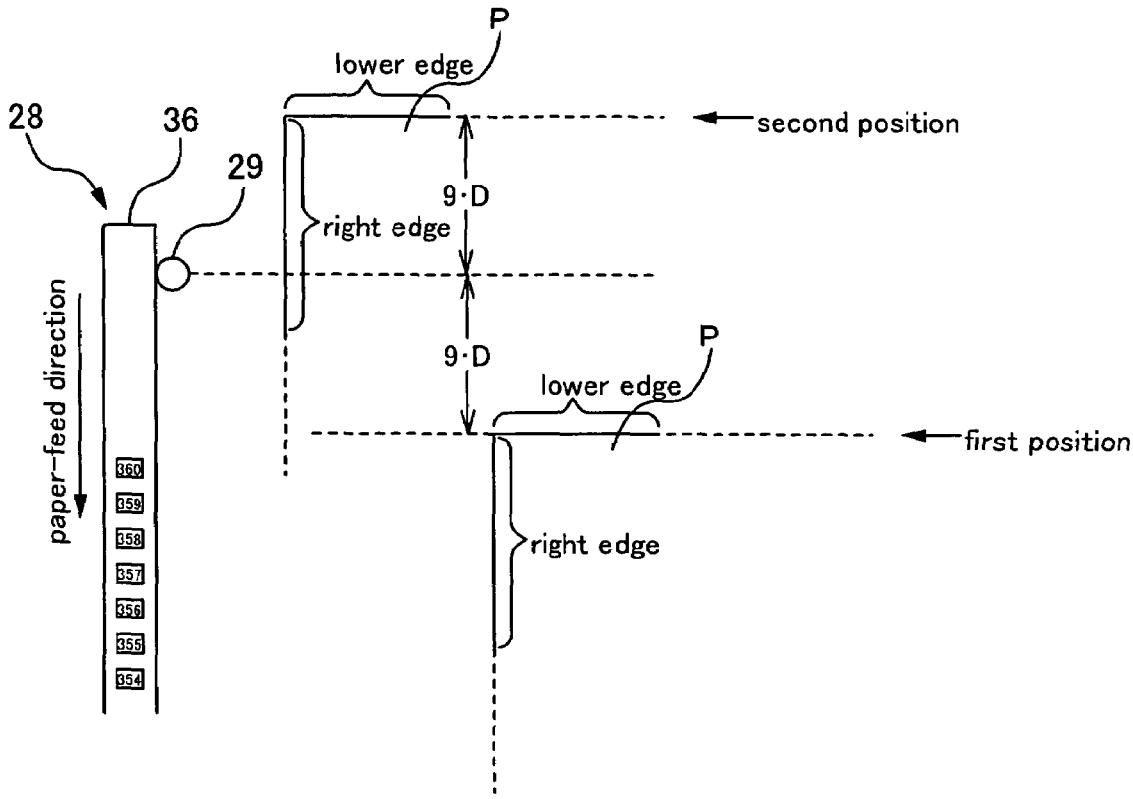
FIG. 13 is a diagram that schematically represents the positional relationship between the nozzles of the print head 36 and the print paper P.

These are described using FIG. 12 and FIG. 13. FIG. 12 and FIG. 13 are diagrams that schematically represent the positional relationship between the nozzles of the print head 36 and the print paper P. FIG. 12 and FIG. 13 correspond to the drawing of FIG. 11, but the positional relationship between the first position or the second position and the position, in the paper-feed direction, of the nozzle located most upstream in the paper-feed direction (i.e., the nozzle #360) is different from FIG. 11.

First, attention is paid to FIG. 12. In the example of FIG. 12, the position, in the paper-feed direction, of the nozzle located most upstream in the paper-feed direction (i.e., the nozzle #360) is on the upstream side of both the first position and the second position. That is, the position in the paper-feed direction of the nozzle #360 is always on the upstream side of the lower edge position of the print paper P when detecting the portion of the print paper P located on the upstream side in the paper-feed direction, regardless of the above-described fluctuation due to the detection error in the lower edge position of the print paper P.

If the above-described method for keeping the nozzles positioned on the upstream side of the paper-feed direction from ejecting ink is applied to this example, then, compared to the example of FIG. 11 for example, the number of nozzles that eject ink, even though they are not required to eject ink because they do not oppose the print paper, increases. This increase in the number of nozzles gives rise to a problem that ink is uselessly wasted.

Next, attention is paid to FIG. 13. In the example of FIG. 13, the position, in the paper-feed direction, of the nozzle located most upstream in the paper-feed direction (i.e., the nozzle #360) is on the downstream side of both the first position and the second position. That is, the position in the paper-feed direction of the nozzle #360 is always on the downstream side of the lower edge position of the print paper P when detecting the portion of the print paper P located on the upstream side in the paper-feed direction, regardless of the above-described fluctuation due to the detection error in the lower edge position of the print paper P.

If the above-described method for keeping the nozzles positioned on the upstream side of the paper-feed direction from ejecting ink is applied to this example, then there will be nozzles that do not eject ink even though they are required to eject ink because they are in opposition to the print paper. Therefore, due to such a nozzle operation, a blank portion will appear on the print paper. Further, in order to prevent this blank portion from appearing, there arises a problem that it becomes necessary to set the above-described predetermined amount to a larger value to secure a larger margin.

Further, when the position, in the paper-feed direction, of the nozzle located most upstream in the paper-feed direction (i.e., the nozzle #360) is on the downstream side of both the first position and the second position, then the size of the carriage 28 in the paper-feed direction becomes large, thereby resulting in the apparatus to be increased in size. More specifically, although the carriage 28 is inherently required to have a size in the paper-feed direction amounting to the length of the nozzle row, it further becomes necessary to provide it with a length for securing the position for attaching the reflective optical sensor.

Compared to these two examples, the example shown in FIG. 11 lessens the problems described for the above two examples because the position, in the paper-feed direction, of the nozzle located most upstream in the paper-feed direction (i.e., the nozzle #360) is located on the upstream side than the first position and on the downstream side than the second position. That is, according to the example shown in FIG. 11, it becomes possible to achieve a printer in which the nozzle located most upstream in the paper-feed direction is arranged at an ideal position in consideration of the problems described above.

(1) Other Embodiments

In the foregoing, a liquid ejecting apparatus etc. according to the invention was described based on an embodiment thereof. However, the foregoing embodiment is for the purpose of elucidating the present invention and are not to be interpreted as limiting the present invention. The invention can of course be altered and improved without departing from the gist thereof and includes functional equivalents.

Print paper was described as an example of the medium, but it also possible to use film, cloth, and thin metal sheets, and the like as the medium.

In the foregoing embodiment, a printing apparatus was described as an example of the liquid ejecting apparatus. However, this is not a limitation. For example, technology like that of the embodiment can also be adopted for color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices. The above-described effects can be maintained even when the present technology is adopted in these fields because of the feature that liquid can be ejected toward a medium.

Further, in the foregoing embodiment, a color inkjet printer was described as an example of the printing apparatus; however, this is not a limitation. For example, the present invention can also be applied to monochrome inkjet printers.

Further, in the above embodiment, ink was used as an example of the liquid; however, this is not a limitation. For example, it is also possible to eject from the nozzles a liquid (including water) including metallic material, organic material (particularly macromolecular material), magnetic material, conductive material, wiring material, film-formation material, processed liquid, and genetic solution.

Further, in the foregoing embodiment, the position, in the paper-feed direction, of the nozzle located most upstream in the paper-feed direction, of among the plurality of nozzles, was in the middle of the first position and the second position, but this is not a limitation, and it is only necessary that the position is on the upstream side of the first position and on the downstream side of the second position.

However, the foregoing embodiment is preferable from the standpoint that, by providing the position, in the paper-feed direction, of the nozzle located most upstream in the paper-feed direction right in the middle of the first position and the second position, it becomes possible to most effectively lessen the two types of problems described above and achieve a printer in which the nozzle located most upstream in the feeding direction is arranged at an ideal position.

Further, in the foregoing embodiment, the reflective optical sensor was provided aligned in the main-scanning direction with the nozzle located most upstream in the paper-feed direction, but this is not a limitation.

In this way, however, the position, in the paper-feed direction, of the nozzle located most upstream in the paper-feed direction becomes located, almost certainly, on the upstream side of the first position and on the downstream side of the second position, and moreover, if the amount of error towards the upstream side from the position of the reflective optical sensor in the paper-feed direction and the amount of error towards the downstream side therefrom are equal (in the example of FIG. 11, the amount of error is set to 9·D), then the position will be right in the middle of the first position and the second position. The foregoing embodiment is therefore more preferable in terms that the above-described effects can be achieved.

Further, in the foregoing embodiment, the portion of the print paper located on the upstream side in the paper-feed direction was detected, and based on this detection result, ink was kept from being ejected from the nozzle located most upstream in the paper-feed direction and the nozzles located within a predetermined distance from that nozzle in the paper-feed direction, of among the plurality of nozzles, but this is not a limitation. For example, some of the nozzles, of among the nozzle located most upstream in the paper-feed direction and the nozzles located within a predetermined distance from that nozzle in the paper-feed direction, may eject ink.

However, the above embodiment is more preferable from the standpoint that they allow the amount of ink that is used to be further reduced.

Further, in the foregoing embodiment, the process of feeding the print paper in the paper-feed direction using the paper feed motor and the process of moving the print head so as to print the print paper were repeated a predetermined number of times after the portion of the print paper located on the upstream side in the paper-feed direction was detected, and then printing to the print paper was ended. This is not a limitation, however.

However, the above embodiment is preferable from the standpoint that they allow the print paper to be completely filled with dots.

Further, in the foregoing embodiment, the predetermined number of times was a plural number of times, and the predetermined distance in the process for printing the print paper was increased in correspondence with an increase in the aggregate paper feed amount of the print paper after detection of the portion of the print paper on the upstream side in the paper-feed direction. However, this is not a limitation, and it is also possible to set the predetermined distance to a distance that remains constant regardless of the increase in the aggregate paper feed amount, for example.

However, in this case, the above embodiment is preferable from the standpoint that they allow the number of nozzles that do not eject ink to be increased in correspondence with an increase in the number of nozzles that are not in opposition to the print paper, consequently allowing the amount of ink that is consumed to be further reduced.

Further, in the foregoing embodiment, the value obtained by subtracting a predetermined amount from the aggregate paper feed amount served as the predetermined distance. However, there is no limitation to this, and for example, it is also possible to adopt the aggregate paper feed amount as the predetermined distance.

However, the above embodiment is more preferable from the standpoint that they allow a margin to be secured, taking into account the detection error when the portion of the print paper that is located on the upstream side in the paper-feed direction is detected.

Further, in the foregoing embodiment, the predetermined amount was made smaller the higher the detection precision with which the portion of the print paper located on the upstream side in the paper-feed direction is detected. However, this is not a limitation, and for example, it is also possible to set a value for the predetermined amount that is unrelated to the detection precision.

However, from the standpoint that the nozzles that are kept from ejecting ink can be more effectively determined by adjusting the amount of the margin in accordance with the degree of detection precision, the above embodiment is more preferable.

Further, in the foregoing embodiment, the portion of the print paper that is located on the upstream side in the paper-feed direction was detected by determining whether or not the edge of the printing paper on the upstream side in the paper-feed direction had passed a predetermining position in the paper-feed direction. However, this is not a limitation.

However, the above embodiment is preferable from the standpoint that the portion of the print paper that is located on the upstream side in the paper-feed direction can be detected more reliably.

Further, in the foregoing embodiment, the apparatus was provided with a platen for supporting the print paper, a light-emitting section for emitting light toward the platen, and a light-receiving section for receiving the light that has been emitted from the light-emitting section, and by determining whether or not the print paper is in the traveling direction of the light emitted from the light-emitting section based on the output value of the light-receiving section, it was determined whether or not the edge of the print paper on the upstream side in the paper-feed direction had passed a predetermined position in the paper-feed direction. However, there is no limitation to this.

However, the above-mentioned embodiment is more preferable from the standpoint that whether or not the edge of the print paper that is positioned on the upstream side in the paper-feed direction has passed a predetermined position in the paper-feed direction can be more easily determined.

Further, in the foregoing embodiment, whether or not the print paper was in the traveling direction of the light was determined based on the output value of the light-receiving section for receiving the light that is emitted from the light-emitting section toward a predetermined position in the paper-feed direction on the platen but toward a plurality of different positions in the main-scanning direction on the platen. However, there is no limitation to this. For example, it is also possible to determine whether or not the print paper is in the traveling direction of the light based on the output value of the light-receiving section for receiving the light that is emitted from the light-emitting section toward only a single position that is in a predetermined position on the platen in the paper-feed direction.

However, in this case, the above-mentioned embodiment is preferable from the standpoint that even if the print paper is skewed, for example, it is possible to reliably detect the portion of the print paper that is located on the upstream side in the paper-feed direction.

Further, in the foregoing embodiment, the light-emitting section and the light-receiving section were provided on a carriage that is movable in the main-scanning direction, and whether or not the print paper is in the traveling direction of the light was determined based on the output value of the light-receiving section for receiving the light that is emitted from the light-emitting section, while the carriage was moved in the main-scanning direction, toward a predetermined position in the paper-feed direction on the platen but toward a plurality of different positions in the main-scanning direction on the platen. However, there is no limitation to this. For example, the positions of the light-emitting section and the light-receiving section can be fixed, and whether or not the print paper is in the traveling direction of the light can be determined based on the output value of the light-receiving section for receiving the light that is emitted from the light-emitting section toward a predetermined position in the paper-feed direction on the platen but a plurality of different positions in the main-scanning direction on the platen.

However, in this case, the above embodiment is more preferable from the standpoint that it is not necessary to change the direction in which the light is emitted for each position when light is emitted from the light-emitting section toward a plurality of different positions in the main-scanning direction.

Further, in the foregoing embodiment, whether or not the print paper is in the traveling direction of the light was detected based on the output value of the light-receiving section for receiving the light that is emitted from the light-emitting section, while the carriage provided with the print head was moved in the main-scanning direction, toward a predetermined position in the paper-feed direction but a plurality of different positions in the main-scanning direction, and also, printing was performed with respect to the print paper by ejecting ink from the nozzles provided in the print head. However, there is no limitation to this. For example, it is also possible to adopt a configuration in which the carriage and the light emitting and light-receiving sections are moved in the main-scanning direction individually.

However, in this case, the above embodiment is preferable from the standpoint that the carriage, the light-emitting section, and the light-receiving section can share a common moving mechanism.

Further, in the foregoing embodiment, borderless printing was performed. This is not a limitation, however.

In the case of borderless printing, however, since printing is carried out with respect to the entire surface of the print paper, a situation where ink is ejected from nozzles that are not in opposition to the print paper when a portion of the nozzle surface is not in opposition to the print paper occurs easily, and therefore, the above-described means are even more advantageous.

(1) Configuration of Computer System Etc.

Next, an embodiment of a computer system, which is an example of an embodiment of the present invention, will be described with reference to the drawings.

Figure 14:
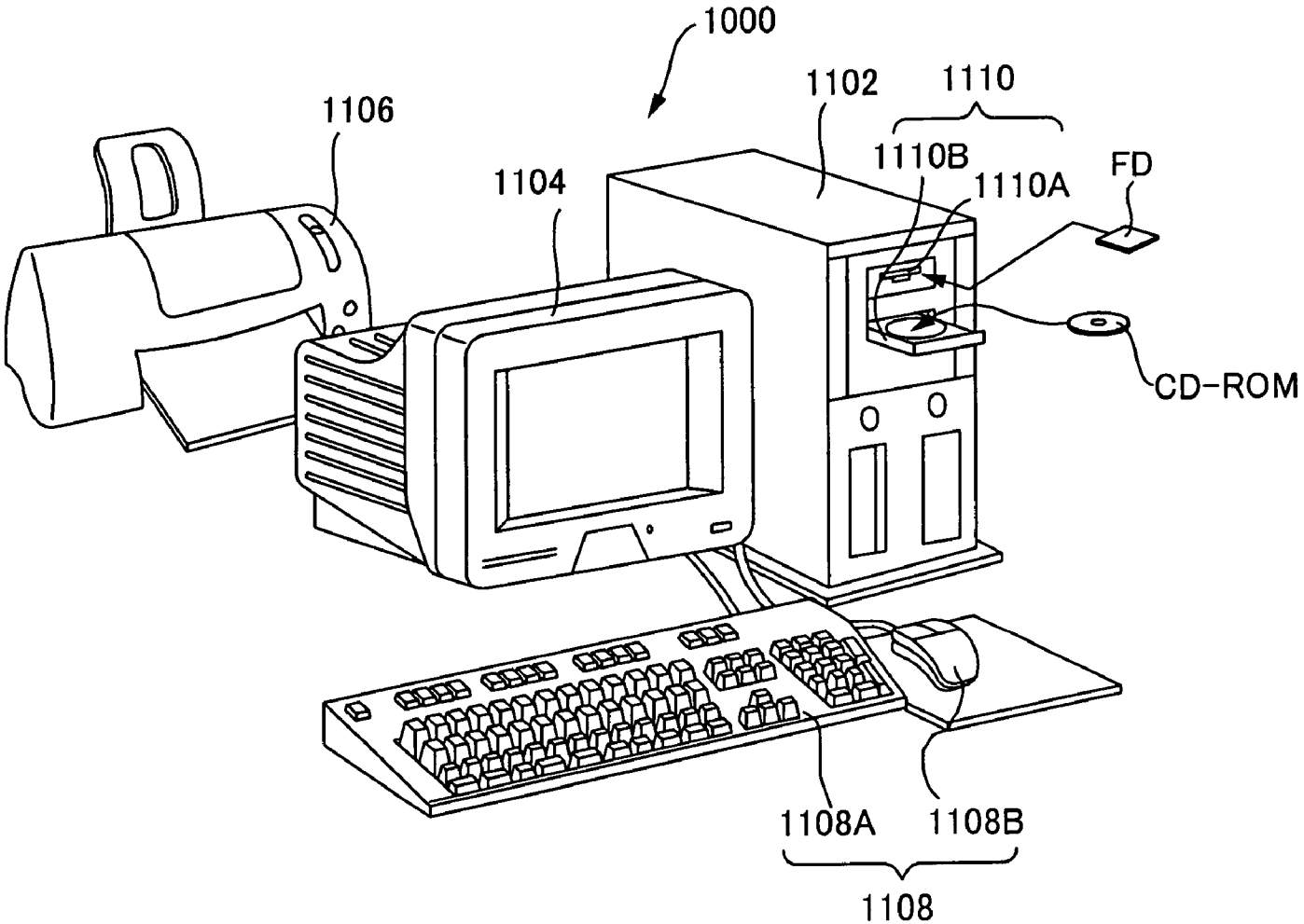
FIG. 14 is an explanatory diagram showing the external configuration of the computer system.

FIG. 14 is an explanatory diagram showing the external configuration of the computer system. A computer system 1000 is provided with a main computer unit 1102, a display device 1104, a printer 1106, an input device 1108, and a reading device 1110. In this embodiment, the main computer unit 1102 is accommodated within a mini-tower type housing; however, this is not a limitation. A CRT (cathode ray tube), a plasma display, or a liquid crystal display device, for example, is generally used as the display device 1104, but this is not a limitation. The printer 1106 is the printer described above. In this embodiment, the input device 1108 is a keyboard 1108A and a mouse 1108B, but it is not limited to these. In this embodiment, a flexible disk drive device 111A and a CD-ROM drive device 1110B are used as the reading device 1110, but the reading device 1110 is not limited to these, and it may also be a MO (magneto optical) disk drive device or a DVD (digital versatile disk), for example.

Figure 15:
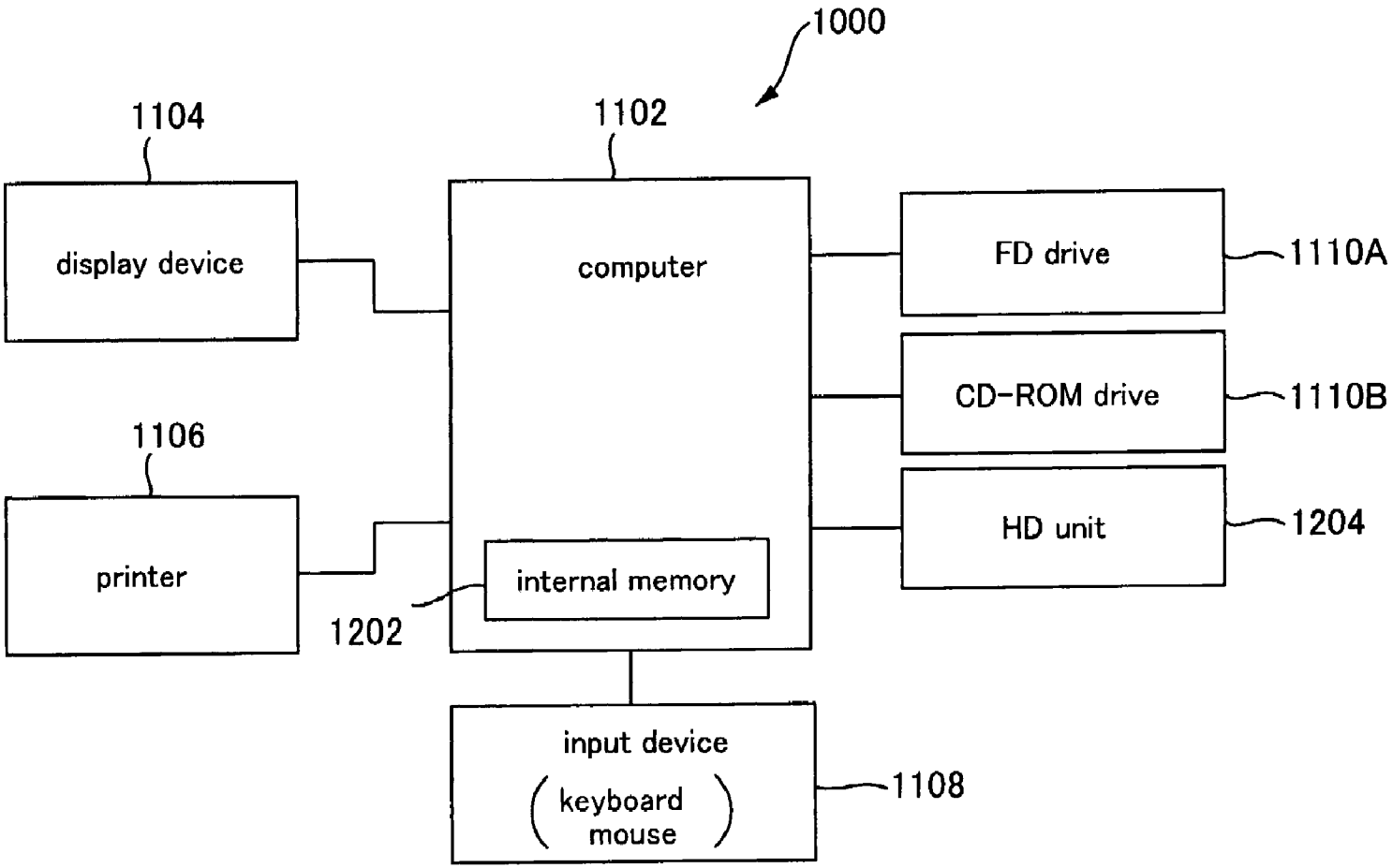
FIG. 15 is a block diagram showing the configuration of the computer system shown in FIG. 14.

FIG. 15 is a block diagram showing the configuration of the computer system shown in FIG. 14. An internal memory 1202 such as a RAM within the housing accommodating the main computer unit 1102 and, also, an external memory such as a hard disk drive unit 1204 are provided.

In the above description, an example was described in which the computer system is constituted by connecting the printer 1106 to the main computer unit 1102, the display device 1104, the input device 1108, and the reading device 1110. However, this is not a limitation. For example, the computer system can be made of the main computer unit 1102 and the printer 1106, or the computer system does not have to be provided with one of the display device 1104, the input device 1108, and the reading device 1110.

It is also possible for the printer 1106, for example, to have some of the functions or mechanisms of the main computer unit 1102, the display device 1104, the input device 1108, and the reading device 1110. As an example, the printer 1106 may be configured so as to have an image processing section for carrying out image processing, a display section for carrying out various types of displays, and a recording media attachment/detachment section to and from which recording media storing image data captured by a digital camera or the like are inserted and taken out.

As an overall system, the computer system that is thus achieved becomes superior to conventional systems.

According to the foregoing embodiment, it becomes possible to achieve a liquid ejecting apparatus and a computer system in which the nozzle located most upstream in the feeding direction is arranged at an ideal position.

(2)

Another embodiment is described next.

It should be noted that the "feeding direction" and the "sub-scanning direction" described above correspond to the "carrying direction" in the description below. Further, the "main-scanning direction" described above corresponds to the "scanning direction" in the description below. Further, the print paper P described above corresponds to the paper S in the description below. Further, the "portion of the print paper located on the upstream side in the paper-feed direction" corresponds to the "rear edge" in the description below.

Further, the "reflective optical sensor 29" described above corresponds to the "optical sensor 254" in the description below.

(2) Configuration of Printing System

An embodiment of a printing system (computer system) is described with reference to the drawings. However, the description of the following embodiment also includes implementations relating to a computer program and a storage medium having recorded thereon the computer program, for example.

Figure 16:
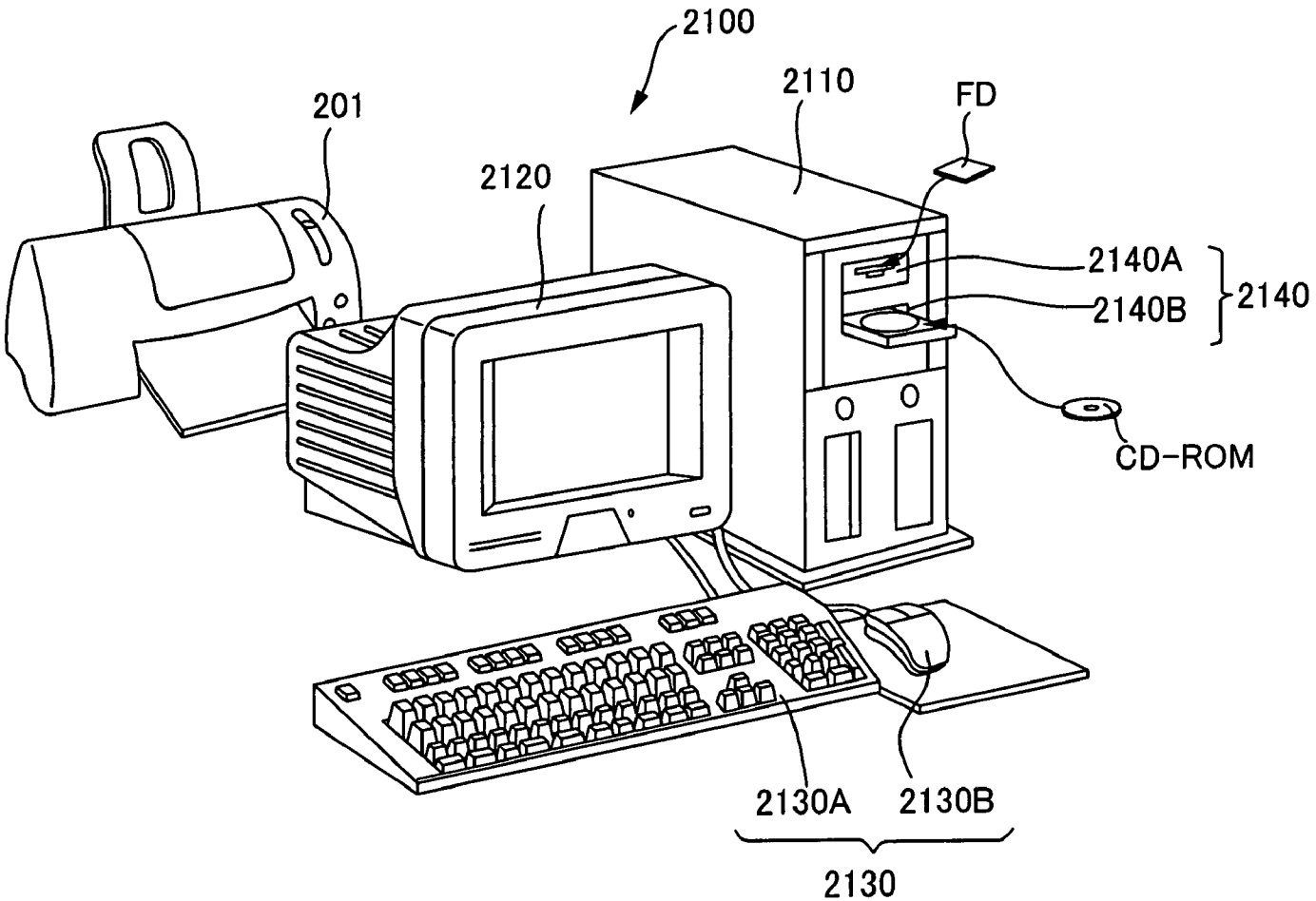
FIG. 16 is an explanatory drawing showing an overall configuration of a printing system.

FIG. 16 is an explanatory drawing showing the external structure of a printing system. A printing system 2100 is provided with a printer 201, a computer 2110, a display device 2120, an input device 2130, and a record-and-play device 2140. The printer 201 is a printing apparatus for printing images on a medium such as paper, cloth, or film. The computer 2110 is electrically connected to the printer 201, and outputs print data corresponding to an image to be printed to the printer 201 in order to print the image with the printer 201. The display device 2120 has a display, and displays a user interface such as an application program or a printer driver. The input device 2130 is for example a keyboard 2130A and a mouse 2130B, and is used to operate an application program or adjust the settings of the printer driver, for example, in accordance with the user interface that is displayed on the display device 2120. A flexible disk drive device 2140A and a CD-ROM drive device 2140B are employed as the record-and-play device 2140.

A printer driver is installed on the computer 2110. The printer driver is a program for achieving the function of displaying the user interface on the display device 2120, and in addition it also achieves the function of converting image data that have been output from the application program into print data. The printer driver is stored on a storage medium (computer-readable storage medium) such as a flexible disk FD or a CD-ROM. Also, the printer driver can be downloaded onto the computer 2110 via the Internet. It should be noted that this program is made of codes for achieving various functions.

It should be noted that "printing apparatus" in a narrow sense means the printer 201, but in a broader sense it means the system constituted by the printer 201 and the computer 2110.

(2) Configuration of the Printer

<Regarding the Configuration of the Inkjet Printer>

Figure 17:
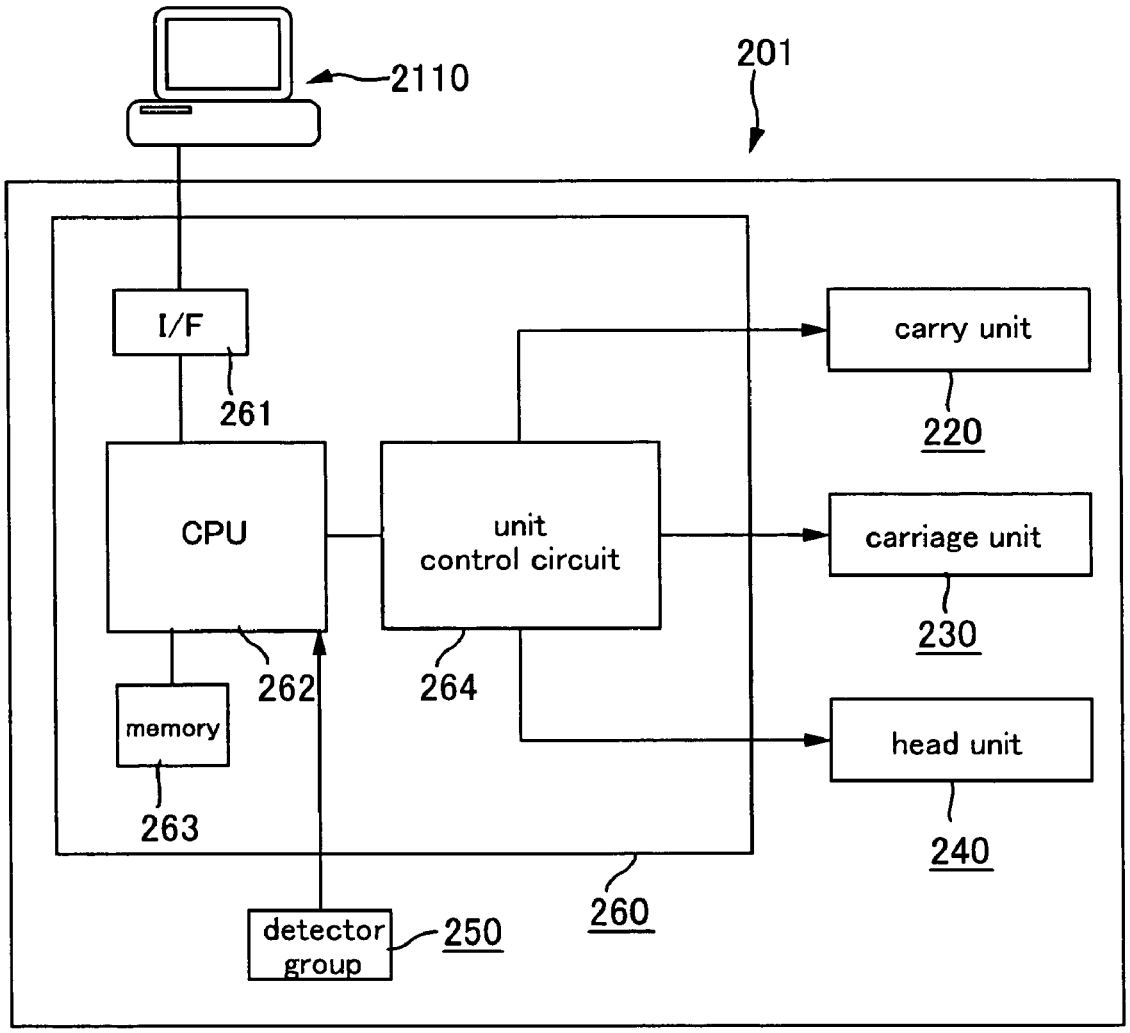
FIG. 17 is a block diagram of an overall configuration of a printer.
Figure 18:
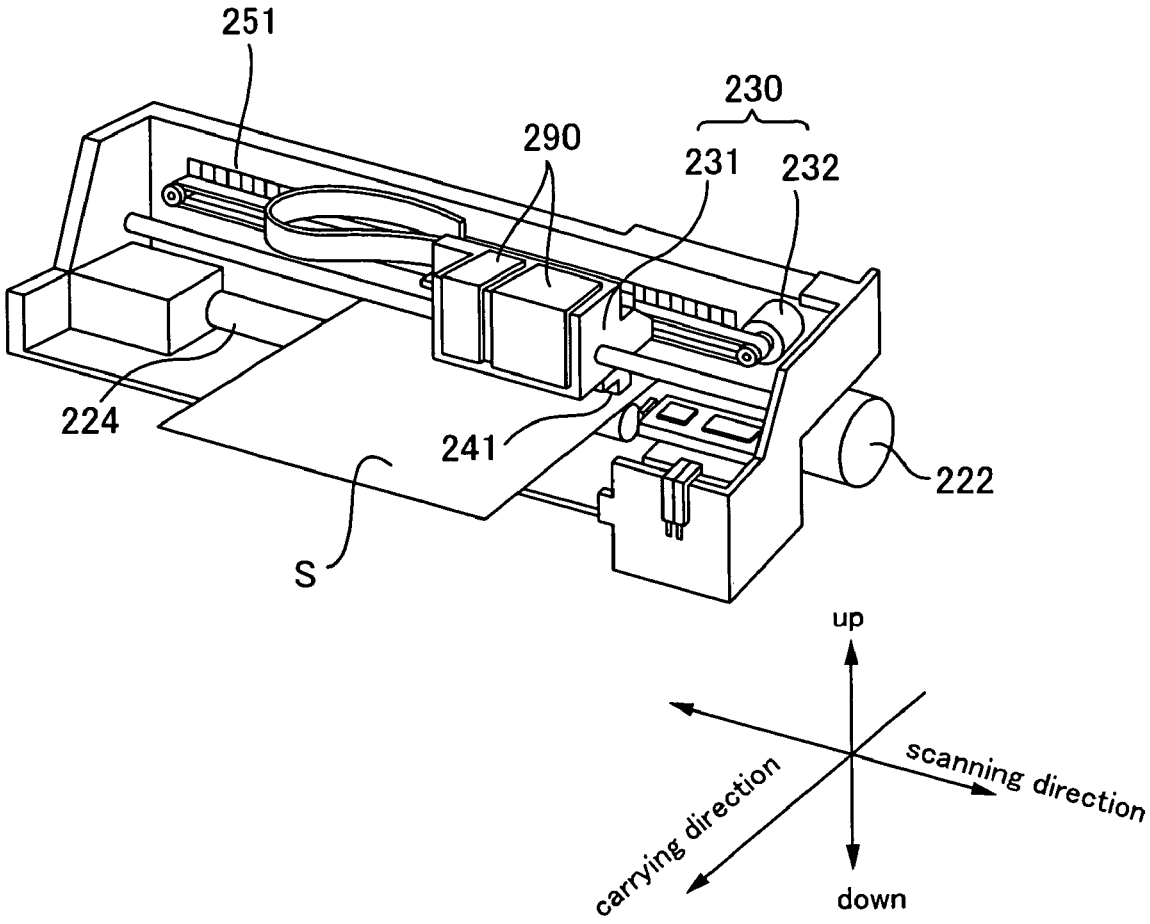
FIG. 18 is a schematic diagram of the overall configuration of the printer.
Figure 19:
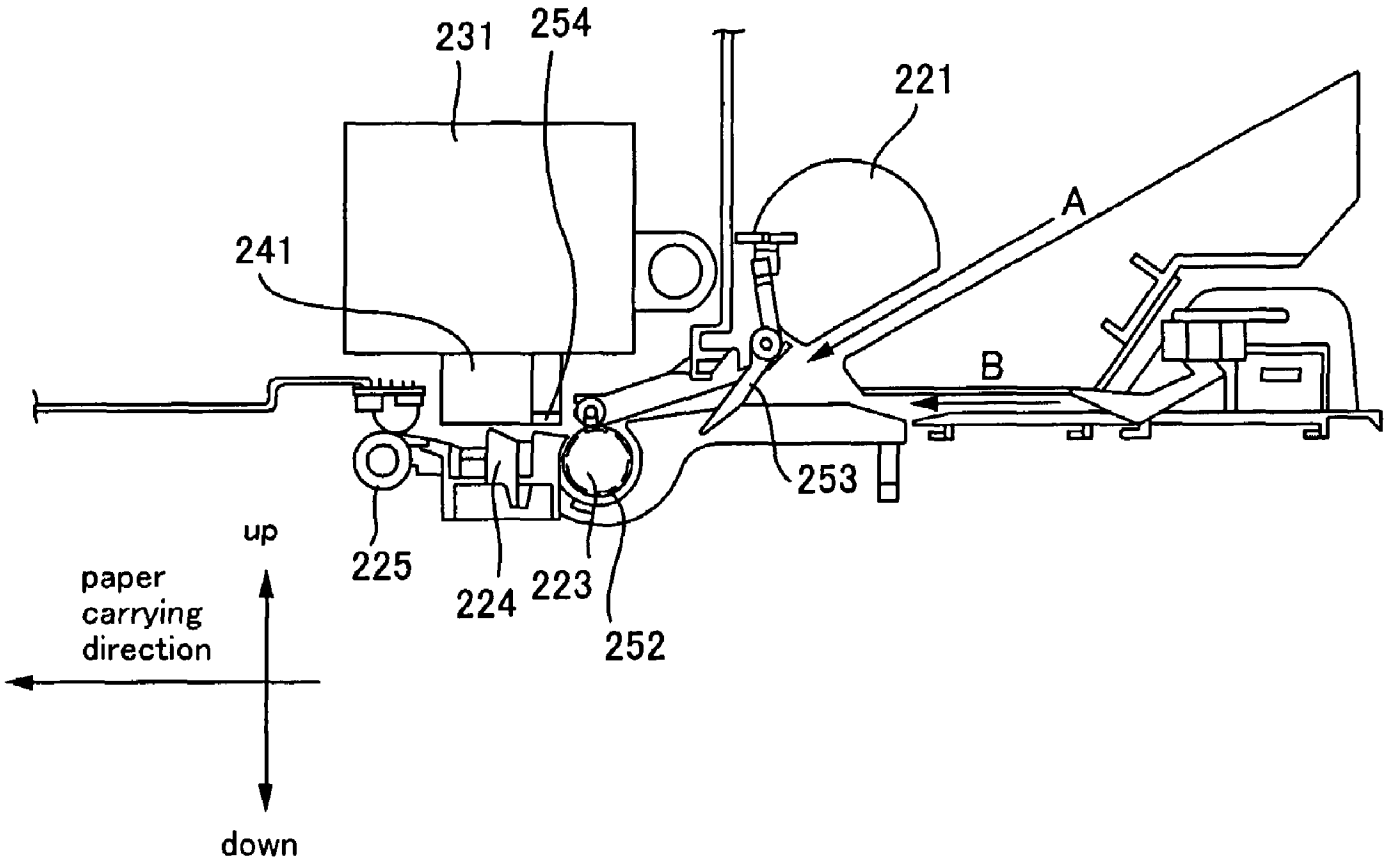
FIG. 19 is lateral sectional view of the overall configuration of the printer.

FIG. 17 is a block diagram of the overall configuration of the printer of this embodiment. Also, FIG. 18 is a schematic diagram of the overall configuration of the printer of this embodiment. FIG. 19 is lateral sectional view of the overall configuration of the printer of this embodiment. The basic structure of the printer according to the present embodiment is described below.

The printer of this embodiment has a carry unit 220, a carriage unit 230, a head unit 240, a detector group 250, and a controller 260. The printer 201 that has received print data from the computer 2110, which is an external device, controls the various units (the carry unit 220, the carriage unit 230, and the head unit 240) using the controller 260. The controller 260 controls the units in accordance with the print data that are received from the computer 2110 to form an image on a paper. The detector group 250 monitors the conditions within the printer 201, and it outputs the results of this detection to the controller 260. The controller receives the detection results from the sensor, and controls the units based on these detection results.

The carry unit 220 is for feeding a medium (for example, paper S) into a printable position and carrying the paper in a predetermined direction (hereinafter, referred to as the carrying direction) by a predetermined carry amount during printing. In other words, the carry unit 220 functions as a carrying mechanism (carrying means) for carrying paper. The carry unit 220 has a paper supplying roller 221, a carry motor 222 (hereinafter, referred to as PF motor), a carry roller 223, a platen 224, and a paper discharge roller 225. However, the carry unit 220 does not necessarily have to include all of these structural elements in order to function as a carrying mechanism. The paper supplying roller 221 is a roller for automatically supplying paper that has been inserted into a paper insert opening into the printer. The paper supplying roller 221 has a transverse cross-sectional shape in the shape of the letter D, and the length of the circumference section thereof is set longer than the carrying distance to the carry motor 2223, so that using this circumference section the paper can be carried up to the carry roller 223. The carry motor 222 is a motor for carrying paper in the paper carrying direction, and is constituted by a DC motor. The carry roller 223 is a roller for carrying the paper S that has been supplied by the paper supplying roller 221 up to a printable region, and is driven by the carry motor 222. The platen 224 supports the paper S during printing. That is, the platen 224 functions as a supporting section. The paper discharge roller 225 is a roller for discharging the paper S for which printing has finished to outside the printer. The paper discharge roller 225 is rotated in synchronization with the carry roller 223.

The carriage unit 230 is for making the head move (perform scanning movement) in a predetermined direction (hereinafter, this is referred to as the scanning direction). The carriage unit 230 has a carriage 231 and a carriage motor 232 (also referred to as CR motor). The carriage 231 is capable of moving back and forth in the scanning direction (and accordingly, the head moves in the scanning direction). Also, the carriage 231 detachably retains an ink cartridge for accommodating ink. The carriage motor 232 is a motor for moving the carriage 231 in the scanning direction, and is constituted by a DC motor.

The head unit 240 is for ejecting ink onto paper. The head unit 240 has a head 241. The head 241 has a plurality of nozzles, which are ink ejecting sections, and ejects ink intermittently from each of the nozzles. The head 241 is provided in the carriage 231. Thus, when the carriage 231 moves in the scanning direction, the head 241 also moves in the scanning direction. A dot line (raster line) is formed on the paper in the scanning direction as a result of the head 241 intermittently ejecting ink while moving in the scanning direction.

The detector group 250 includes a linear encoder 251, a rotary encoder 252, a paper detection sensor 253, and an optical sensor 254, for example. The linear encoder 251 is for detecting the position of the carriage 231 in the scanning direction. The rotary encoder 252 is for detecting the amount of rotation of the carry roller 223. The paper detection sensor 253 is for detecting the position of the front edge of the paper to be printed. The paper detection sensor 253 is provided in a position where it can detect the position of the front edge of the paper as the paper is being fed toward the carry roller 223 by the paper supplying roller 221. It should be noted that the paper detection sensor 253 is a mechanical sensor that detects the front edge of the paper through a mechanical mechanism. More specifically, the paper detection sensor 253 has a lever that can be rotated in the paper carrying direction, and this lever is arranged such that it protrudes into the path over which the paper is carried. In this way, the front edge of the paper comes into contact with the lever and the lever is rotated, and thus the paper detection sensor 253 detects the position of the front edge of the paper by detecting movement of the lever. The optical sensor 254 is attached to the carriage 231. The optical sensor 254 detects whether or not the paper is present by its light-receiving section detecting reflected light of the light that has been irradiated onto the paper from the light-emitting section. The optical sensor 254 detects the position of the edge of the paper while being moved by the carriage 41. The optical sensor 254 optically detects the edge of the paper, and thus has higher detection accuracy than the mechanical paper detection sensor 253.

The controller 260 is a control unit (controlling means) for carrying out control of the printer. The controller 260 has an interface section 261, a CPU 262, a memory 263, and a unit control circuit 264. The interface section 261 exchanges data between the computer 2110, which is an external device, and the printer 201. The CPU 262 is a computer processing device for carrying out overall control of the printer. The memory 263 is for reserving a working region and a region for storing the programs for the CPU 262, for instance, and has storing means such as a RAM or an EEPROM. The CPU 262 controls the various units via the unit control circuit 264 in accordance with programs stored in the memory 263.

<Regarding the Printing Operation>

Figure 20:
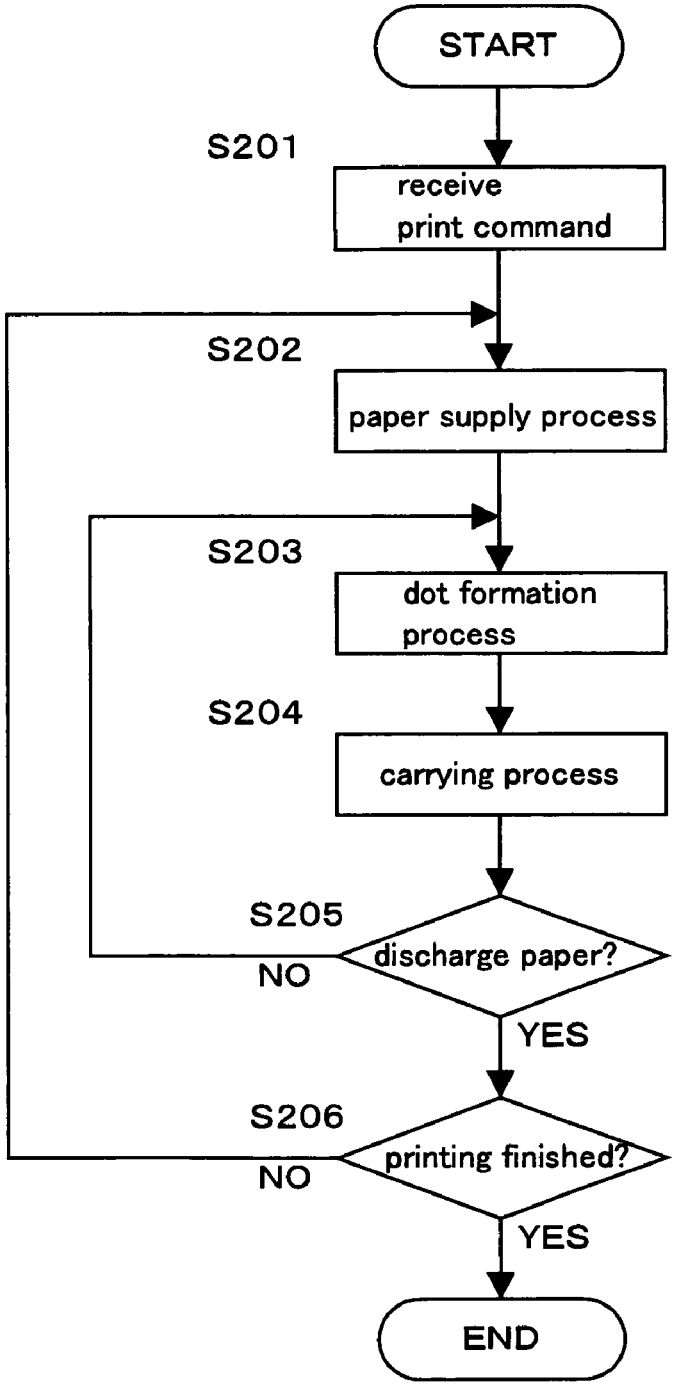
FIG. 20 is a flowchart of the processing during printing.

FIG. 20 is a flowchart of the processing during printing. The processes described below are executed by the controller 260 controlling the various units in accordance with a program stored in the memory 263. This program has codes for executing the various processes.

The controller 260 receives a print command via the interface section 261 from the computer 2110 (S201). This print command is included in the header of the print data transmitted from the computer 2110. The controller 260 then analyzes the content of the various commands included in the print data that is received and uses the units to perform the following paper supply process, carrying process, and ink ejection process, for example.

First, the controller 260 performs the paper supply process (S202). The paper supply process is a process for supplying paper to be printed into the printer and positioning the paper at a print start position (also referred to as the "indexed position"). The controller 260 rotates the paper supplying roller 221 to feed the paper to be printed up to the carry roller 223. The controller 260 rotates the carry roller 223 to position the paper that has been fed from the paper supplying roller 221 at the print start position. When the paper has been positioned at the print start position, at least some of the nozzles of the head 241 are in opposition to the paper.

Next, the controller 260 performs the dot formation process (S203). The dot formation process is a process for intermittently ejecting ink from a head that moves in the scanning direction so as to form dots on the paper. The controller 260 drives the carriage motor 232 to move the carriage 231 in the scanning direction. The controller 260 then causes the head to eject ink in accordance with the print data during the period that the carriage 231 is moving. Dots are formed on the paper when ink droplets ejected from the head land on the paper.

Next, the controller 260 performs the carrying process (S204). The carrying process is a process for moving the paper relative to the head in the carrying direction. The controller 260 drives the carry motor to rotate the carry roller and thereby carry the paper in the carrying direction. Through this carrying process the head 241 can form dots at positions that are different from the positions of the dots formed in the preceding dot formation process.

Next, the controller 260 determines whether or not to discharge the paper under printing (S205). The paper is not discharged if there are still data for printing on the paper which is currently being printed on. In this case, the controller 260 alternately repeats the dot formation and carrying processes until there is no longer data for printing, thereby gradually printing an image made of dots on the paper. When there are no longer data for printing on the paper which is currently being printed on, the controller 260 discharges that paper. The controller 260 discharges the printed paper to the outside by rotating the paper discharge roller. It should be noted that whether or not to discharge the paper can also be determined based on a paper discharge command included in the print data.

Next, the controller 260 determines whether or not to continue printing (S206). If the next sheet of paper is to be printed, then printing is continued and the paper supply process for the next sheet of paper is started. If the next sheet of paper is not to be printed, then the printing operation is ended.

(2) Paper Supply Processing

Figure 21:
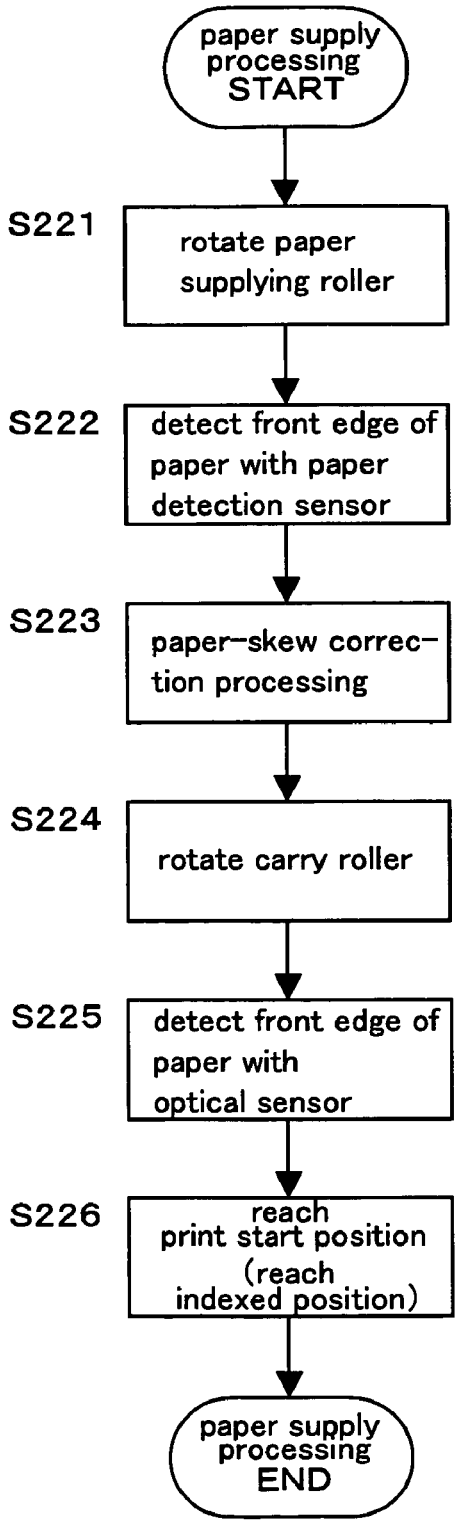
FIG. 21 is a flowchart of the paper supply processing.

FIG. 21 is a flowchart of the paper supply processing. Further, FIG. 22A to FIG. 22E are explanatory diagrams showing how the paper supply processing is performed as viewed from the upper surface. The various operations described below are achieved by the controller controlling the carry unit 220 based on a program stored in a memory of the printer 201. Further, this program is made up of codes for enabling the various operations described below.

First, the controller rotates the paper supplying roller (S221). The rotation of the paper supplying roller is started in accordance with a paper-supply command data included in the print data. When the paper supplying roller rotates, the paper is supplied toward the carry roller. The position of the paper S and the structural elements at this timing is as shown in FIG. 22A.

Next, the paper detection sensor 253 detects the front edge of the paper (S222). That is, it is possible to detect that the front edge of the paper S has reached the position of the paper detection sensor 253 by detecting the rotation of the lever as the front edge of the paper S comes into contact with the lever of the paper detection sensor 253. The paper detection sensor 253 is provided at a position where it can detect the paper front edge while the paper supplying roller 221 is supplying the paper toward the carry roller 223. Therefore, the paper detection sensor 253 can detect the front edge of the paper before the front edge of the paper reaches the carry roller. The position of the paper S and the structural elements at this timing is as shown in FIG. 22B.

Next, the controller performs paper-skew correction processing (S223). There are cases in which the posture of the paper is skewed with respect to the carrying direction before the paper is carried by the carry roller. Therefore, the controller corrects the skew in the paper by controlling the rotation of the paper supplying roller 221.

Figure 23:
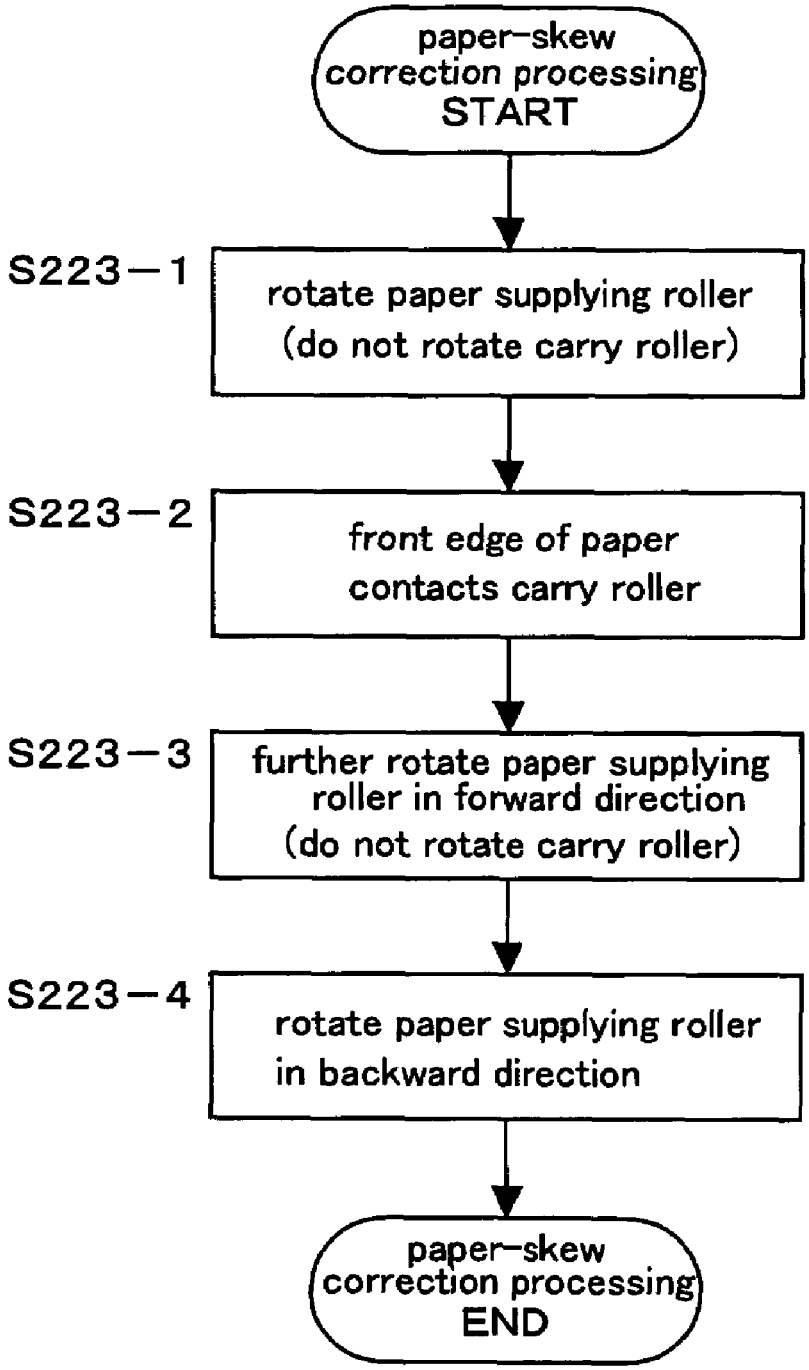
FIG. 23 is a flowchart of the paper-skew correction processing.

FIG. 23 is a flowchart of the paper-skew correction processing. Further, FIG. 24A to FIG. 24D are explanatory diagrams of how the paper-skew correction processing is performed as viewed from the upper surface. The various operations described below are achieved by the controller controlling the carry unit 220 based on a program stored in a memory of the printer 201. Further, this program is made up of codes for enabling the various operations described below.

First, in a state where the rotation of the carry roller 223 is stopped, the controller rotates the paper supplying roller 221 in the forward direction (the rotating direction by which the paper is supplied toward the carry roller) (S223-1; FIG. 24A). When the controller continues this operation, the front edge of the paper S comes into contact with the carry roller 223 (S223-2; FIG. 24B). Next, in a state where the rotation of the carry roller 223 is stopped, the controller further rotates the paper supplying roller 221 in the forward direction (S223-3). At this time, since the carry roller 223 is in a stopped state, the paper S cannot move forward in the carrying direction, and thus a slippage occurs between the paper supplying roller 221 and the paper S, thereby causing the front edge of the paper S to become parallel with the axial direction of the carry roller 223 (FIG. 24C). Next, the controller makes the paper supplying roller 221 rotate backwards, to thereby make the front edge of the paper S move away from the carry roller 223 (S223-4; FIG. 24D).

By performing the above processing, the controller can carry the paper while correcting the skew in the paper.

Next, the controller rotates the carry roller 223 (S224). At this time, since the paper supplying roller 221 and the carry roller 223 rotate in synchronization, the paper is carried up to the printable region by the two rollers. The position of the paper S and the structural elements at this timing is as shown in FIG. 22C.

Next, the optical sensor 254 detects the front edge of the paper (S225). The optical sensor is provided at a position where it can detect the front edge of the paper before the front edge of the paper reaches the print start position. The controller controls the carry motor such that, when the optical sensor 254 detects the front edge of the paper, the carry roller 223 rotates by a predetermined rotation amount. The position of the paper S and the structural elements at this timing is as shown in FIG. 22D.

If the carry roller 223 is rotated by the predetermined rotation amount, then the front edge of the paper will reach the print start position. That is, since the distance from the position where the optical sensor 254 detects the front edge of the paper to the print start position is known, if the controller rotates the carry roller by the predetermined rotation amount when the optical sensor 254 detects the front edge of the paper, then the front edge of the paper will be positioned at the print start position. The position of the paper S and the structural elements at this timing is as shown in FIG. 22E.

(2) Carrying Process

<Regarding the Carrying Process>

Figure 25:
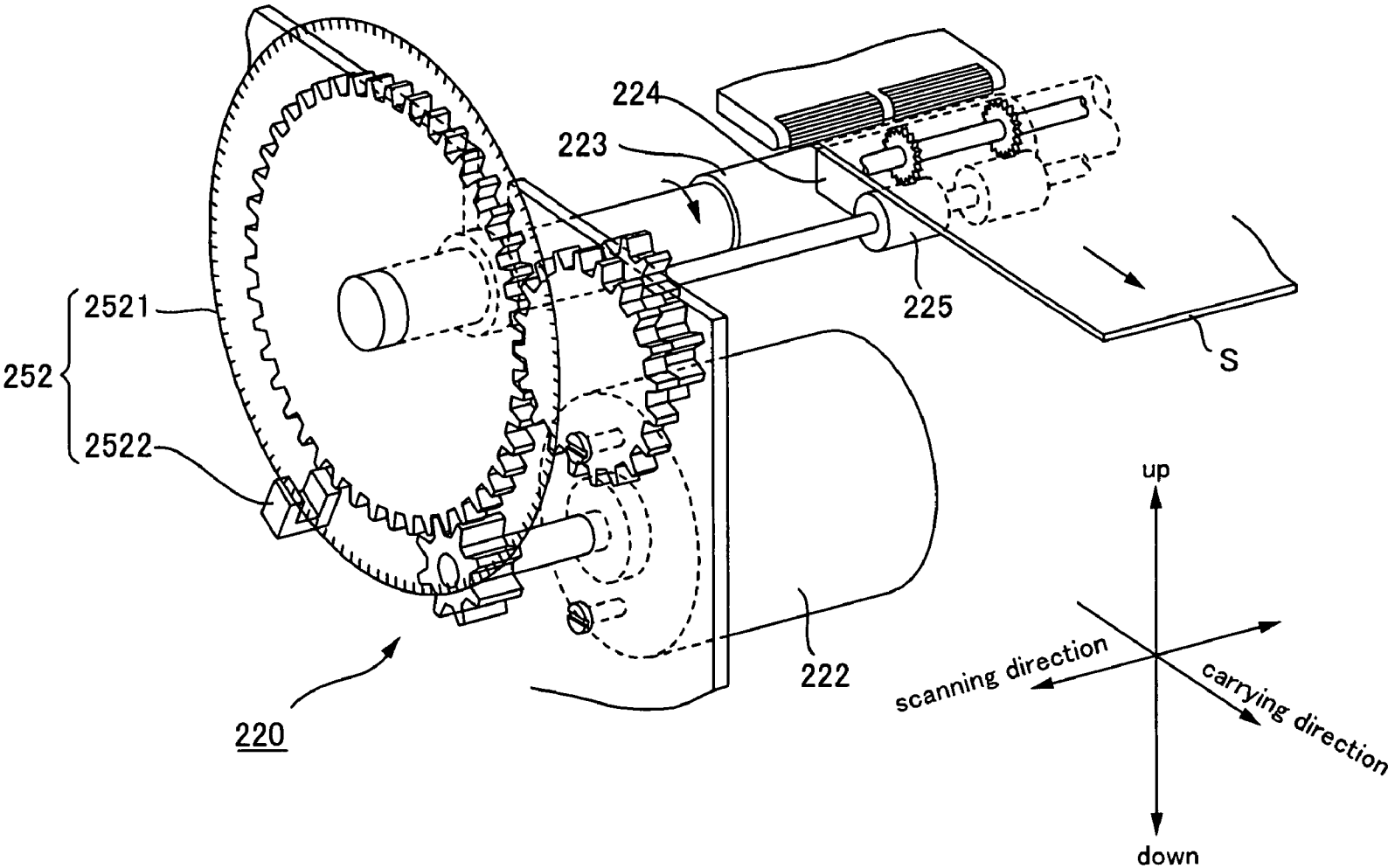
FIG. 25 is an explanatory diagram of showing the structure of the carry unit.

FIG. 25 is an explanatory diagram of showing the structure of the carry unit 220. It should be noted that in this diagram, structural elements that have already been described are assigned identical reference numerals and further description thereof has been omitted.

The carry unit 220 drives the carry motor 222 by a predetermined drive amount in accordance with a carry command from the controller. The carry motor 222 generates a drive force in the rotation direction that corresponds to the drive amount that has been ordered. The carry motor 222 then rotates the carry roller 223 using this drive force. The carry motor 222 also rotates the paper discharge roller 225 using this drive force. That is, when the carry motor 222 generates a predetermined drive amount, the carry roller 223 and the paper discharge roller 225 rotate by a predetermined rotation amount. When the carry roller 223 and the paper discharge roller 225 are rotated by the predetermined rotation amount, the paper is carried by a predetermined carry amount. Because the carry roller 223 and the paper discharge roller 225 rotate in synchronization, the paper can be carried by the carry unit 220 as long as the paper is in contact with at least one of the carry roller 223 and the paper discharge roller 225.

The carry amount, by which the paper is carried, is determined according to the rotation amount of the carry roller 223. Consequently, if the rotation amount of the carry roller 223 can be detected, then it is also possible to detect the carry amount of the paper. Accordingly, the rotary encoder 252 is provided in order to detect the rotation amount of the carry roller 223.

<Regarding the Structure of the Rotary Encoder>

FIG. 26 is an explanatory diagram of the configuration of the rotary encoder. It should be noted that in this diagram, structural elements that have already been described are assigned identical reference numerals and further description thereof has been omitted.

The rotary encoder 252 has a scale 2521 and a detecting section 2522.

The scale 2521 has numerous slits provided at predetermined intervals. The scale 2521 is provided in the carry roller 223. That is, the scale 2521 rotates together with the carry roller 223 when the carry roller 223 is rotated. For example, when the carry roller 223 is rotated such that the paper S is carried by 1/1440 inch, the scale 2521 is rotated by one slit with respect to the detecting section 2522.

The detecting section 2522 is provided in opposition to the scale 2521, and is fastened on the printer body side. The detecting section 2522 has a light-emitting diode 2522A, a collimating lens 2522B, and a detection processing section 2522C. The detection processing section 2522C is provided with a plurality of (for instance, four) photodiodes 2522D, a signal processing circuit 2522E, and two comparators 2522Fa and 2522Fb.

The light-emitting diode 2522A emits light when a voltage Vcc is applied to it via resistors on both sides, and this light is incident on the collimating lens. The collimating lens 2522B turns the light that is emitted from the light-emitting diode 2522A into parallel light, and irradiates the parallel light on the scale 2521. The parallel light that has passed through the slits provided in the scale then passes through stationary slits (not shown) and is incident on the photodiodes 2522D. The photodiodes 2522D convert the incident light into electric signals. The electric signals that are output from the photodiodes are compared in the comparators 2522Fa and 2522Fb, and the results of these comparisons are output as pulses. Then, the pulse ENC-A and the pulse ENC-B that are output from the comparators 2522Fa and 2522Fb become the output of the rotary encoder 252.

<Regarding the Signals of the Rotary Encoder>

FIG. 27A is a timing chart of the waveforms of the output signals when the carry motor 222 is rotating forward. FIG. 27B is a timing chart of the waveforms of the output signals when the carry motor 222 is rotating in reverse.

As shown in the figure, the phases of the pulse ENC-A and the pulse ENC-B are misaligned by 90 degrees both when the carry motor 12 is rotating forward and when it is rotating in reverse. When the carry motor 222 is rotating forward, that is, when the paper S is carried in the carrying direction, then the phase of the pulse ENC-A leads the phase of the pulse ENC-B by 90 degrees. On the other hand, when the carry motor 222 is rotating in reverse, that is, when the paper S is carried in the direction opposite from the carrying direction, then the phase of the pulse ENC-A trails the phase of the pulse ENC-B by 90 degrees. A single period T of the pulses is the same as the time during which the carry roller 223 is rotated by an interval of the slits of the scale 2521 (for example, by 1/1440 inch (1 inch=2.54 cm)).

By counting the number of pulse signals with the controller, the rotation amount of the carry roller 223 can be detected, and thus the carry amount of the paper can be detected. Also, by detecting a single period T of the pulses with the controller, the rotation velocity of the carry roller 223 can be detected, and thus the carry velocity of the paper can be detected.

<Regarding the Flow of Carrying>

Figure 28:
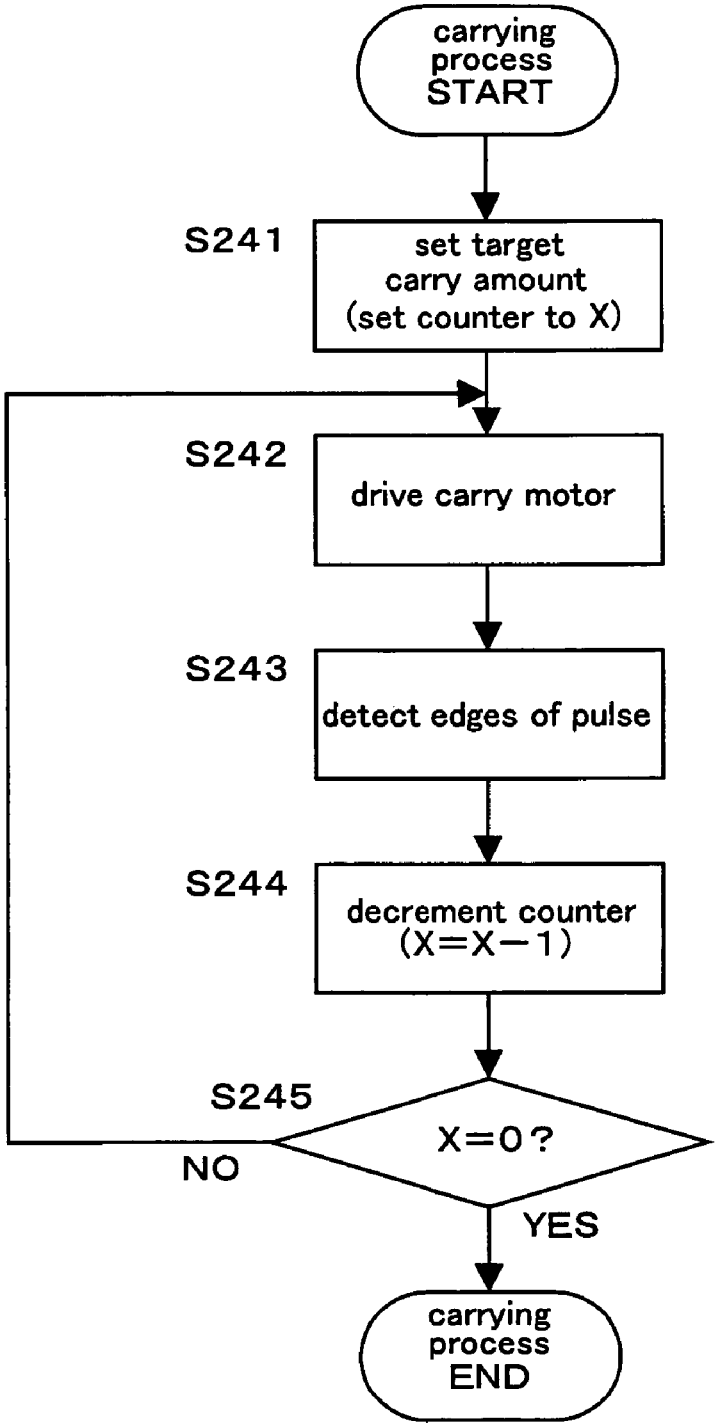
FIG. 28 is a flowchart of the carrying process.

FIG. 28 is a flowchart of the carrying process. The various operations that are described below are achieved by the controller controlling the carry unit 220 based on a program stored in the memory in the printer 201. Also, this program is made of codes for performing the various operations described below.

First, the controller sets a target carry amount (S241). The target carry amount is a value determining the drive amount of the carry unit 220 in order for the carry unit 220 to carry the paper S by a carry amount that has been defined as a target. The target carry amount is determined based on carry command data (information about the target carry amount) included in the print data that are received from the computer side. The target carry amount is set by setting the value of the counter with the controller. In the following description, the target carry amount is defined as X, and thus the controller sets the value of the counter to X.

Next, the controller drives the carry motor 222 (S242). When the carry motor 222 generates a predetermined drive amount, the carry roller 223 is rotated by a predetermined rotation amount. Then, the slits 521 provided in the carry roller 223 are also rotated when the carry roller 223 is rotated by the predetermined rotation amount.

Next, the controller detects the edge of the pulse signal of the rotary encoder (S243). That is, the controller detects the rising edge or the falling edge of the pulse ENC-A or the pulse ENC-B. For example, if the controller detects one edge, then this means that the carry roller 223 has carried the paper S by a carry amount of 1/1440 inch.

When the controller has detected an edge of the pulse signal of the rotary encoder, the controller subtracts this from the value of the counter (S244). That is, if the value of the counter is X, then the controller sets the value of the counter to X−1 when it has detected one edge of the pulse signal.

Next, the controller repeats the operations of S242 to S244 until the value of the counter becomes zero (S245). That is, the controller drives the carry motor 222 until the same number of pulses as the value initially set in the counter have been detected. In this fashion, the carry unit 220 carries the paper S in the carrying direction by a carry amount that corresponds to the value initially set in the counter.

For example, for the carry unit 220 to carry the paper S by 90/1440 inch, the controller sets the value of the counter to 90, thereby setting the target carry amount. The controller then decrements the value of the counter each time that it detects a rising edge or a falling edge of the pulse signal of the rotary encoder. Then, when the value of the counter has reached zero, the controller ends the carrying operation. This is because the detection of 90 pulse signals means that the carry roller 223 has carried the paper S by 90/1440 inch. Consequently, if the controller sets the value of the counter to 90 as the settings for the target carry amount, then the result is that the carry unit 220 carries the paper S by 90/1440 inch.

It should be noted that in the foregoing description, the controller detects the rising edge or the falling edge of the pulse ENC-A or the pulse ENC-B, but it is also possible for it to detect both edges of the pulse ENC-A and the pulse ENC-B. The cycles of the pulse ENC-A and the pulse ENC-B are equal to the slit intervals of the scales 2521 and the phases of the pulse ENC-A and the pulse ENC-B are misaligned by 90 degrees, and therefore, detection by the controller of either the rising edge or the falling edge of the pulses means that the carry roller 223 has carried the print paper by 1/5760 inch. In the present case, if the controller sets the value of the counter to 90, then the carry unit 220 carries the paper S by 90/5760 inch.

The foregoing description is for a single carrying operation. If the printer is to intermittently perform the carrying operation for a plurality of times, then the controller sets the target carry amount (sets the value of the counter) each time the carrying operation is finished, and the carry unit 220 carries the paper S in accordance with the target carry amount that has been set.

Incidentally, the rotary encoder 252 directly detects the rotation amount of the carry roller 223, and strictly speaking, does not detect the carry amount of the paper S. That is, if slippage occurs between the carry roller 223 and the paper S, then the rotation amount of the carry roller 223 and the carry amount of the paper S will not match, and thus the rotary encoder 252 cannot accurately detect the carry amount of the paper S, resulting in a carry error (detection error). When slippage occurs between the carry roller 223 and the paper S in this manner, it is necessary for the controller to rotate the carry roller 223 by a larger carry amount than the target carry amount in order for the carry unit 220 to carry the paper S by the target carry amount. Accordingly, the controller is capable of correcting the target carry amount and setting the counter to a value that corresponds to the corrected target carry amount in order to carry the paper S by the most suitable carry amount.

(2) Arrangement of the Nozzles

Figure 29:
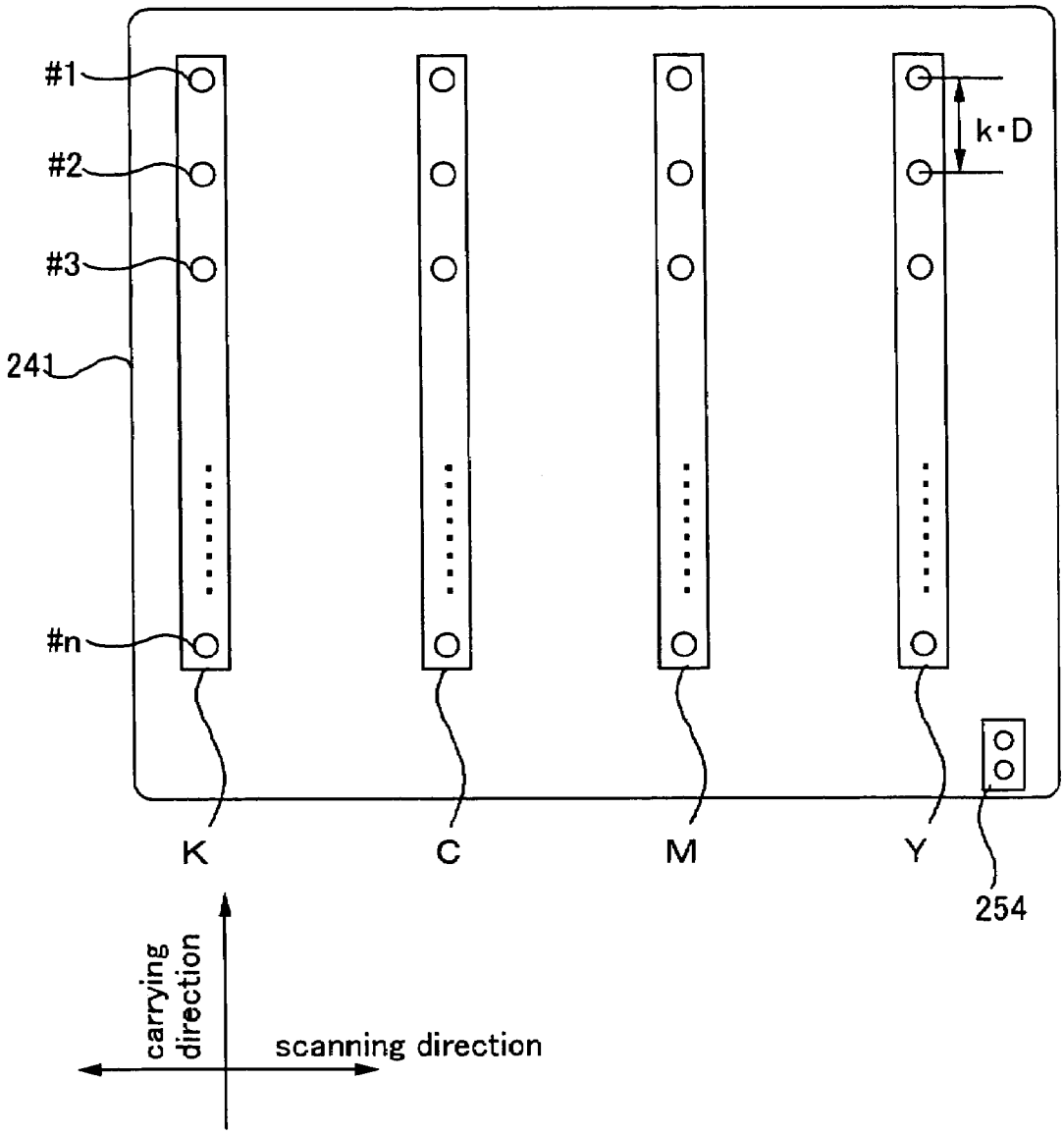
FIG. 29 is an explanatory diagram showing the arrangement of nozzles.

FIG. 29 is an explanatory diagram showing the arrangement of nozzles in the lower surface of the head 241. A black ink nozzle group K, a cyan ink nozzle group C, a magenta ink nozzle group M, and a yellow ink nozzle group Y are formed in the lower surface of the head 241. Each nozzle group is provided with a plurality of nozzles (in this embodiment, 180 nozzles), which are ejection openings for ejecting ink of the respective colors.

The plurality of nozzles in each nozzle group are arranged in a row at a constant spacing (nozzle pitch: k·D) in the carrying direction. Here, D is the minimum dot pitch in the carrying direction (that is, the interval between dots, which are formed on the paper S, at the maximum resolution). Furthermore, k is an integer that is 1 or greater. For example, if the nozzle pitch is 180 dpi (1/180 inch), and the dot pitch in the carrying direction is 720 dpi (1/720), then k=4.

The nozzles in each nozzle group are assigned a number (#1 to #180) that becomes smaller the more downstream the nozzle is positioned. That is, the nozzle #1 is positioned more downstream in the carrying direction than the nozzle #180. Each nozzle is provided with a piezo element (not shown) as a drive element for driving the nozzle and causing it to eject an ink droplet. Also, the optical sensor 254 is arranged at a position on the upstream side of the most upstream nozzle #180 (i.e., the nozzle most upstream in the carrying direction) as regards its position in the carrying direction. The attachment position of the optical sensor 254 is described in detail below.

(2) Detailed Description of the Optical Sensor

<Regarding the Configuration of the Optical Sensor>

Figure 30:
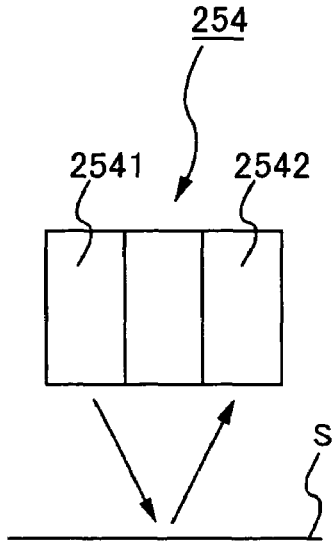
FIG. 30 is an explanatory diagram of a configuration of the optical sensor.

FIG. 30 is an explanatory diagram of a configuration of the optical sensor 254. The optical sensor 254 is a reflective-type optical sensor having a light-emitting section 541 and a light-receiving section 542. The light-emitting section 541 includes, for example, a light emitting diode, and emits light onto the paper. The light-receiving section 542 includes, for example, a phototransistor, and detects the reflected light of among the light emitted onto the paper from the light-emitting section. If the paper S does not exist in the region onto which the light-emitting section 541 emits light, then the amount of reflected light received by the light-receiving section 542 becomes small. If the paper S exists in the region onto which the light-emitting section 541 emits light, then the amount of reflected light received by the light-receiving section 542 becomes large. The light-receiving section 542 outputs signals in accordance with the amount of reflected light that it receives.

<Regarding the Output Signal of the Optical Sensor>

Figure 31:
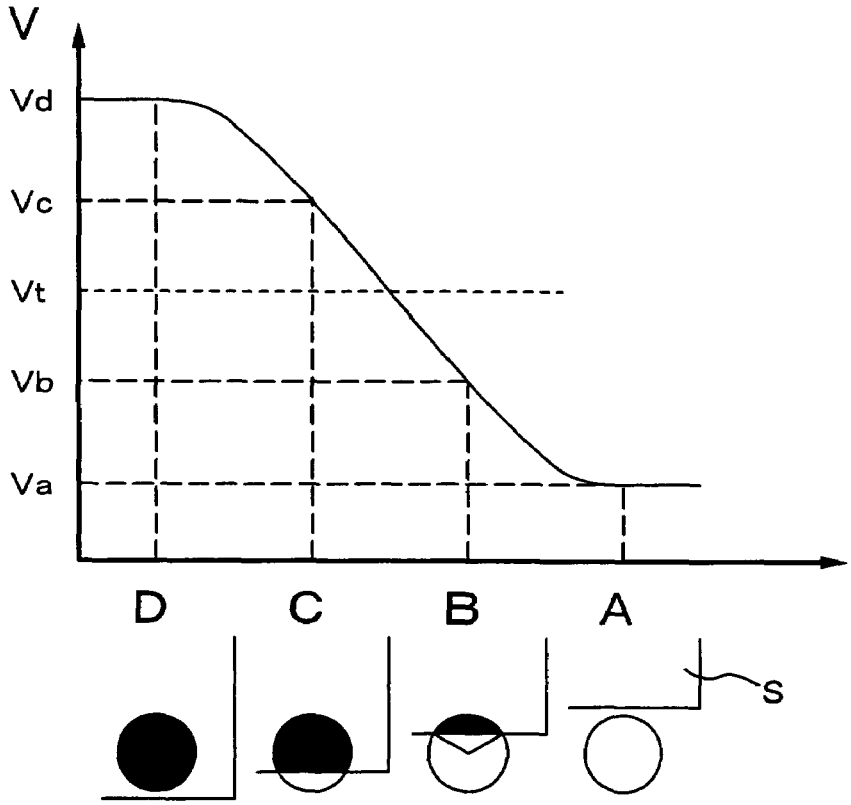
FIG. 31 is an explanatory diagram of output signals of the optical sensor 54.

FIG. 31 is an explanatory diagram of output signals of the optical sensor 254. The graph shown on the upper side of the figure is a graph showing a relationship between the position of the edge of the paper S and the output signal of the optical sensor 254. The diagrams on the lower side of the figure are diagrams showing relationships between the position of the edge of the paper S and the detection spot of the optical sensor. In the figure, the circle indicates the detection spot (detection region) of the optical sensor, and more specifically, it indicates the region onto which the light from the light-emitting section of the optical sensor 254 is emitted. The region within the circle that is filled in with black indicates that the light from the light-emitting section of the optical sensor 254 is being emitted on the paper S.

In state A (i.e., in a state where the edge of the paper S is outside the detection spot of the optical sensor and the paper S is not in the detection spot), the light from the light-emitting section of the optical sensor 254 is not emitted onto the paper S. Therefore, the light-receiving section of the optical sensor 254 cannot detect the reflected light. The output voltage of the optical sensor at this time becomes Va. In state B (i.e., in a state where the edge of the paper S is inside the detection spot of the optical sensor and the paper S is in a portion of the detection spot), a portion of the light from the light-emitting section of the optical sensor 254 is emitted on the paper S. The output voltage of the optical sensor 254 at this time becomes Vb. In state C (i.e., in a state where the edge of the paper S is inside the detection spot of the optical sensor and the paper S is in almost the entire detection spot), almost all of the light from the light-emitting section of the optical sensor 254 is emitted on the paper S. The output voltage of the optical sensor 254 at this time becomes Vc. In state D (i.e., in a state where the edge of the paper S is outside the detection spot of the optical sensor and the paper S is in the entire detection spot), all of the light from the light-emitting section of the optical sensor 254 is emitted on the paper S. The output voltage of the optical sensor at this time becomes Vd. As apparent from the figure, the larger the region occupied by the paper S in the detection spot of the optical sensor 254, the larger the output signal of the optical sensor 254 becomes.

When an output value Vt is set as a threshold, the controller determines the state A and the state B as a "no paper state". When the controller makes a determination of a "no paper state", then the printer performs the various operations assuming that there is no paper at the position of the optical sensor. On the other hand, when the output value Vt is set as a threshold, the controller determines the state C and the state D as a "paper existing state". When the controller makes a determination of a "paper existing state", then the printer performs the various operations assuming that there is paper at the position of the optical sensor.

The output value Vt can be set freely within a range from Va to Vd; here, it is equal to the output value of the optical sensor 254 for when the paper S occupies half of the detection spot.

<Regarding the Attachment Position of Optical Sensor>

Figure 32:
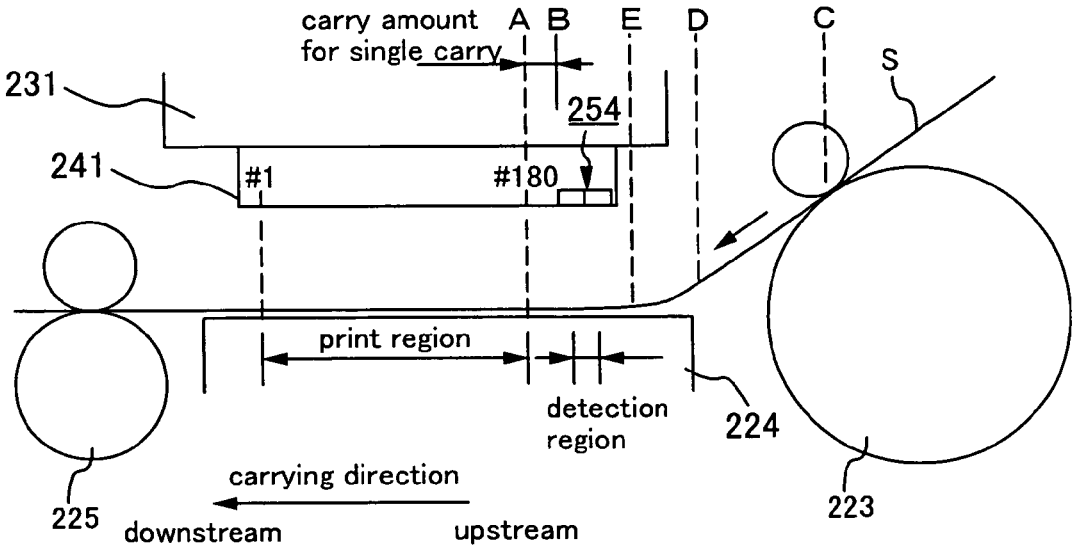
FIG. 32 is an explanatory diagram of an attachment position of the optical sensor.

FIG. 32 is an explanatory diagram of an attachment position of the optical sensor 254. Structural elements that have already been described are assigned identical reference numerals, and further description of those structural elements has been omitted. In the figure, the carriage 231 is movable in a direction perpendicular to the paper face (i.e., in the scanning direction). Further, the optical sensor 254 is attached to the carriage 231 and is movable in the scanning direction. Further, in the figure, the "print region" is a region that is in opposition to the nozzle #1 to nozzle #180 of the head 241, and is a region on which the ink ejected from the nozzles lands. Further, in the figure, the "detection spot" is the region onto which the light from the light-emitting section of the optical sensor 254 is emitted, and is the same region as the region indicated by the circle in FIG. 31 described above.

The optical sensor 254 is arranged on the upstream side, in the carrying direction, of the most upstream nozzle #180. That is, the optical sensor 254 is more on the upstream side than the position A in the figure. Therefore, the detection spot of the optical sensor 254 is positioned on the upstream side, in the carrying direction, of the print region. Therefore, when the paper S is carried from the carry roller 223 toward the print region, the front edge (upper edge) of the paper S reaches the detection spot of the optical sensor 254 before reaching the print region. In other words, the optical sensor 254 is able to detect the front edge of the paper S before the front edge of the paper S becomes printable.

Similarly, when the rear edge of the paper S moves away from the carry roller 223 and the paper S is carried by the paper discharge roller 225, the rear edge (lower edge) of the paper S reaches the detection spot of the optical sensor 254 before reaching the print region. In other words, the optical sensor 254 is able to detect the rear edge of the paper S before the rear edge of the paper S becomes printable.

Further, during printing, the paper S is carried intermittently by a predetermined carry amount. The optical sensor 254 is positioned on the upstream side with respect to the nozzle #180 by more than a carry amount for a single carry. That is, the optical sensor 254 is positioned on the upstream side, in the carrying direction, away from the nozzle #180 by more than a carry amount for a single carry. In other words, the optical sensor 254 is more on the upstream side than the position B in the figure. For example, according to a certain print mode, the carry amount for a single carry is $^{50}/_{1440}$ inch, and so the optical sensor 254 is provided away from the nozzle #180 by $^{50}/_{1440}$ inch or more. Therefore, when printing on the rear edge of the paper S (described later), a dot formation process (S203) is performed at least once during a period from when the optical sensor 254 detects the rear edge of the paper S up to when the rear edge reaches the print region.

Further, the optical sensor 254 is on the upstream side, in the carrying direction, of the nozzle #180, but is on the downstream side, in the carrying direction, of the carry roller 223. That is, the optical sensor 254 is more on the downstream side than the position C in the figure. The reason to this is described below. After the optical sensor 254 has detected the front edge of the paper, the controller controls the carry amount of the paper based on the result of the detection of the optical sensor 254 and positions the paper such that the front edge of the paper is at the print start position. (the indexed position) On the other hand, as described above, before the carry roller 223 carries the paper, the paper-skew correction processing is performed (refer to FIG. 23 and FIG. 24). In the paper-skew correction processing, the controller rotates the paper supplying roller 221 in a state where the carry roller 223 is stopped, and the skew in the paper is corrected by causing a slippage between the paper supplying roller 221 and the paper. Therefore, if the optical sensor 254 is provided on the upstream side of the carry roller 223 in the carrying direction, then it is not possible to correctly position the front edge of the paper at the print start position due to the slippage between the paper supplying roller 221 and the paper when performing the paper-skew correction. That is, it is preferable for the optical sensor 254 to be able to detect the front edge of the paper after the paper-skew correction processing is finished. Therefore, in the present embodiment, the optical sensor 254 is arranged on the downstream side, in the carrying direction, of the carry roller 223.

Further, not only is the optical sensor 254 arranged on the downstream side of the carry roller 223, it is arranged such that its detection spot is on the platen. In other words, the optical sensor 254 is on the downstream side of the position D in the figure. The reason to this is described below. The amount of light emitted by the light-emitting section of the optical sensor 254 of the present embodiment changes due to deterioration, even when the voltage applied to the light-emitting section is the same. When the amount of light emitted by the light-emitting section changes, the amount of light received by the light-receiving section changes, and thus, the position of the edge of the paper that is detected by the optical sensor 254 also changes. Therefore, as for the optical sensor 254 of the present embodiment, the voltage applied to the light-emitting section is controlled based on the output signal of the light-receiving section in a state where there is no paper. In this case, the light-emitting section of the optical sensor emits light onto the platen 224, and control is performed such that the output signal of the light-receiving section at this time becomes constant. In other words, as for the optical sensor 254 of the present embodiment, calibration is performed based on the output signal in a state in which the platen is not supporting the paper. If the detection spot of the optical sensor 254 includes the carry roller 223, then, the light-receiving section will receive a large amount of reflected light because the carry roller 223 is made of metal; therefore, even in a state where there is no paper, the output signal will be the same as that for a state where there is paper, and thus, it will not be possible to detect the degree of deterioration of the optical sensor 254. Therefore, in the present embodiment, the optical sensor 254 is arranged such that the detection spot is on the platen.

Further, not only is the optical sensor arranged such that its detection spot is on the platen, but it is arranged such that the detection spot of the optical sensor is positioned at a position where the posture of the paper is stable. In other words, the optical sensor 254 is arranged more on the downstream side than the position E in the figure. The position where the posture of the paper is stable (position E) is described below.

FIG. 33A to FIG. 33D are explanatory diagrams showing how the paper S is carried from the carry roller 223 toward the print region. Structural elements that have already been described are assigned identical reference numerals, and further description of those structural elements has been omitted. If the paper is being carried by both the carry roller 223 and the paper discharge roller 225 as shown in FIG. 33D, then the paper will not lift up from the platen in the print region positioned between the carry roller 223 and the paper discharge roller 225. However, the paper is carried only by the carry roller 223 during the paper-supplying process and before the front edge of the paper reaches the paper discharge roller 225, and therefore, the paper tends to lift up from the platen and the front edge of the paper tends to come close to the head 241. Therefore, in the present embodiment, the paper is supplied in a slanted manner with respect to the platen 224, as shown in FIG. 33A. Then, by carrying the paper such that it abuts against the platen as shown in FIG. 33B and FIG. 33C, the front edge of the paper is prevented from lifting up from the platen 224, even before the front edge of the paper reaches the paper discharge roller 225. It should be noted that the position E in the figure is the position at which the front edge of the paper first comes into contact with the platen 224.

Since the paper is supplied in a slanted manner with respect to the platen 224 as described above, the paper S is away from the platen 224 on the upstream side of the position E in the figure. If the detection spot of the optical sensor 254 is arranged at a position where the paper S is away from the platen 224, then there is a possibility that the optical sensor 254 cannot correctly detect the position of the front edge of the paper. Therefore, in the present embodiment, the optical sensor 254 is arranged more on the downstream side than the position E.

By the way, the optical sensor 254 detects whether or not the paper is present using regular reflection (FIG. 30). Therefore, the position of the center of the detection spot (the center of detection) of the optical sensor 254 matches the position right in the middle, in the carrying direction, of the light-emitting section 541 and the light-receiving section 541 of the optical sensor 254. However, if the optical sensor 254 uses diffuse reflection for detecting whether or not the paper is present, then the position of the center of the detection spot may not necessarily be right in the middle of the light-emitting section 541 and the light-receiving section 541 of the optical sensor 254.

The detection spot of the optical sensor 254 does not converge on one point, but occupies a predetermined region. In other words, the detection spot of the optical sensor 254 has a predetermined width in the carrying direction. Therefore, it is preferable for the optical sensor 254 to be arranged taking into consideration the width of the detection spot. In other words, it is preferable to arrange the optical sensor 254 such that the entire detection spot of the optical sensor 254 is in an appropriate position.

For example, it is preferable for the position, on the most downstream side in the carrying direction, of the detection spot of the optical sensor 254 to be positioned on the upstream side, in the carrying direction, of the nozzle #180 (i.e., on the upstream side in the carrying direction of the position A). Further, it is preferable for the position, on the most downstream side in the carrying direction, of the detection spot of the optical sensor 254 to be positioned on the upstream side, in the carrying direction, away from the nozzle #180 by more than a carry amount for a single carry (i.e., on the upstream side in the carrying direction of the position B). Furthermore, it is preferable for the position, on the most upstream side in the carrying direction, of the detection spot of the optical sensor 254 to be positioned on the downstream side of the carry roller 223 (i.e., on the downstream side in the carrying direction of the position C). Furthermore, it is preferable for the position, on the most upstream side in the carrying direction, of the detection spot of the optical sensor 254 to be on the platen 224 (i.e., on the downstream side in the carrying direction of the position D). Furthermore, it is preferable for the position, on the most upstream side in the carrying direction, of the detection spot of the optical sensor 254 to be positioned on the downstream side of the position at which the front edge of the paper first comes into contact with the platen 224 (i.e., on the downstream side in the carrying direction of the position E).

Further, the detection spot of the optical sensor 254 is not the same for all printers, but there are individual differences among the printers. For example, there is about a±0.3 mm variation in the width, in the carrying direction, of the detection spot of the optical sensor 254. Therefore, it is preferable to arrange the optical sensor 254 taking into consideration the variation in the width of the detection spot.

For example, it is preferable that the position, on the most downstream side in the carrying direction, of the detection spot of an average optical sensor 254 is positioned 0.3 mm further upstream, in the carrying direction, from the position A. Further, it is preferable that the position, on the most downstream side in the carrying direction, of the detection spot of an average optical sensor 254 is positioned 0.3 mm further upstream, in the carrying direction, from the position B. Further, it is preferable that the position, on the most upstream side in the carrying direction, of the detection spot of an average optical sensor 254 is positioned 0.3 mm further downstream, in the carrying direction, from the position C. Furthermore, it is preferable that the position, on the most upstream side in the carrying direction, of the detection spot of an average optical sensor 254 is positioned 0.3 mm further downstream, in the carrying direction, from the position D. Furthermore, it is preferable that the position, on the most upstream side in the carrying direction, of the detection spot of an average optical sensor 254 is positioned 0.3 mm further downstream, in the carrying direction, from the position E.

It should be noted that when attaching the optical sensor 254 to the carriage 231, a variation in the attachment position occurs due to tolerance. Therefore, it is preferable to design the optical sensor 254 such that, if attached within the range of tolerance, the whole detection spot of the optical sensor 254 is in an appropriate position. It should be noted that the variation in the attachment position due to tolerance is, for example, 0.5 mm.

(2) Borderless Printing

Figure 34:
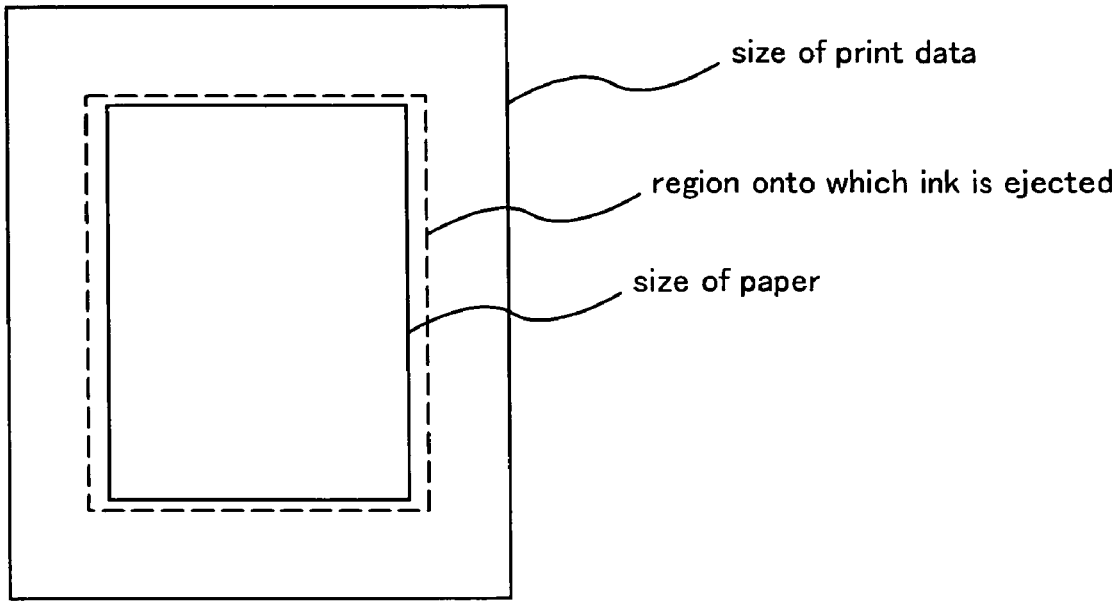
FIG. 34 is an explanatory diagram of borderless printing.

FIG. 34 is an explanatory diagram of borderless printing. "Borderless printing" is printing carried out over the entire surface of the paper. In the figure, the rectangle on the inner side which is drawn with the solid line shows the size of the paper. In the figure, the rectangle on the outside which is drawn with the solid line shows the size of the print data. In borderless printing, printing is carried out over the entire surface of the paper by ejecting ink onto a region that is larger than the paper. Therefore, the size of the print data is larger than the size of the paper. For this reason, the printer ejects ink also to the outside of the range of the paper.

However, if the amount of ink that does not land on the paper is large, then the amount of consumption of ink will become large, and this is not preferable. Therefore, waste of ink is prevented by masking the print data to make the region to which ink is ejected small. The rectangle drawn with the dashed line in the figure shows the region onto which the printer ejects ink based on masked print data. The region onto which ink is ejected is determined by the controller based on the output of the optical sensor.

<Regarding the Lateral Edge Processing>

FIG. 35A is an explanatory diagram of detection of the lateral edge of the paper. The hatched section in the figure shows the region in which dots are formed on the paper (the region that is printed). While the carriage 231 is moving in the scanning direction, the head 241 intermittently ejects ink to form dots in the hatched section of the figure and print a band-like strip of image on the paper. Since the carriage moves back and forth in the scanning direction during the dot formation process, the optical sensor 254 also moves back and forth in the scanning direction, and the optical sensor 254 can detect the position of both lateral edges of the paper.

FIG. 35B is an explanatory diagram of the lateral edge processing in borderless printing. The band-like rectangle in the figure shows print data for a single pass. It should be noted that a single pass means an operation in which the carriage 231 moves once in the scanning direction. More specifically, the band-like rectangle in the figure indicates data that is necessary for the nozzle #1 to nozzle #180 to eject ink during a single pass. The print data in the hatched section in the figure indicates print data that was used to eject ink from the head 241. On the other hand, the print data without the hatching in the figure indicates print data that was replaced by NULL data as a result of being masked, thereby resulting in the ink not being ejected from the head 241.

During the dot formation process, the lateral edge of the paper is detected by the optical sensor 254. Normally, it should be possible to complete borderless printing just by using only the print data corresponding to the inside of the detected paper to eject ink, because this will result in the entire surface of the paper being printed. However, if the paper is carried skewed, then a blank section will be formed at the lateral edges of the paper, and thus it will not be possible to perform fine borderless printing. Therefore, the print data is masked, leaving a predetermined margin to allow for error due to the paper being carried skewed, and the region in which ink is ejected is set slightly wider than the lateral edges of the paper.

In the present embodiment, as described above, the optical sensor 254 is arranged on the upstream side of the nozzle #180. Therefore, the region where the optical sensor 254 detects whether or not the paper is present is away from the region in which the dots are formed on the paper. If ink is ejected in the detection spot of the optical sensor 254, then the precision of detection of the optical sensor 254 will drop. On the other hand, since in the present embodiment ink is not ejected in the detection spot of the optical sensor 254, it is possible for the optical sensor 254 to detect the lateral edges of the paper with high precision. As a result, it is possible to perform high-quality borderless printing, or suppress waste of ink as much as possible.

<Regarding the Rear Edge Processing>

FIG. 36A to FIG. 36C are explanatory diagrams of the rear edge processing of the present embodiment. Structural elements that have already been described are assigned identical reference numerals, and further description of those structural elements has been omitted. In the figure, the hatched section of the head 241 indicates that the nozzles within that region are to eject ink.

As shown in FIG. 36A, in normal dot formation process, if the optical sensor 254 detects a "paper existing state", then ink is ejected from all of the nozzles because all of the nozzles in the head 241 are in opposition to the paper. Then, after the dot formation process, the carrying process is performed at a predetermined carry amount.

As shown in FIG. 36B, as a result of the carrying process, the optical sensor 254 detects a "no paper state" when the rear edge of the paper passes the optical sensor 254. On the other hand, in the present embodiment, the optical sensor 254 is on the upstream side, in the carrying direction, away from the nozzle #180 by more than a carry amount for a single carry, as described above. Therefore, even when the optical sensor 254 detects a "no paper state", all of the nozzles eject ink because all of the nozzles provided in the head 241 are in opposition to the paper. Then, during the dot formation process in the state shown in the figure, the controller determines the nozzles for ejecting ink in the next pass in accordance with the timing at which the optical sensor 254 detects a "no paper state". That is, the controller determines the nozzles to be used in the next pass based on the result of detection of the optical sensor 254, such that ink is not ejected in the next pass from the nozzles on the upstream side of the rear edge of the paper. Then, after the dot formation process in the state shown in the figure, the carrying process is performed to further carry the paper by a predetermined carry amount in order to print on the rear edge of the paper.

Then, as shown in FIG. 36C, ink is not ejected from the nozzles on the upstream side of the rear edge of the paper, and ink is ejected from the nozzles on the downstream side of the rear edge of the paper to form dots on the rear edge of the paper.

In the present embodiment, according to the rear edge processing described above, it is possible to print on the rear edge of the paper while suppressing waste of ink as much as possible.

FIG. 37A and FIG. 37B are explanatory diagrams of the rear edge processing of a reference example. The attachment position of the optical sensor 254 is different compared to the present embodiment. In the reference example, the optical sensor 254 is arranged on the downstream side, in the carrying direction, of the nozzle #180.

In the reference example, even when the rear edge of the paper passes the optical sensor 254, there is no time for the controller to determine the nozzles to be used based on the detection results of the optical sensor. Therefore, as shown in FIG. 37B, wasteful ink that does not land on the rear edge of the paper is ejected. Even if the controller determines the nozzles to be used based on the determination results of the optical sensor, since it is not possible to perform printing while the controller is performing calculation, it will take much time for printing.

On the other hand, according to the present embodiment, the optical sensor 254 is arranged on the upstream side of the nozzle #180, as described above. Therefore, the rear edge of the paper passes the detection spot of the optical sensor 254 before it passes the nozzle #180, and thus, it is possible to suppress waste of ink as much as possible. Further, according to the present embodiment, the optical sensor 254 is on the upstream side, in the carrying direction, away from the nozzle #180 by more than a carry amount for a single carry, as described above. Therefore, at least the dot formation process is performed once during the period from when the rear edge of the paper has passed the detection spot of the optical sensor 254 up to when the rear edge reaches the print region (the region on the downstream side, in the carrying direction, of the nozzle #180). As a result, in the present embodiment, it is possible for the controller to perform calculation for the nozzles to be used during this dot formation process, and therefore, it becomes possible to print on the rear edge of the paper at high speed while suppressing waste of ink as much as possible.

(2) Other Embodiments

The foregoing embodiment described primarily a printer. However, it goes without saying that the foregoing description also includes the disclosure of printing apparatuses, recording apparatuses, liquid ejection apparatuses, printing methods, recording methods, liquid ejection methods, printing systems, recording systems, computer systems, programs, storage media storing programs, display screens, screen display methods, and methods for producing printed material, for example.

Also, a printer, for example, serving as an embodiment was described above. However, the foregoing embodiment is for the purpose of elucidating the present invention and is not to be construed as limiting the present invention. The invention can of course be altered and improved without departing from the gist thereof and includes equivalents. In particular, the implementations mentioned below are also included in the invention.

<Regarding the Optical Sensor>

According to the foregoing embodiment, the sensor provided on the carriage was a reflective-type optical sensor. The sensor, however, is not limited to that of the foregoing embodiment because it is only necessary for it to detect the edge of the paper.

For example, the sensor provided on the carriage may be a transmission-type sensor in which the edge of the paper is detected by detecting whether or not the light is blocked. Further, it may be a mechanical sensor.

<Regarding the Printer>

A printer was described in the foregoing embodiment, but this is not a limitation. For example, technology like that of the embodiment can also be adopted for various recording apparatuses that use the inkjet technology such as color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices. Further, methods for such devices and manufacturing methods thereof are within the scope of application. When the present technology is adopted in these fields, a reduction in material, process steps, and costs can be achieved compared to conventional art, because of the feature that liquid can be directly ejected (directly rendered) on an object.

<Regarding the Ink>

Since the foregoing embodiment was an embodiment of a printer, a dye ink or a pigment ink was ejected from the nozzles. However, the liquid that is ejected from the nozzles is not limited to such inks. For example, it is also possible to eject from the nozzles a liquid (including water) including metallic material, organic material (particularly macromolecular material), magnetic material, conductive material, wiring material, film-formation material, electronic ink, processed liquid, and genetic solutions. A reduction in material, process steps, and costs can be achieved if such liquids are directly ejected toward a target object.

<Regarding the Nozzles>

In the foregoing embodiment, ink was ejected using piezoelectric elements. However, the method for ejecting liquid is not limited to this. Other methods may also be employed, such as a method for generating bubbles in the nozzles through heat.

With the printing apparatus described above, it is possible to arrange the sensor for detecting the edge of the paper at the most suitable position, and to suppress waste of ink that is ejected from the nozzles.

INDUSTRIAL APPLICABILITY

With the liquid ejecting apparatus (printing apparatus) of the foregoing embodiments, it is possible to arrange the sensor for detecting the edge of the paper at the most suitable position, and to suppress waste of ink that is ejected from the nozzles.

The invention claimed is:

1. A liquid ejecting apparatus comprising:

a movable head that is provided with a plurality of nozzles for ejecting a liquid;

a transport unit for transporting a medium in a predetermined transporting direction; and a sensor for detecting lateral edges of said medium and that is movable with said head;

wherein a position, in the transporting direction, of said sensor is on an upstream side of a nozzle located most upstream in said transporting direction, of among said plurality of nozzles;

wherein said liquid ejecting apparatus generates print data expressing a print image, a width of said print image of said print data is wider than the width of said medium;

wherein said print data is masked so as to leave a margin outside each of said lateral edges detected by said sensor; and wherein, in accordance with the masked print data, said liquid ejecting apparatus ejects said liquid in a region that is set wider than the width of said medium and does not eject said liquid beyond said margin.

2. A liquid ejecting apparatus according to claim 1, wherein a position, on the most downstream side in said transporting direction, of a detection region of said sensor is located on the upstream side, in said transporting direction, of said nozzle located most upstream in said transporting direction.

3. A liquid ejecting apparatus according to claim 1, wherein said liquid is ink; and wherein said liquid ejecting apparatus is a printing apparatus that prints on a medium to be printed, which serves as said medium, by ejecting the ink from said nozzles.

4. A liquid ejecting apparatus according to claim 1, wherein said transport unit transports said medium by a predetermined transport amount in said transporting direction; and wherein the position, in the transporting direction, of said sensor is on the upstream side, in said transporting direction, away from said nozzle located most upstream in said transporting direction by more than said transport amount.

5. A liquid ejecting apparatus according to claim 4, wherein a position, on the most downstream side in said transporting direction, of a detection region of said sensor is on the upstream side, in said transporting direction, away from said nozzle located most upstream in said transporting direction by more than said transport amount.

6. A liquid ejecting apparatus according to claim 4, wherein said liquid ejecting apparatus ejects the liquid onto the edge of said medium using a portion of said plurality of nozzles after said sensor no longer detects said medium.

7. A liquid ejecting apparatus according to claim 6, wherein said liquid ejecting apparatus ejects the liquid onto said medium using all of said plurality of nozzles in a state where said sensor no longer detects said medium, and after said transport unit has further transported said medium by said transport amount, said liquid ejecting apparatus ejects said liquid onto the edge of said medium using a portion of said plurality of nozzles.

8. A liquid ejecting apparatus according to claim 1, wherein said transport unit has a transport roller for transporting said medium up to a position where said liquid can be ejected onto said medium; and wherein the position, in the transporting direction, of said sensor is on the downstream side of said transport roller.

9. A liquid ejecting apparatus according to claim 8, wherein a process of correcting a skew in said medium is performed on the upstream side of said transport roller.

10. A liquid ejecting apparatus according to claim 8, wherein a position, on the most upstream side in said transporting direction, of a detection region of said sensor is on the downstream side, in said transporting direction, of said transport roller.

11. A liquid ejecting apparatus according to claim 8, wherein said liquid ejecting apparatus further comprises a supporting section for supporting said medium that is transported from said transport roller; and wherein said sensor is arranged such that a detection region of said sensor is located on said supporting section.

12. A liquid ejecting apparatus according to claim 11, wherein calibration of said sensor is performed based on an output signal of said sensor in a state in which said supporting section is not supporting said medium.

13. A liquid ejecting apparatus according to claim 11, wherein a position, on the most upstream side in said transporting direction, of the detection region of said sensor is on said supporting section.

14. A liquid ejecting apparatus according to claim 11, wherein said transport unit transports said medium in a slanted manner with respect to said supporting section; and wherein the position of said sensor is on the downstream side, in said transporting direction, of a position at which a front edge of said medium first comes into contact with said supporting section.

15. A liquid ejecting apparatus according to claim 14, wherein said transport unit has a paper discharge roller for discharging said medium; and wherein said medium that has been transported in a slanted manner with respect to said supporting section passes a print region within which the liquid ejected from said nozzles land, and then reaches said paper discharge roller.

16. A liquid ejecting apparatus according to claim 14, wherein a position, on the most upstream side in said transporting direction, of the detection region of said sensor is on the downstream side, in said transporting direction, of the position at which the front edge of said medium first comes into contact with said supporting section.

17. A printing system comprising:

a main computer unit; and a liquid ejecting apparatus that is connectable to said main computer unit and that is provided with:

a movable head that is provided with a plurality of nozzles for ejecting a liquid;

a transport unit for transporting a medium in a predetermined transport direction; and a sensor for detecting lateral edges of said medium and that is movable with said head;

wherein a position, in the transporting direction, of said sensor is on an upstream side of a nozzle located most upstream in said transporting direction, of among said plurality of nozzles;

wherein said liquid ejecting apparatus generates print data expressing a print image, a width of said print image of said print data is wider than the width of said medium;

wherein said print data is masked so as to leave a margin outside each of said lateral edges detected by said sensor; and wherein, in accordance with the masked print data, said liquid ejecting apparatus ejects said liquid in a region that is set wider than the width of said medium and does not eject said liquid beyond said margin.

* * * * *